US010695814B2

(12) United States Patent
Nitta et al.

(10) Patent No.: US 10,695,814 B2
(45) Date of Patent: Jun. 30, 2020

(54) METHOD FOR MANUFACTURING PRESS-FORMED PRODUCT, DEVICE FOR MANUFACTURING PRESS-FORMED PRODUCT, MANDREL, AND PRESS-FORMED PRODUCT

(71) Applicant: NIPPON STEEL & SUMITOMO METAL CORPORATION, Tokyo (JP)

(72) Inventors: Jun Nitta, Futtsu (JP); Tohru Yoshida, Chiba (JP); Hiroshi Yoshida, Chiba (JP); Nobuo Yoshikawa, Kimitsu (JP); Shigeru Yonemura, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 310 days.

(21) Appl. No.: 15/107,715

(22) PCT Filed: Mar. 3, 2015

(86) PCT No.: PCT/JP2015/056184

§ 371 (c)(1),
(2) Date: Jun. 23, 2016

(87) PCT Pub. No.: WO2015/133464

PCT Pub. Date: Sep. 11, 2015

(65) Prior Publication Data

US 2016/0325330 A1 Nov. 10, 2016

(30) Foreign Application Priority Data

Mar. 4, 2014 (JP) ..... 2014-042144
Mar. 19, 2014 (JP) ..... 2014-057177
Oct. 10, 2014 (JP) ..... 2014-209361

(51) Int. Cl.
*B21D 7/06* (2006.01)
*B21D 22/22* (2006.01)
(Continued)

(52) U.S. Cl.
CPC ..... *B21D 7/06* (2013.01); *B21D 22/225* (2013.01); *B21D 22/26* (2013.01); *B21D 35/006* (2013.01);
(Continued)

(58) Field of Classification Search
CPC ... B21D 1/00; B21D 1/08; B21D 1/10; B21D 3/10; B21D 3/16; B21D 5/01;
(Continued)

(56) References Cited

U.S. PATENT DOCUMENTS 1,290,047 A * 1/1919 Bardeen ..... B21D 7/0225 72/380
1,322,267 A * 11/1919 Roth ..... B21D 7/06 72/390.6
(Continued)

FOREIGN PATENT DOCUMENTS

CN 2173669 Y 8/1994
CN 1178729 A 4/1998
(Continued)

OTHER PUBLICATIONS

Chinese Office Action and Search Report for counterpart Chinese Application No. 201580005983.0, dated Apr. 1, 2017, with an English translation of the Chinese Search Report.
(Continued)

*Primary Examiner* — Edward T Tolan
(74) *Attorney, Agent, or Firm* — Birch, Stewart, Kolasch & Birch, LLP

(57) ABSTRACT

A method for manufacturing a press-formed product includes: a first step of preparing a long material having a bending portion; and a second step of decreasing curvature of the bending portion while restricting both ends of the long material in a longitudinal direction.

9 Claims, 74 Drawing Sheets

(51) Int. Cl.

| | |
|---|---|
| ***B21D 35/00*** | (2006.01) |
| ***B21D 47/01*** | (2006.01) |
| ***B21J 5/08*** | (2006.01) |
| ***B21K 23/00*** | (2006.01) |
| ***B21D 22/26*** | (2006.01) |
| *B21D 53/88* | (2006.01) |

(52) U.S. Cl.
CPC ..... *B21D 47/01* (2013.01); *B21J 5/08* (2013.01); *B21K 23/00* (2013.01); *B21D 53/88* (2013.01)

(58) Field of Classification Search
CPC ..... B21D 7/022; B21D 11/08; B21D 35/001; B21D 7/06; B21D 22/225; B21D 47/01; B21D 22/20; B21D 22/22; B21D 22/26; B21D 22/30; B21C 37/0803; B21C 37/155; B21J 5/08
See application file for complete search history.

(56) References Cited

U.S. PATENT DOCUMENTS

| | | | | | |
|---|---|---|---|---|---|
| 1,945,092 | A * | 1/1934 | Storer | B21J 1/06 | 72/340 |
| 2,377,974 | A * | 6/1945 | Sherman | B21J 5/08 | 72/376 |
| 2,466,877 | A * | 4/1949 | Cross | B21C 37/28 | 72/364 |
| 2,830,645 | A * | 4/1958 | Huet | B21C 37/283 | 29/890.147 |
| 3,102,576 | A * | 9/1963 | Schilberg | B21D 3/10 | 72/362 |
| 3,429,169 | A * | 2/1969 | Boice | B21D 3/10 | 72/297 |
| 3,934,450 | A * | 1/1976 | Reed | B21D 7/06 | 72/383 |
| 4,175,419 | A * | 11/1979 | Mabery | B21C 37/283 | 29/890.051 |
| 4,483,175 | A * | 11/1984 | Hansen | B21D 3/10 | 72/390.5 |
| 4,625,533 | A * | 12/1986 | Okada | B21C 37/16 | 72/302 |
| 6,345,427 | B1 * | 2/2002 | Bostic | B21D 3/14 | 29/402.01 |
| 7,401,490 | B2 * | 7/2008 | Copeland | B21D 7/06 | 72/369 |
| 8,087,277 | B2 * | 1/2012 | Umeda | B21C 37/155 | 72/31.06 |
| 8,573,023 | B2 * | 11/2013 | Matsuda | B21C 37/02 | 72/352 |
| 10,065,230 | B2 * | 9/2018 | Joyce | B21D 47/01 | |
| 10,413,956 | B2 * | 9/2019 | Shinmiya | B21D 22/26 | |
| 2008/0299352 | A1 | 12/2008 | Matsuda et al. | | |
| 2012/0104717 | A1 * | 5/2012 | Hashimoto | B21D 9/15 | 280/124.166 |
| 2013/0255349 | A1 * | 10/2013 | Lee | B21D 7/06 | 72/414 |
| 2017/0165735 | A1 * | 6/2017 | Shinmiya | B21D 22/26 | |

FOREIGN PATENT DOCUMENTS

| | | | | | |
|---|---|---|---|---|---|
| CN | 200988062 | Y | | 12/2007 | |
| CN | 101234466 | A | | 8/2008 | |
| CN | 101323002 | A | | 12/2008 | |
| CN | 201644561 | U | | 11/2010 | |
| CN | 202021249 | U | | 11/2011 | |
| CN | 202779318 | U | | 3/2013 | |
| CN | 203018514 | U | | 6/2013 | |
| CN | 103521557 | A | | 1/2014 | |
| DE | 846957 | C | * | 8/1952 | B21D 3/10 |
| DE | 3022844 | A1 | | 1/1982 | |
| DE | 19512646 | A1 | * | 10/1996 | B21D 9/05 |
| DE | 102009024406 | A1 | | 12/2010 | |
| DE | 102011000845 | A1 | * | 8/2012 | B21D 9/00 |
| JP | 10-329503 | A | | 12/1968 | |
| JP | 56-148416 | A | * | 11/1981 | B21D 5/01 |
| JP | 59-47026 | A | * | 3/1984 | B21D 7/06 |
| JP | 4-9243 | A | | 1/1992 | |
| JP | 8-132142 | A | | 5/1996 | |
| JP | 2004-322104 | A | | 11/2004 | |
| JP | 2005-152975 | A | | 6/2005 | |
| JP | 2009-208149 | A | | 9/2009 | |
| JP | 2010-23112 | A | | 2/2010 | |
| JP | 2010-120062 | A | | 6/2010 | |
| JP | 2013-18016 | A | | 1/2013 | |
| WO | WO 94/06581 | A2 | | 3/1994 | |

OTHER PUBLICATIONS

Japanese Office Action dated Apr. 18, 2017, issued in Japanese Patent Application 2016-506494.

Chinese Search Report and Office Action, dated Mar. 1, 2019, for counterpart Chinese Application No. 201810144746.8, with an English translation of the Chinese Search Report.

International Search Report for PCT/JP2015/056184 dated Jun. 2, 2015.

Written Opinion of the International Searching Authority for PCT/JP2015/056184 (PCT/ISA/237) dated Jun. 2, 2015.

Chinese Office Action and Search Report for counterpart Chinese Application No. 201910638412.0, dated Apr. 26, 2020, with a English translation of the Search Report.

* cited by examiner

METHOD FOR MANUFACTURING PRESS-FORMED PRODUCT, DEVICE FOR MANUFACTURING PRESS-FORMED PRODUCT, MANDREL, AND PRESS-FORMED PRODUCT

TECHNICAL FIELD OF THE INVENTION

The present invention relates to a method for manufacturing a press-formed product, a device for manufacturing a press-formed product, a mandrel, and a press-formed product.

Priority is claimed on Japanese Patent Application No. 2014-042144, filed on Mar. 4, 2014, Japanese Patent Application No. 2014-057177, filed on Mar. 19, 2014, and Japanese Patent Application No. 2014-209361, filed on Oct. 10, 2014, the contents of which are incorporated herein by reference.

RELATED ART

In automobiles, high rigidity of a vehicle body is required in order to secure handling stability or the like while a decrease in weight of the vehicle body is required to improve fuel consumption. A press-formed product obtained by press-forming a steel sheet is used in a portion of a skeleton member of the vehicle body. Decreasing the thickness of the press-formed product is considered to decrease the weight of the vehicle body. However, if the thickness decreases, rigidity decreases. Accordingly, in order to decrease the weight of the press-formed product and increase the rigidity thereof, increasing the thickness of a portion of the press-formed product is considered.

For example, Patent Document 1 discloses a method for manufacturing a vehicle component using a tailored blank material. In addition, a steel sheet (reinforcing material) may be welded to the skeleton member of the vehicle body so as to partially increase the thickness of the skeleton member.

CITATION LIST

Patent Document

[Patent Document 1] Japanese Unexamined Patent Application, First Publication No. 2005-152975

DISCLOSURE OF THE INVENTION

Problems to be Solved by the Invention

A tailored blank material is manufactured by welding steel sheets having tensile strength different from each other or steel sheets having thicknesses different from each other. However, in a case where the tailored blank material is press-formed, stress is concentrated in a weld, and there is a concern that cracks or ruptures occur. In addition, since a welding process is required, there is a concern that production efficiency decreases.

In addition, in a case where a steel sheet is welded to a skeleton member of a vehicle body so as to partially increase the thickness, weight of the skeleton member increases, and this case goes against a decrease in the weight of the vehicle. In addition, in this case, similarly to the case of the tailored blank material, since a welding process is required, there is a concern that production efficiency decreases.

The present invention is made in consideration of the above-described circumferences, and an object thereof is to provide a method for manufacturing a press-formed product, a device for manufacturing a press-formed product, a mandrel, and a press-formed product capable of simultaneously achieving a decrease in weight and high rigidity without the need of welding.

Means for Solving the Problem

In order to solve the problems, the present invention adopts the following.

(1) According to a first aspect of the present invention, a method for manufacturing a press-formed product, includes: a first step of preparing a long material having a bending portion; and a second step of decreasing curvature of the bending portion while restricting both ends of the long material in a longitudinal direction.

(2) In the aspect according to (1), in the second step, the curvature may decrease while the shortest distance between both ends of the long material is constantly maintained.

(3) In the aspect according to (1), in the second step, the curvature may decrease while the shortest distance between both ends of the long material decreases.

(4) In the aspect according to any one of (1) to (3), in the second step, the curvature may decrease while at least a concave side of the bending portion of the long material is supported.

(5) In the aspect according to any one of (1) to (4), in the second step, the curvature may decrease in stages.

(6) In the aspect according to any one of (1) to (5), planes including edges of both ends of the long material may be parallel with each other.

(7) According to a second aspect of the present invention, a device for manufacturing a press-formed product using a long material having a bending portion, includes: a first press tool which includes a base portion, and a pair of restriction walls which is provided on the base portion, comes into contact with both ends of the long material in a longitudinal direction, and faces each other; and a second press tool which includes a punch portion which presses a convex side of the bending portion of the long material inserted into between the pair of restriction walls, in which the distance between the pair of restriction walls is shorter than the entire length when the long material linearly extends.

(8) In the aspect according to (7), the distance between the pair of restriction walls may be the same as the shortest distance between both ends of the long material in the longitudinal direction.

(9) In the aspect according to (7) or (8), each of the pair of restriction walls may include a curve shaped guide surface which comes into contact with the end portion of the long material in the longitudinal direction when the long material is inserted between the restriction walls.

(10) In the aspect according to any one of (7) to (9), the device for manufacturing a press-formed product may further include a blank holder tool which is disposed between the pair of restriction walls, and includes a support surface which comes into contact with at least a concave side of the bending portion of the long material.

(11) In the aspect according to (7), one of the pair of restriction walls may be a fixing restriction wall which is fixed to the base portion, and the other of the pair of restriction walls may be a pressurization restriction wall which approaches the fixing restriction wall when the punch portion moves while coming into contact with the convex side of the bending portion of the long material.

(12) In the aspect according to (11), at least one of the fixing restriction wall and the pressurization restriction wall may include a workpiece receiving portion which comes into contact with one end of the long material, and an elastic body which biases the workpiece receiving portion toward the one end of the long material.

(13) In the aspect according to (11) or (12), the device for manufacturing a press-formed product may further include a blank holder tool which is disposed between the fixing restriction wall and the pressurization restriction wall, and includes a support surface which comes into contact with at least a concave side of the bending portion of the long material.

(14) According to a third aspect of the present invention, a mandrel which is used in the device for manufacturing a press-formed product according to any one of (7) to (13), includes: a plurality of division bodies which support the concave side of the long material; and a connection body which connects the division bodies, in which a line shape of the division bodies is changed according to the shape of the bending portion of the long material.

(15) In the aspect according to (14), each division body may include a concave portion which accommodates the connection body when the division bodies are arranged in a line, and an elastic body which is provided between a bottom surface of the concave portion and an end portion of the connection body inserted into the concave portion.

(16) In the aspect according to (14), the connection body may include a pair of division connection bodies which is movable close to and away from each other within a predetermined range, and an elastic body which is provided between the pair of division connection bodies and biases the pair of division connection bodies in a direction separated from each other.

(17) According to a fourth aspect of the present invention, a press-formed product which is long in one direction, includes: a high cross-sectional area portion which has the largest cross-sectional area when viewed in a cross section perpendicular to a longitudinal direction; a low cross-sectional area portion which has a cross-sectional area which is smaller than that of the high cross-sectional area portion; and an intermediate portion which is provided between the high cross-sectional area portion and the low cross-sectional area portion, and in which a cross-sectional area continuously changes along the longitudinal direction.

(18) In the aspect according to (17), a plurality of high cross-sectional area portions may be provided in a plurality of locations along the longitudinal direction.

Effects of the Invention

According to the method for manufacturing a press-formed product described in (1), since the curvature of the bending portion decreases while both ends of the long material having the bending portion in the longitudinal direction are restricted, it is possible to compress the long material in the longitudinal direction. That is, since the compressed portion becomes a surplus, it is possible to increase a cross-sectional area of the long material. Accordingly, it is possible to increase the rigidity of the long material.

Moreover, since the long material is compressed in the longitudinal direction, it is possible to increase yield strength of the long material due to work hardening of the long material.

In addition, since the cross-sectional area at the location corresponding to the bending portion increases, by arbitrarily selecting the position of the bending portion of the long material, it is possible to increase the cross-sectional area at a desired location.

In the case of (2), since the curvature of the bending portion of the long material decreases while the shortest distance between both ends of the long material is constantly maintained, it is possible to further compress the long material in the longitudinal direction. That is, since the surplus of the long material increases, it is possible to further increase the cross-sectional area of the long material.

In the case of (3), since the curvature of the bending portion of the long material decreases while the shortest distance between both ends of the long material decreases, it is possible to further compress the long material in the longitudinal direction. That is, since the surplus of the long material increases, it is possible to further increase the cross-sectional area of the long material.

Moreover, in the case of (4), since the curvature of the bending portion of the long material decreases while the concave side of the long material is supported, it is possible to prevent buckling distortion of the long material.

In the case of (5), since the curvature of the bending portion of the long material decreases in stages, it is possible to gradually increase the cross-sectional area of the long material. That is, since it is difficult to buckle the long material by the increase in the cross-sectional area, it is possible to prevent the buckling distortion of the long material when the curvature of the bending portion decreases to a predetermined curvature.

In the case of (6), since planes including edges of both ends of the long material are parallel with each other, it is possible to equally apply a load to both ends of the long material. Accordingly, it is possible to prevent the buckling distortion of the long material.

According to the device for manufacturing a press-formed product described in (7), since the device includes the second press tool which includes the punch portion which presses the convex side of the bending portion of the long material inserted between the pair of restriction walls, it is possible to decrease the curvature of the bending portion of the long material. In addition, since the distance between the pair of restriction walls is shorter than the entire length when the long material linearly extends, it is possible to restrict the long material in the longitudinal direction when the long material is pressed by the punch portion. Accordingly, it is possible to compress the long material in the longitudinal direction. That is, since the compressed portion becomes a surplus, it is possible to increase the cross-sectional area of the long material.

In the case of (8), since the distance between the pair of restriction walls is the same as the shortest distance between both ends of the long material in the longitudinal direction, it is possible to further compress the long material in the longitudinal direction. That is, since the surplus of the long material increases, it is possible to further increase the cross-sectional area of the long material.

In the case of (9), since each of the pair of restriction walls includes the guide surface which comes into contact with the end portion of the long material in the longitudinal direction when the long material is inserted between the restriction walls, the long material is introduced into the portion between the pair of restriction walls. Accordingly, since it is possible to reliably restrict the long material, it is possible to prevent buckling distortion.

In the case of (10), since the device for manufacturing a press-formed product includes the blank holder tool which is disposed between the pair of restriction walls, and includes the support surface which comes into contact with at least the concave side of the bending portion of the long material, it is possible to prevent the buckling distortion when the long material is compressed in the longitudinal direction.

In the case of (11), since one of the pair of restriction walls is the fixing restriction wall, and the other is the pressurization restriction wall which approaches the fixing restriction wall when the punch portion moves while coming into contact with the convex side of the bending portion of the long material, it is possible to further compress the long material in the longitudinal direction. Accordingly, it is possible to further increase the cross-sectional area of the long material.

In the case of (12), since at least one of the fixing restriction wall and the pressurization restriction wall includes the workpiece receiving portion which comes into contact with one end of the long material, and the elastic body which biases the workpiece receiving portion toward the one end of the long material, it is possible to follow the distortion of both ends of the long material when the long material is compressed in the longitudinal direction. That is, when the punch portion presses the convex side of the bending portion of the long material, it is possible to restrict the entire portion of both ends of the long material. Therefore, since it is possible to equally apply a compressive force to the long material, it is possible to prevent the buckling distortion when the long material is compressed.

In the case of (13), since the device for manufacturing a press-formed product further includes the blank holder tool which is disposed between the fixing restriction wall and the pressurization restriction wall, and includes the support surface which comes into contact with at least the concave side of the bending portion of the long material, it is possible to prevent the buckling distortion when the long material is compressed in the longitudinal direction.

According to the mandrel described in (14), since the line shape of the division bodies is changed according to the shape of the bending portion of the long material, the plurality of division bodies which support the concave side of the long material can follow the distortion of the long material. Accordingly, when the long material is compressed in the longitudinal direction, it is possible to always support the long material, and it is possible to prevent the buckling distortion when the long material is compressed in the longitudinal direction.

In the case of (15), since each division body includes the concave portion which accommodates the connection body when the division bodies are arranged in a line, and the elastic body which is provided between the bottom surface of the concave portion and the end portion of the connection body inserted into the concave portion, it is possible to increase and decrease the entire length of the mandrel. Accordingly, it is possible to allow the division bodies to come into contact with the approximately entirety of the long material. Therefore, it is possible to prevent the buckling distortion when the long material is compressed in the longitudinal direction.

In the case of (16), since each connection body includes the pair of division connection bodies which is movable close to and away from each other, and the elastic body which is provided between the pair of division connection bodies and biases the pair of division connection bodies in a direction separated from each other, it is possible to increase and decrease the entire length of the mandrel. Accordingly, it is possible to allow the division bodies to come into contact with the approximately entirety of the long material. Therefore, it is possible to prevent the buckling distortion when the long material is compressed in the longitudinal direction.

According to the press-formed product described in (17), since the press-formed product includes the high cross-sectional area portion, it is possible to increase rigidity of the press-formed product. Moreover, since the press-formed product includes the low cross-sectional area portion, it is possible to decrease weight of the press-formed product.

In addition, since the press-formed product includes the intermediate portion in which the cross-sectional area continuously changes along the longitudinal direction, it is possible to prevent stress from being concentrated in a boundary between the high cross-sectional area portion and the low cross-sectional area portion.

In the case of (18), since the plurality of high cross-sectional area portions are provided, it is possible to further increase the rigidity of the press-formed product.

BRIEF DESCRIPTION OF THE DRAWINGS

FIG. 57 is an enlarged front view showing still another modification example of the mandrel according to the sixth embodiment of the present invention.

FIG. 58 is a front view showing a connection body of the mandrel shown in FIG. 57.

FIG. 59 is a plan view showing a connection body of the mandrel shown in FIG. 57 which is different from the connection body shown in FIG. 58.

FIG. 60A is a perspective view showing an intermediate press-formed product which is used in a device for manufacturing a press-formed product according to a seventh embodiment of the present invention.

FIG. 60B is a front view showing the intermediate press-formed product.

FIG. 60C is a plan view showing the intermediate press-formed product.

FIG. 61 is a front view showing the device for manufacturing a press-formed product according to the seventh embodiment of the present invention.

FIG. 62 is a side view showing the device for manufacturing a press-formed product according to the seventh embodiment of the present invention.

FIG. 63 is a side view showing the device for manufacturing a press-formed product according to the seventh embodiment of the present invention, and is a view showing a state where an upper press tool is lowered to a bottom dead center.

FIG. 64A is a perspective view showing a modification example of the intermediate press-formed product which is used in the device for manufacturing a press-formed product according to the sixth embodiment of the present invention.

FIG. 64B is a front view showing the intermediate press-formed product.

FIG. 64C is a plan view showing the intermediate press-formed product.

Figure 65:
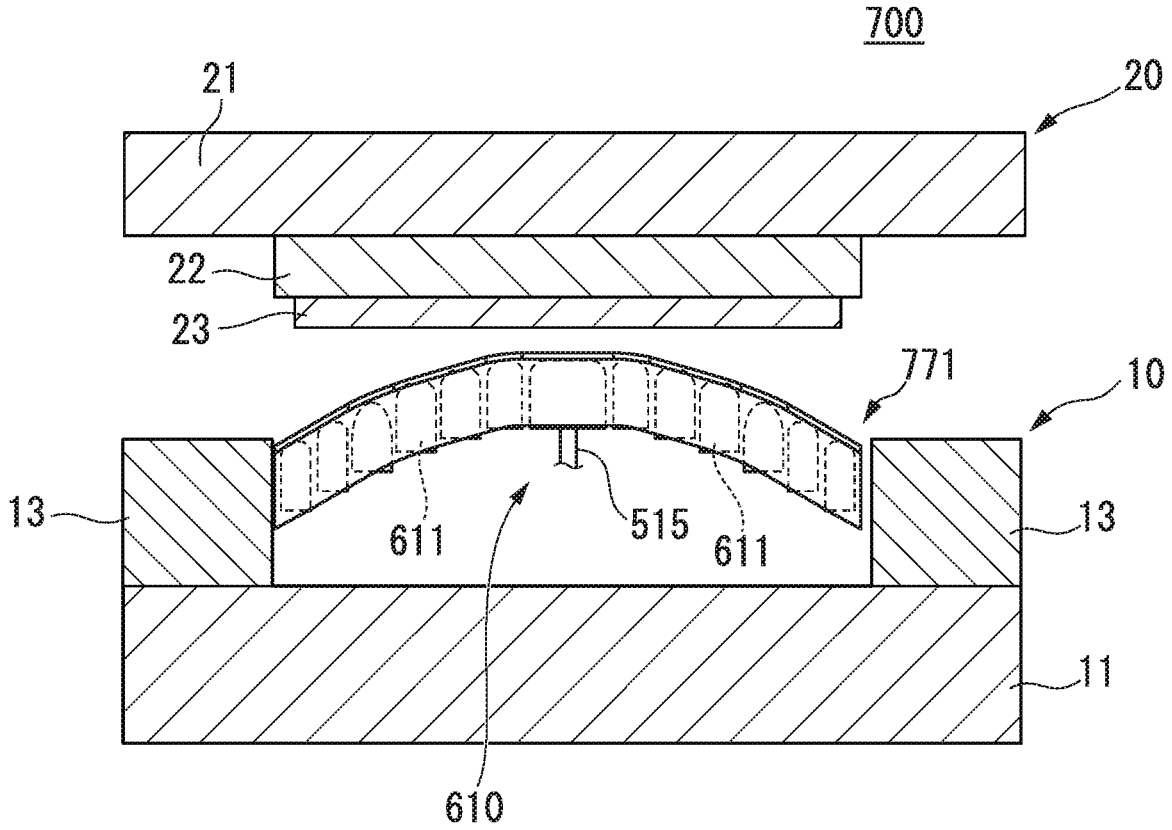

FIG. 65 is a front view showing the device for manufacturing a press-formed product according to the seventh embodiment of the present invention.

Figure 66A:
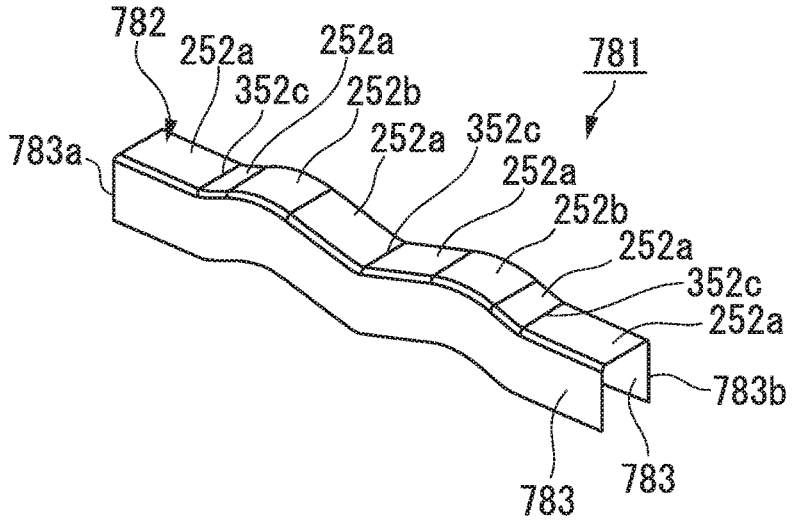

FIG. 66A is a perspective view showing another modification example of the intermediate press-formed product which is used in the device for manufacturing a press-formed product according to the seventh embodiment of the present invention.

Figure 66B:
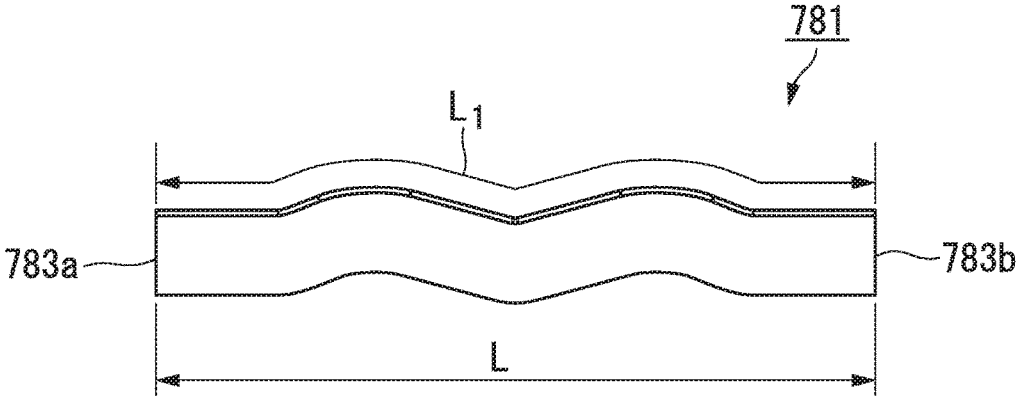

FIG. 66B is a front view showing the intermediate press-formed product.

Figure 66C:
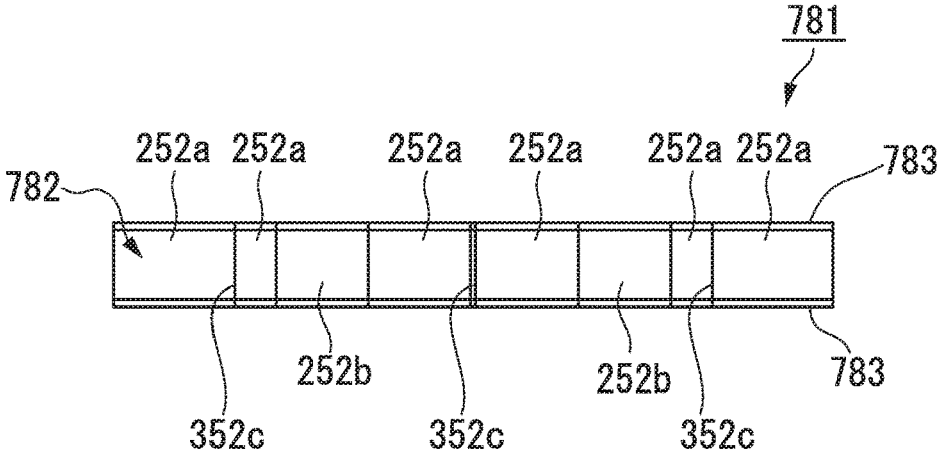

FIG. 66C is a plan view showing the intermediate press-formed product.

Figure 67:
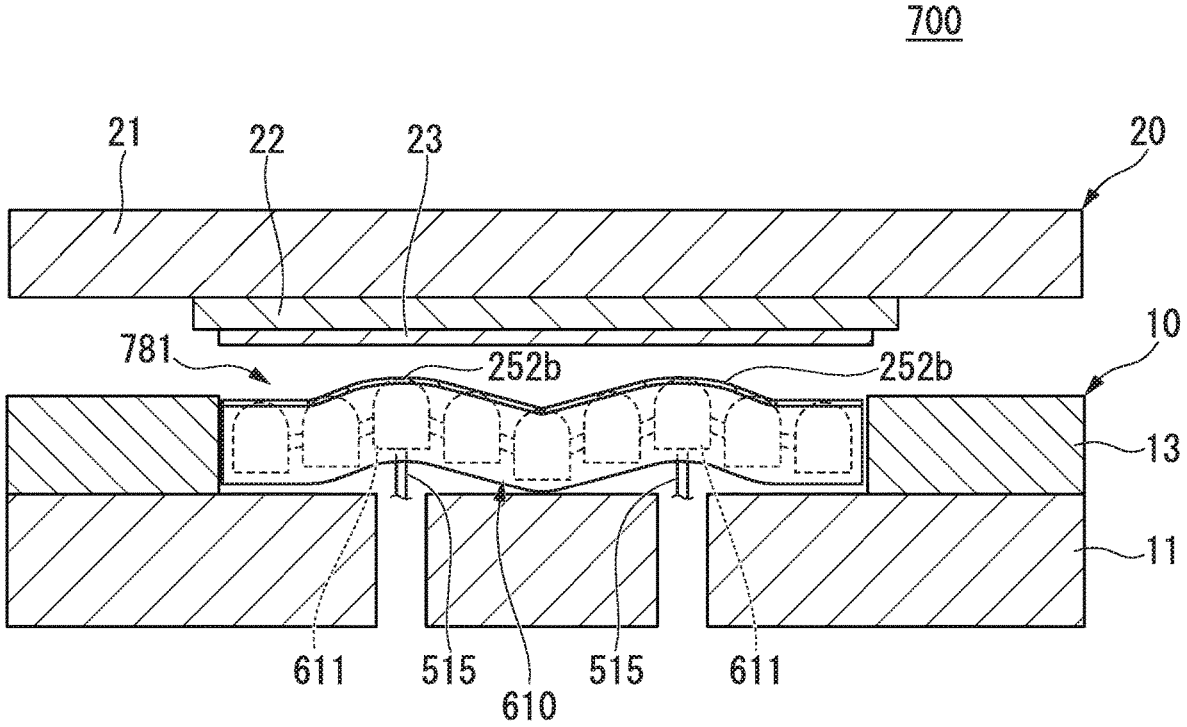

FIG. 67 is a front view showing the device for manufacturing a press-formed product according to the seventh embodiment of the present invention.

Figure 68A:
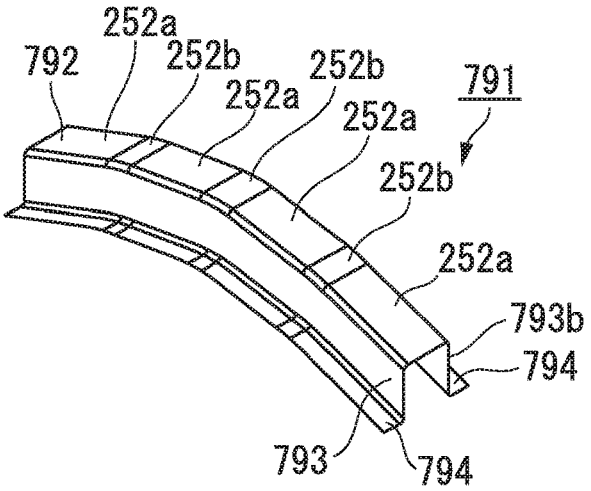

FIG. 68A is a perspective view showing still another modification example of the intermediate press-formed product which is used in the device for manufacturing a press-formed product according to the seventh embodiment of the present invention.

Figure 68B:
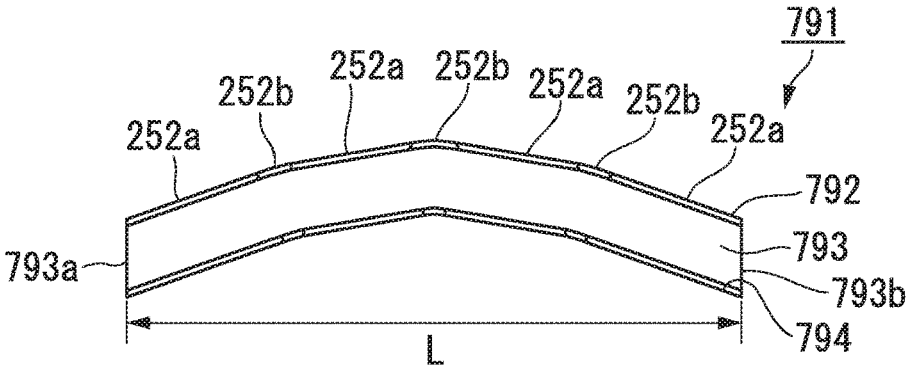

FIG. 68B is a front view showing the intermediate press-formed product.

Figure 68C:
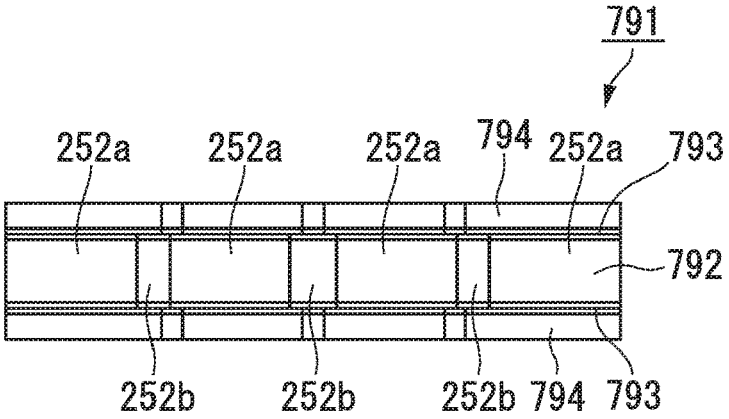

FIG. 68C is a plan view showing the intermediate press-formed product.

Figure 69:
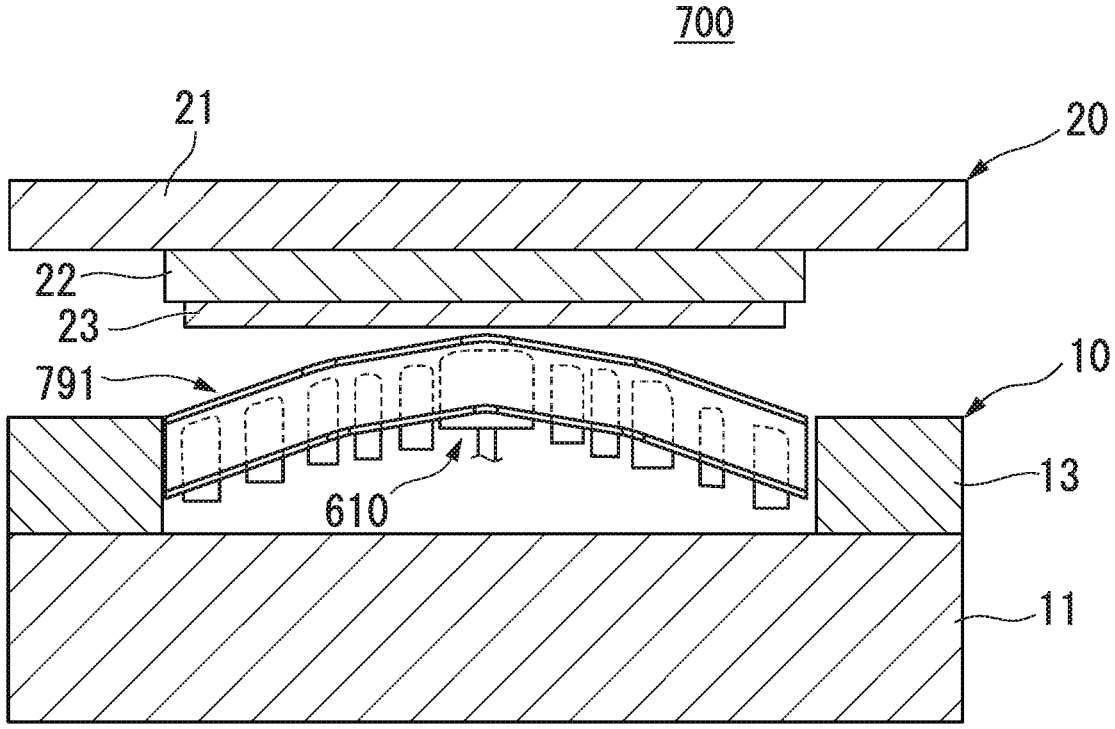

FIG. 69 is a front view showing the device for manufacturing a press-formed product according to the seventh embodiment of the present invention.

Figure 70:
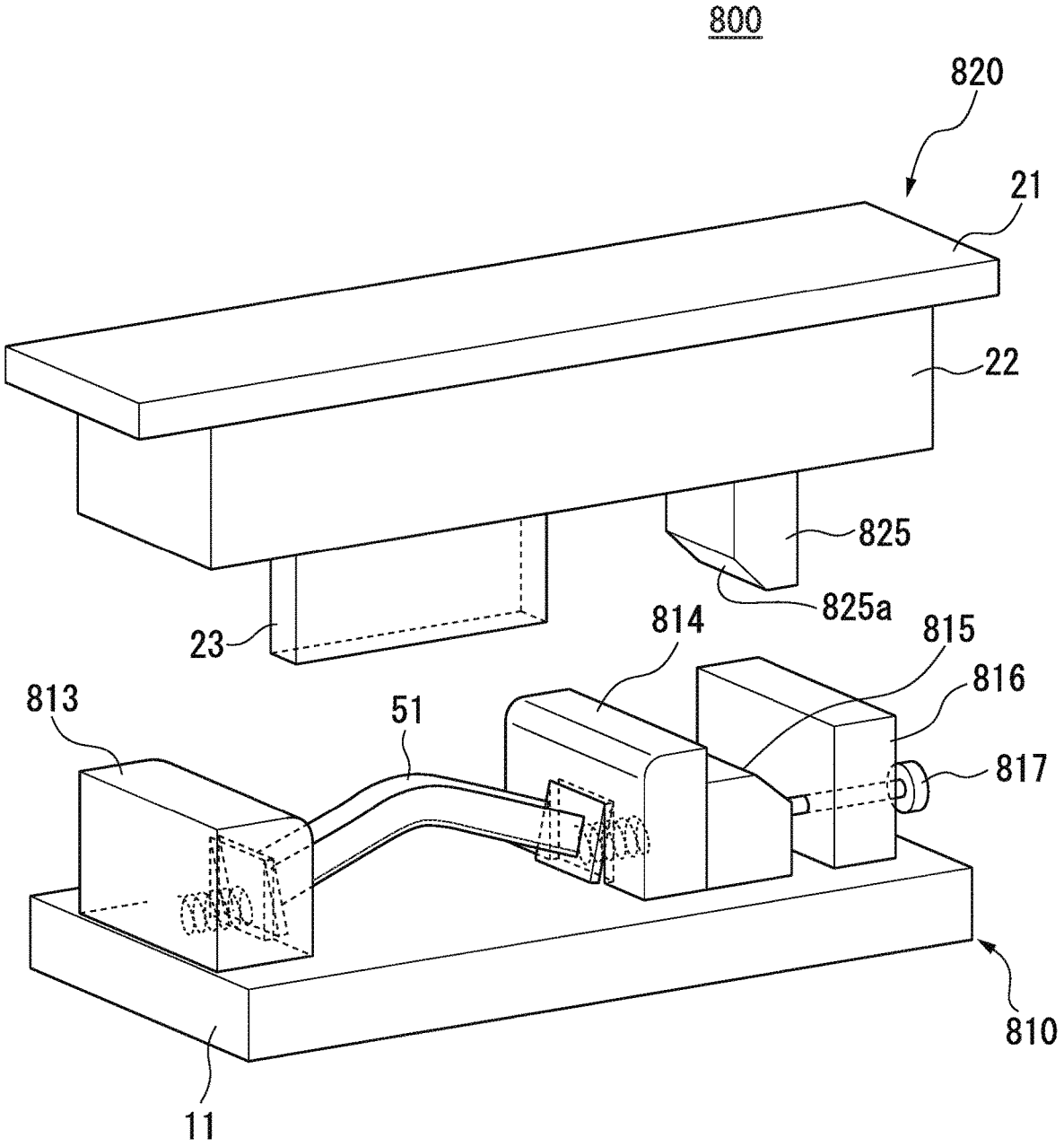

FIG. 70 is a perspective view showing a device for manufacturing a press-formed product according to an eighth embodiment of the present invention.

Figure 71A:
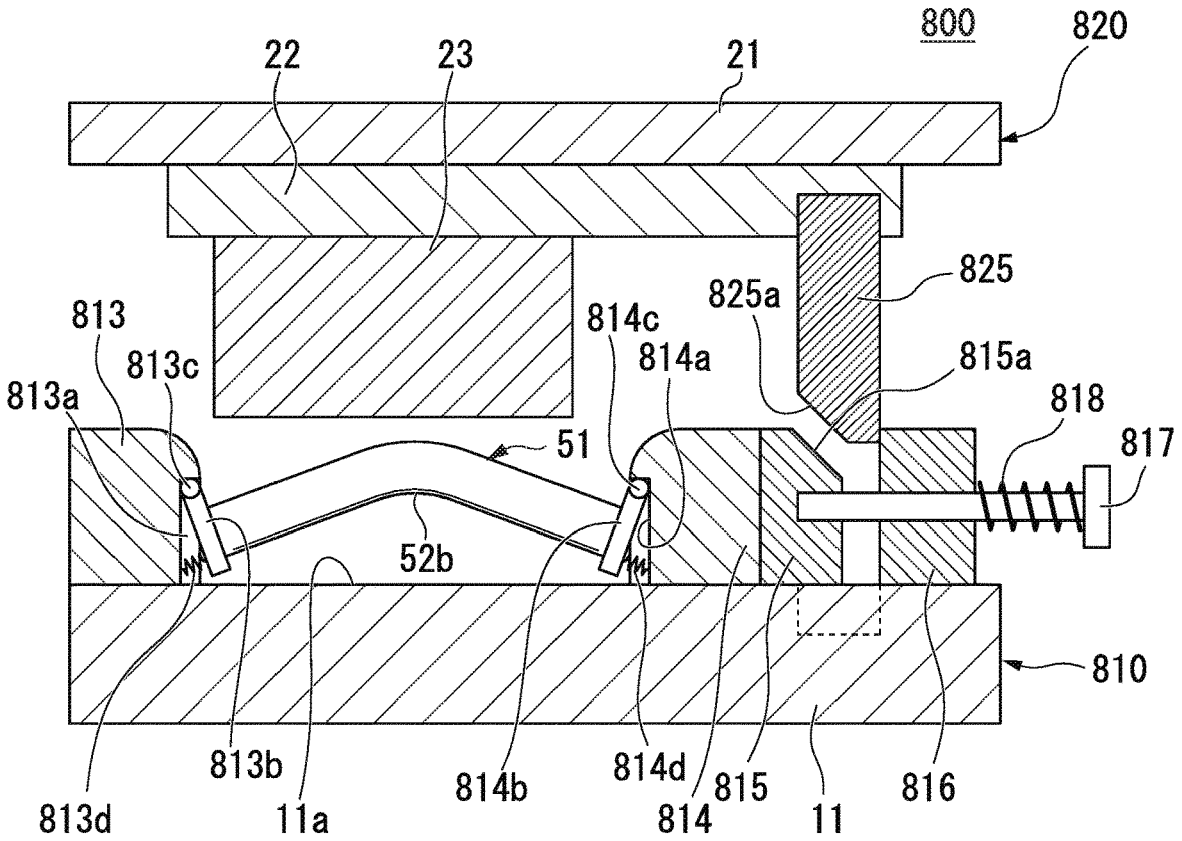

FIG. 71A is a front view showing the device for manufacturing a press-formed product according to the eighth embodiment of the present invention.

Figure 71B:
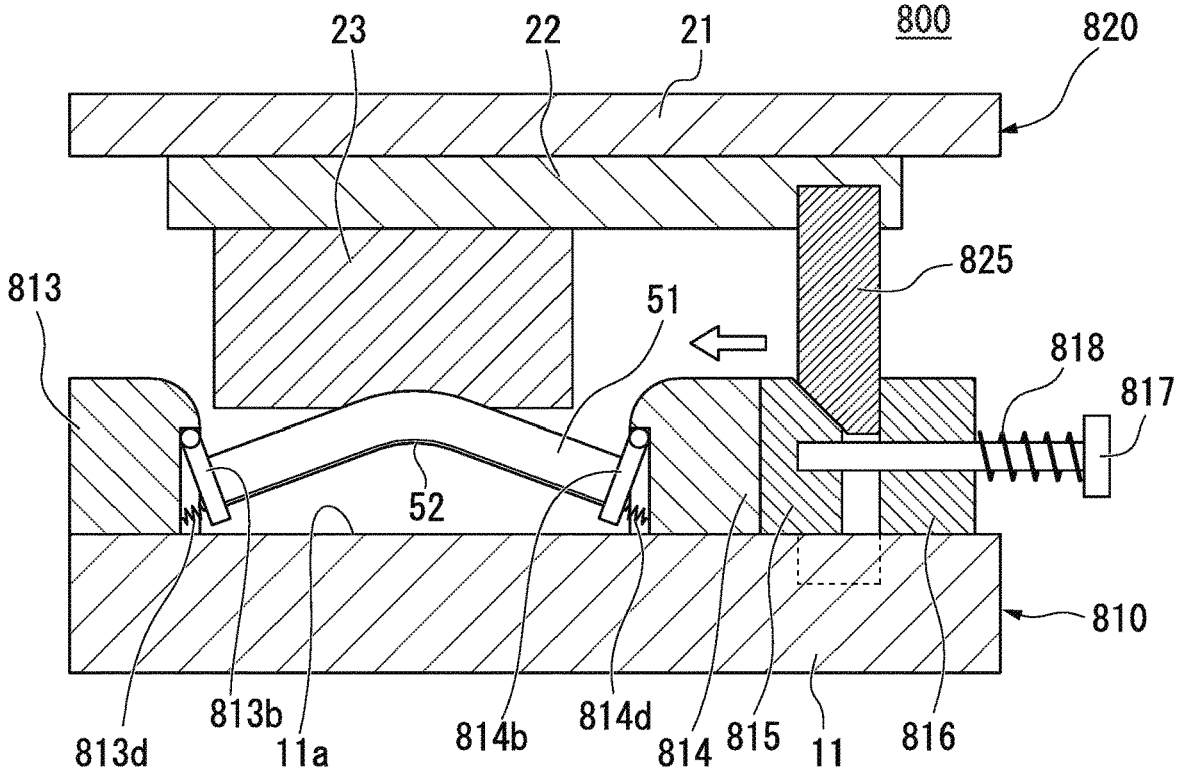

FIG. 71B is a front view showing the device for manufacturing a press-formed product according to the eighth embodiment of the present invention, and is a view showing a state where an upper press tool is lowered to a bottom dead center.

Figure 71C:
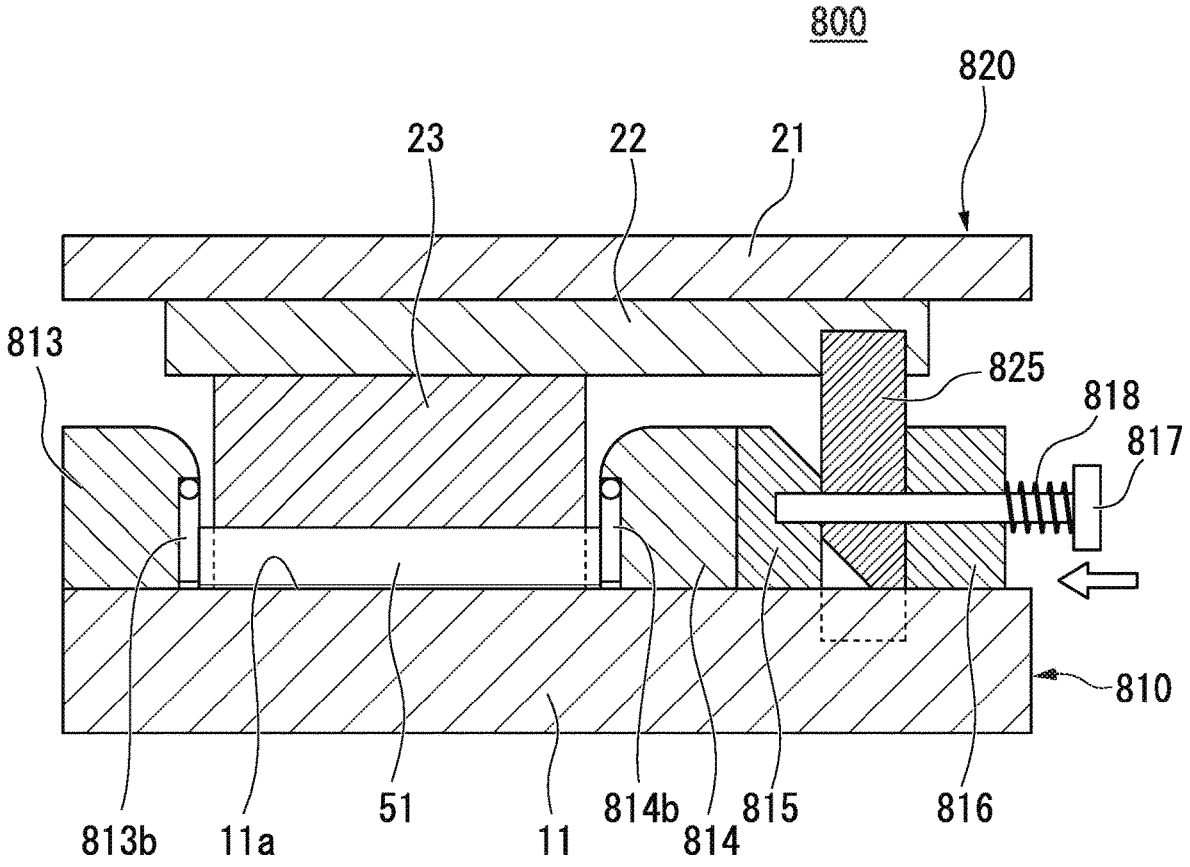

FIG. 71C is a front view showing the device for manufacturing a press-formed product according to the eighth embodiment of the present invention, and is a view showing a state where the upper press tool is lowered to the bottom dead center.

Figure 72A:
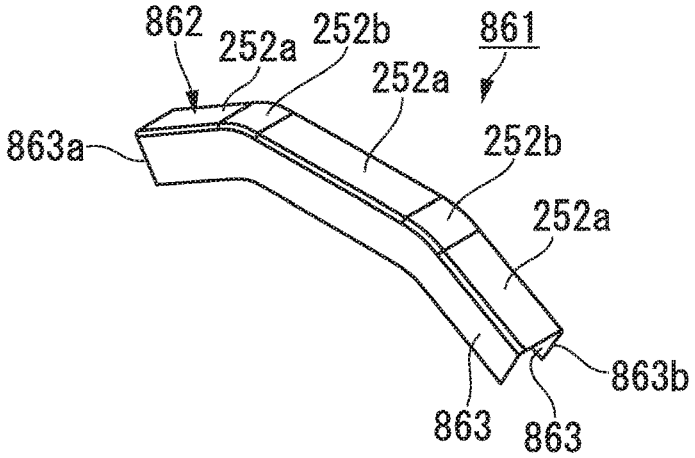

FIG. 72A is a perspective view showing a modification example of the intermediate press-formed product which is used in the device for manufacturing a press-formed product according to the eighth embodiment of the present invention.

Figure 72B:
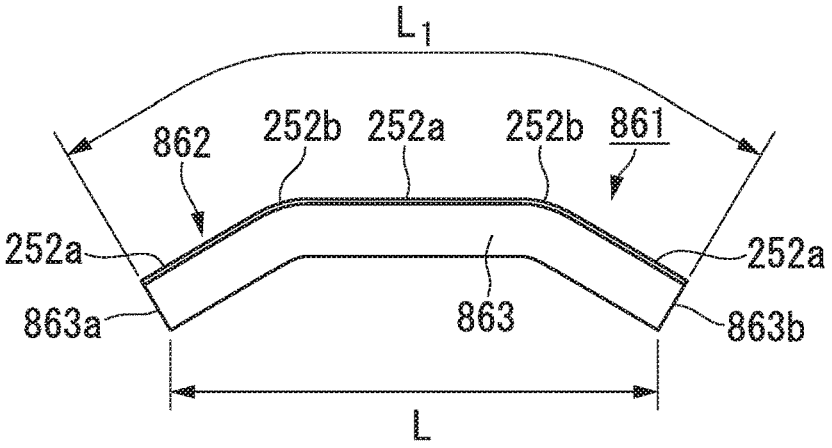

FIG. 72B is a front view showing intermediate press-formed product.

Figure 72C:
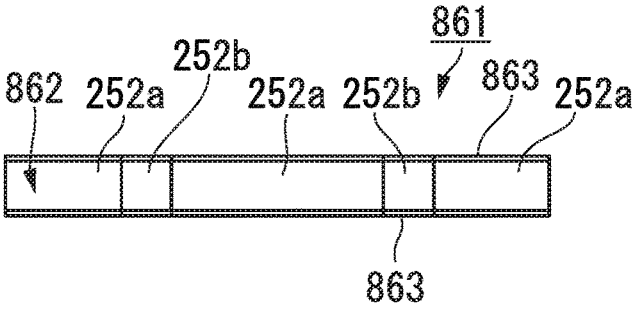

FIG. 72C is a plan view showing intermediate press-formed product.

Figure 73A:
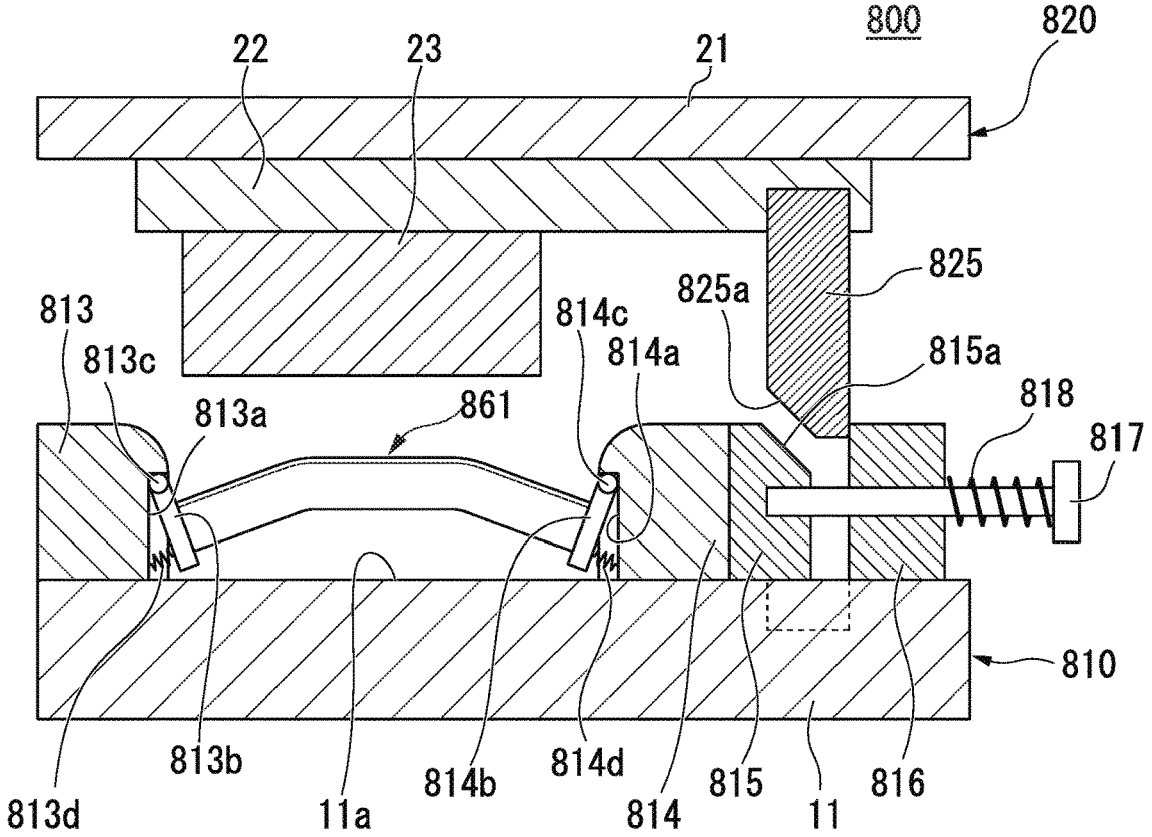

FIG. 73A is a front view showing the device for manufacturing a press-formed product according to the eighth embodiment of the present invention.

Figure 73B:
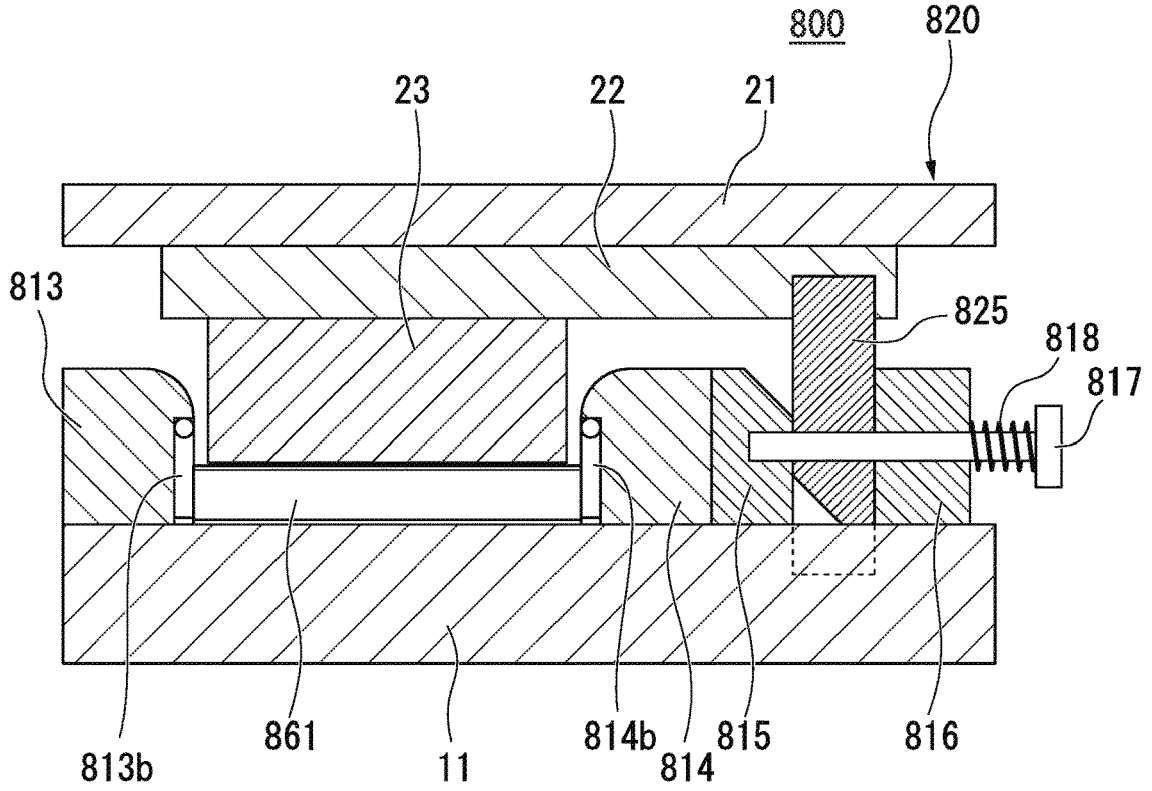

FIG. 73B is a front view showing the device for manufacturing a press-formed product according to the eighth embodiment of the present invention, and is a view showing a state where the upper press tool is lowered to the bottom dead center.

Figure 74A:
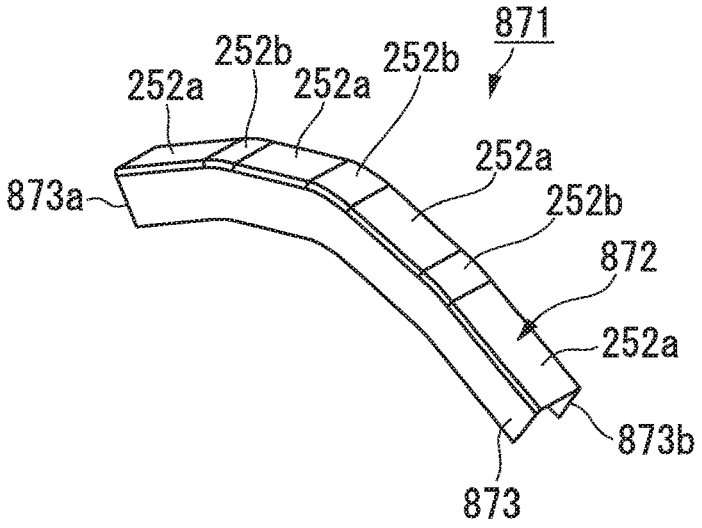

FIG. 74A is a perspective view showing another modification example of the intermediate press-formed product which is used in the device for manufacturing a press-formed product according to the eighth embodiment of the present invention.

Figure 74B:
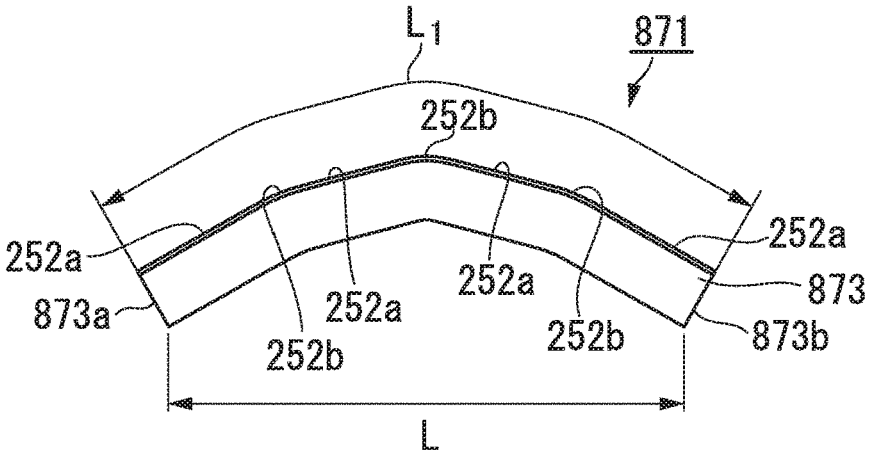

FIG. 74B is a front view showing the intermediate press-formed product.

Figure 74C:
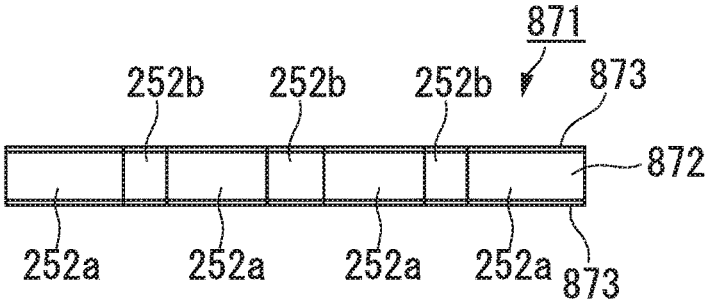

FIG. 74C is a plan view showing the intermediate press-formed product.

Figure 75A:
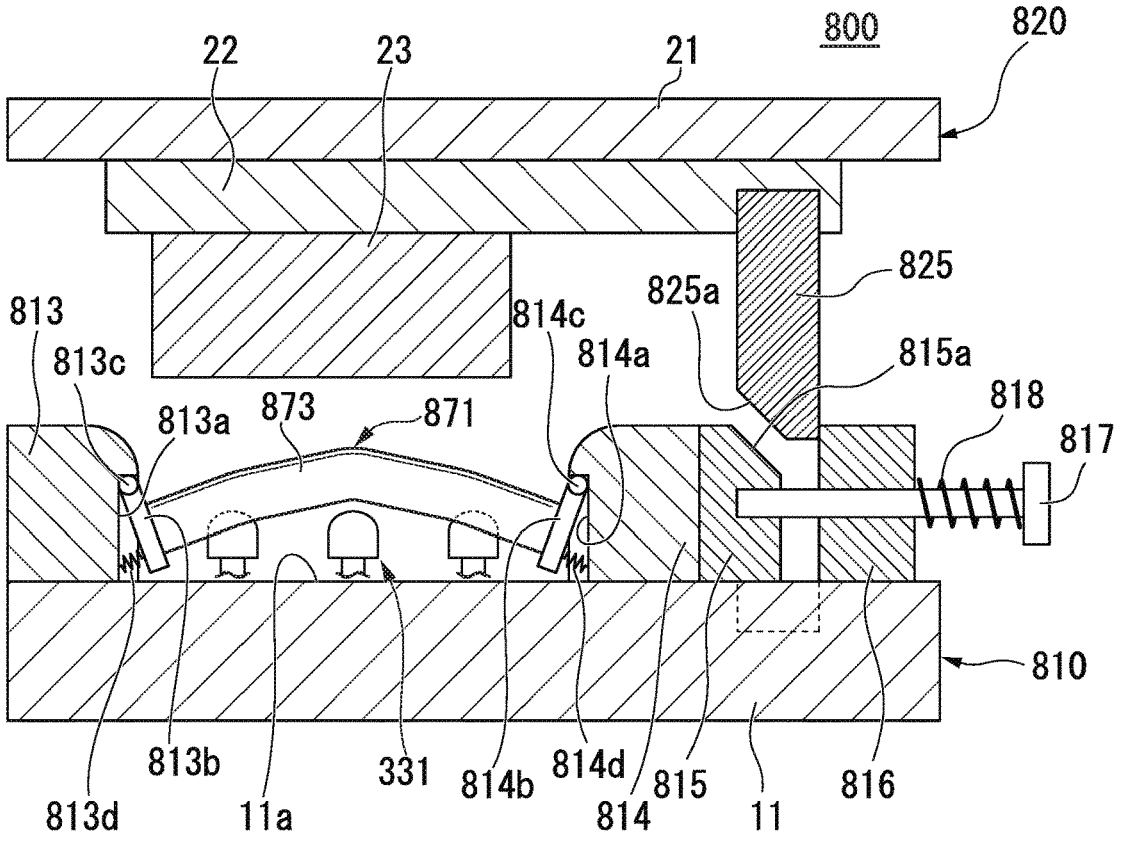

FIG. 75A is a front view showing a modification example of the device for manufacturing a press-formed product according to the eighth embodiment of the present invention.

Figure 75B:
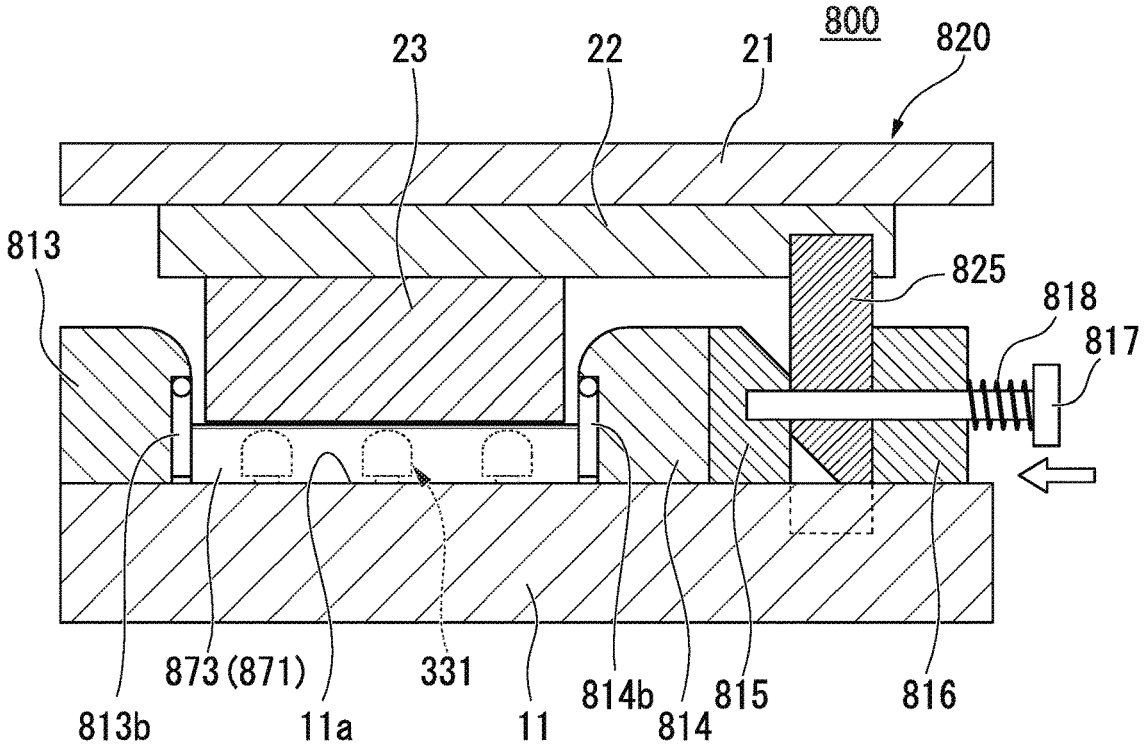

FIG. 75B is a view showing a state where the upper press tool is lowered to the bottom dead center from the state shown in FIG. 75A.

Figure 76:
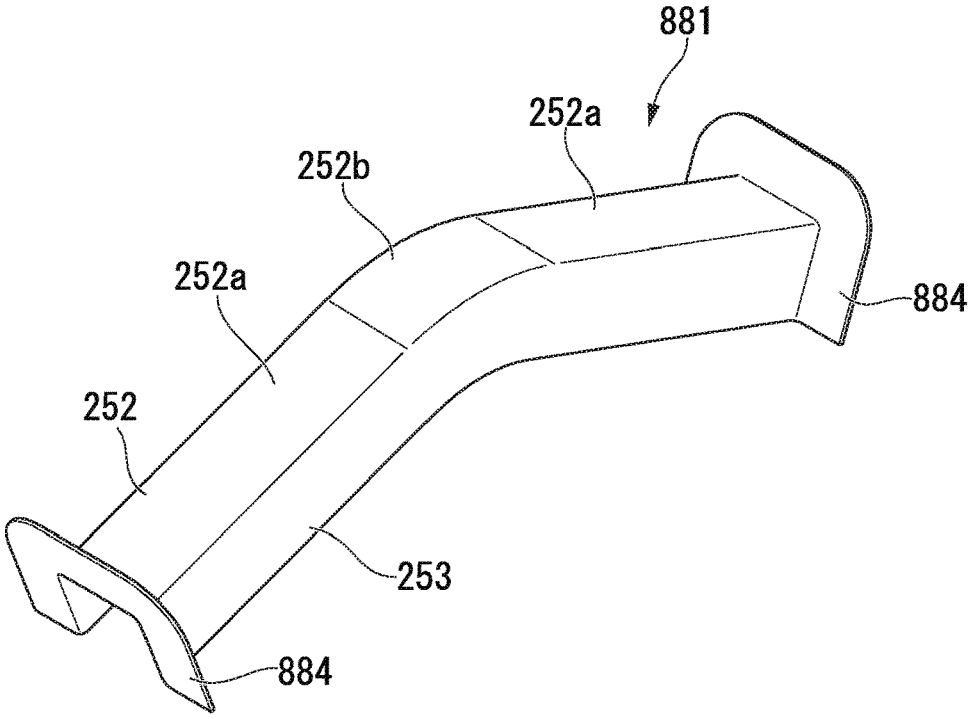

FIG. 76 is a perspective view showing still another modification example of the intermediate press-formed product which is used in the device for manufacturing a press-formed product according to the eighth embodiment of the present invention.

Figure 77:
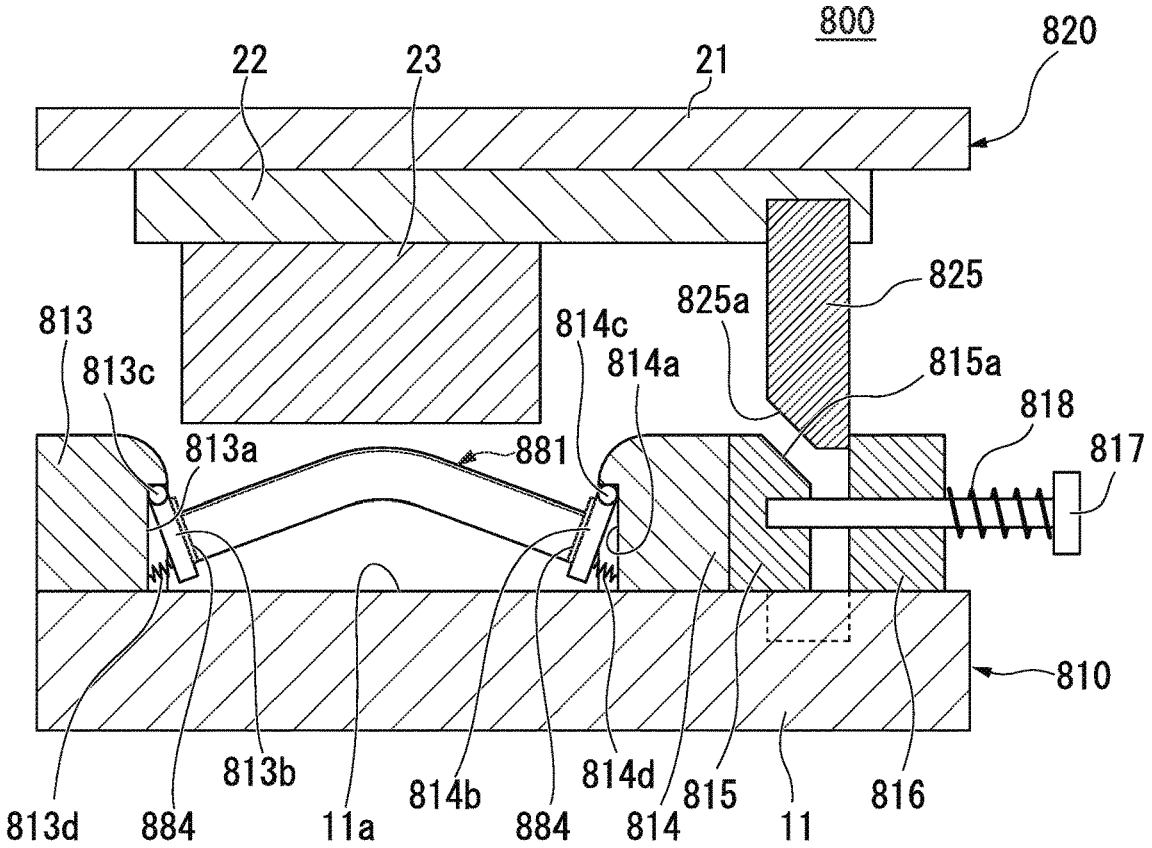

FIG. 77 is a front view showing the device for manufacturing a press-formed product according to the eighth embodiment of the present invention.

Figure 78:
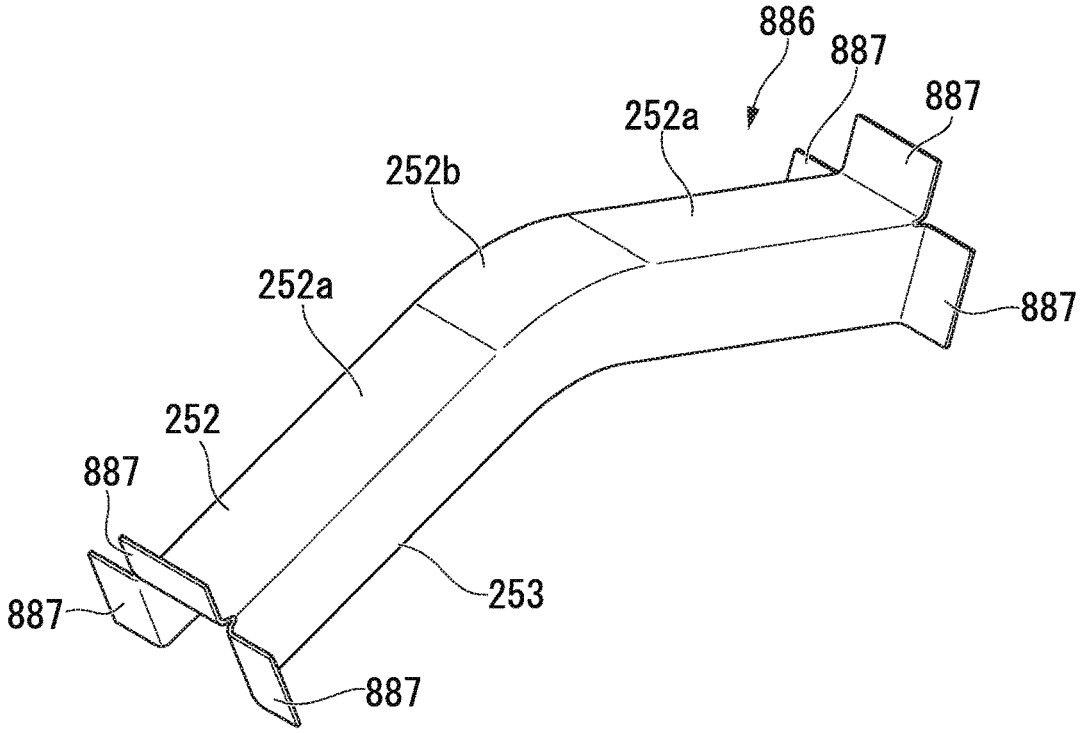

FIG. 78 is a perspective view showing still another modification example of the intermediate press-formed product which is used in the device for manufacturing a press-formed product according to the eighth embodiment of the present invention.

Figure 79:
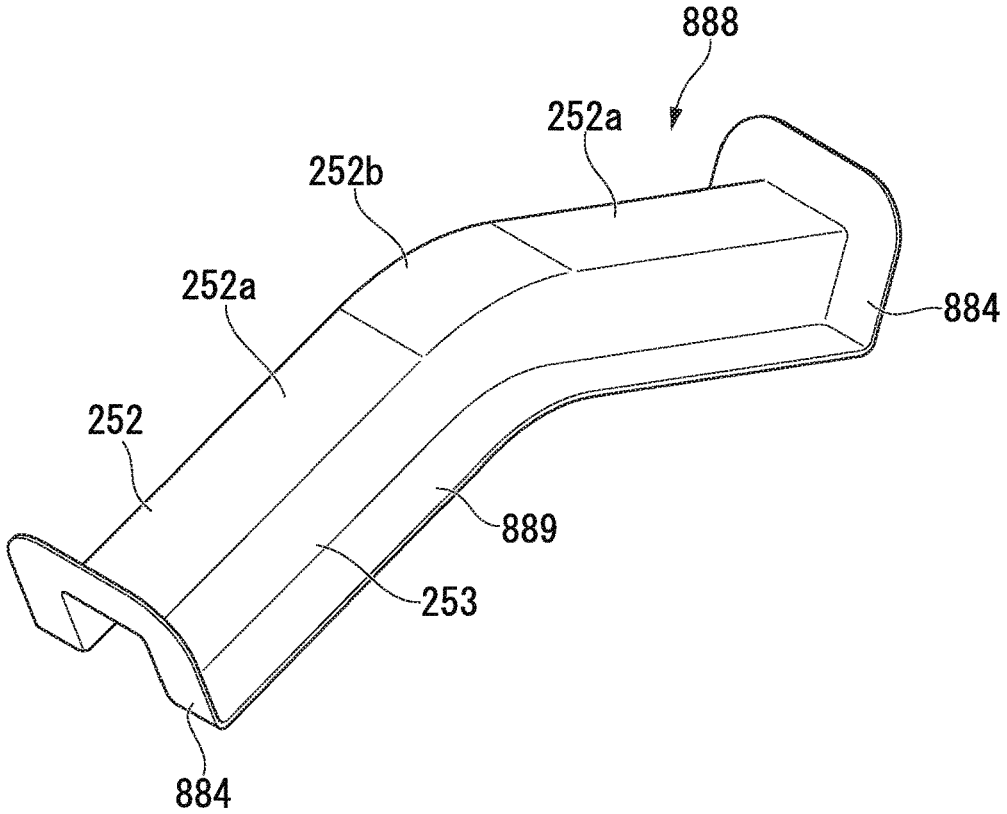

FIG. 79 is a perspective view showing still another modification example of the intermediate press-formed product which is used in the device for manufacturing a press-formed product according to the eighth embodiment of the present invention.

Figure 80A:
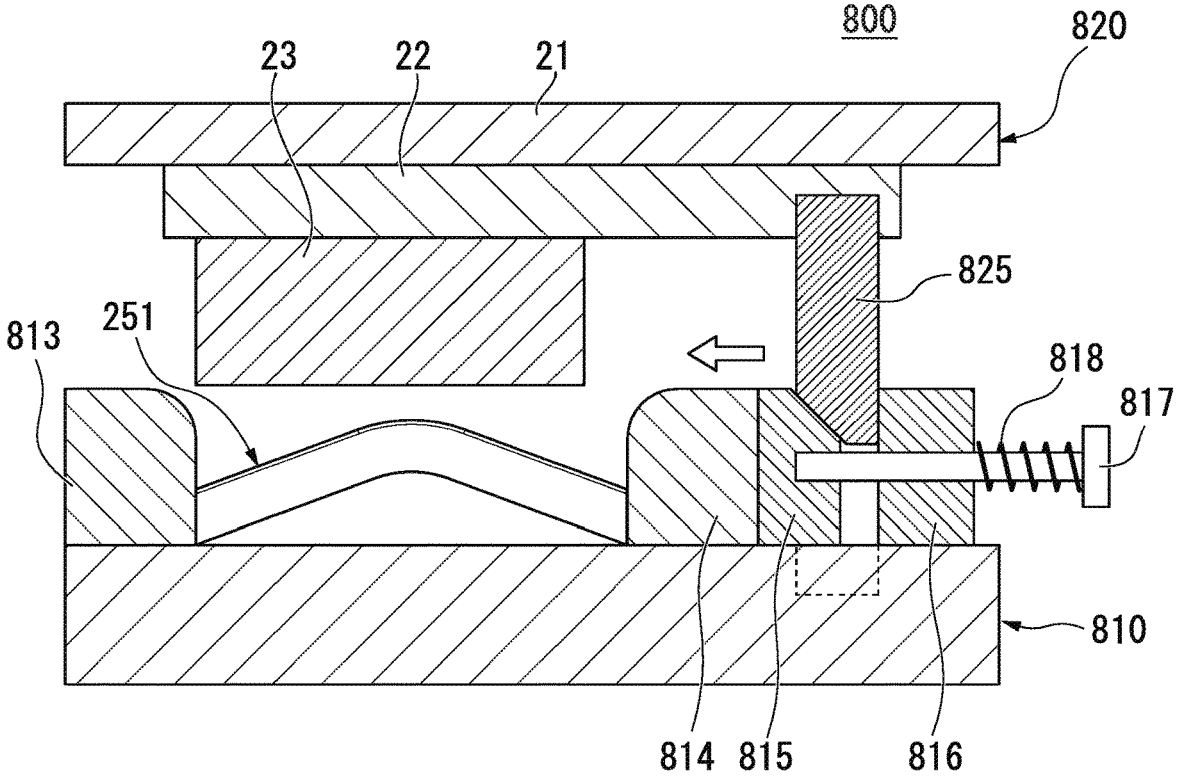

FIG. 80A is a front view showing a modification example of the device for manufacturing a press-formed product according to the eighth embodiment of the present invention.

Figure 80B:
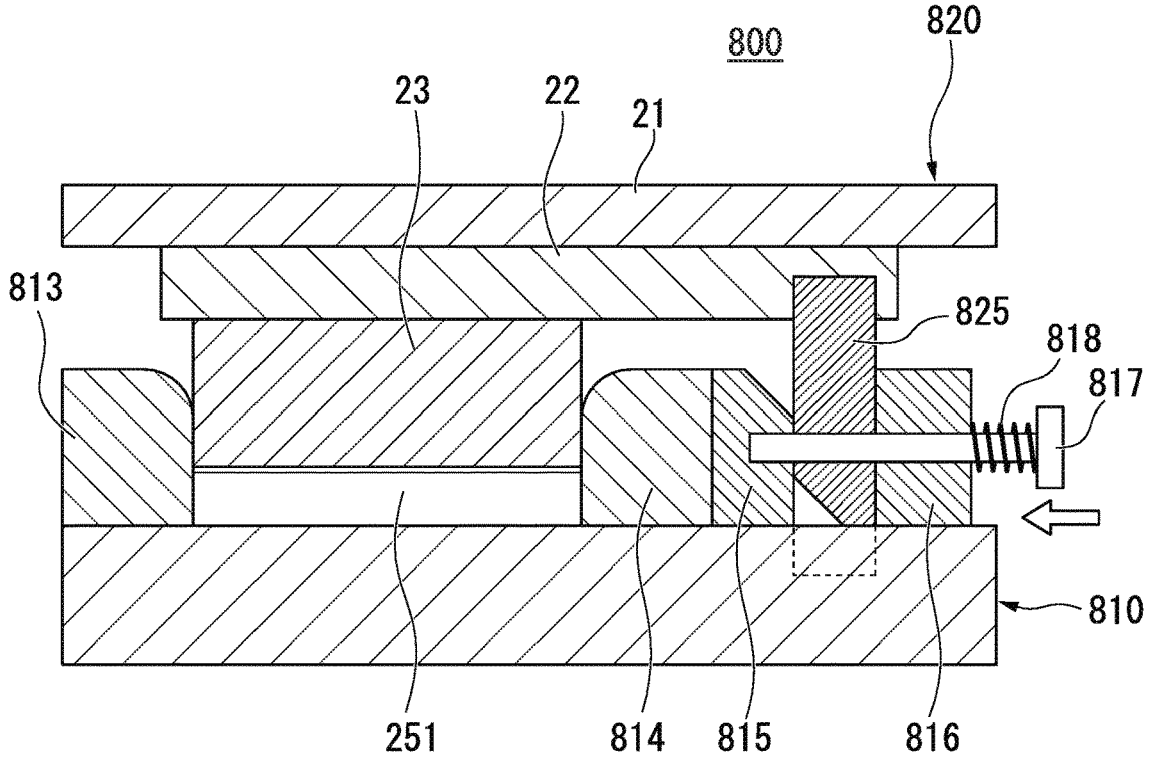

FIG. 80B is a front view showing the modification example of the device for manufacturing a press-formed product according to the eighth embodiment of the present invention, and a view showing a state where an upper press tool is lowered to a bottom dead center.

Figure 81:
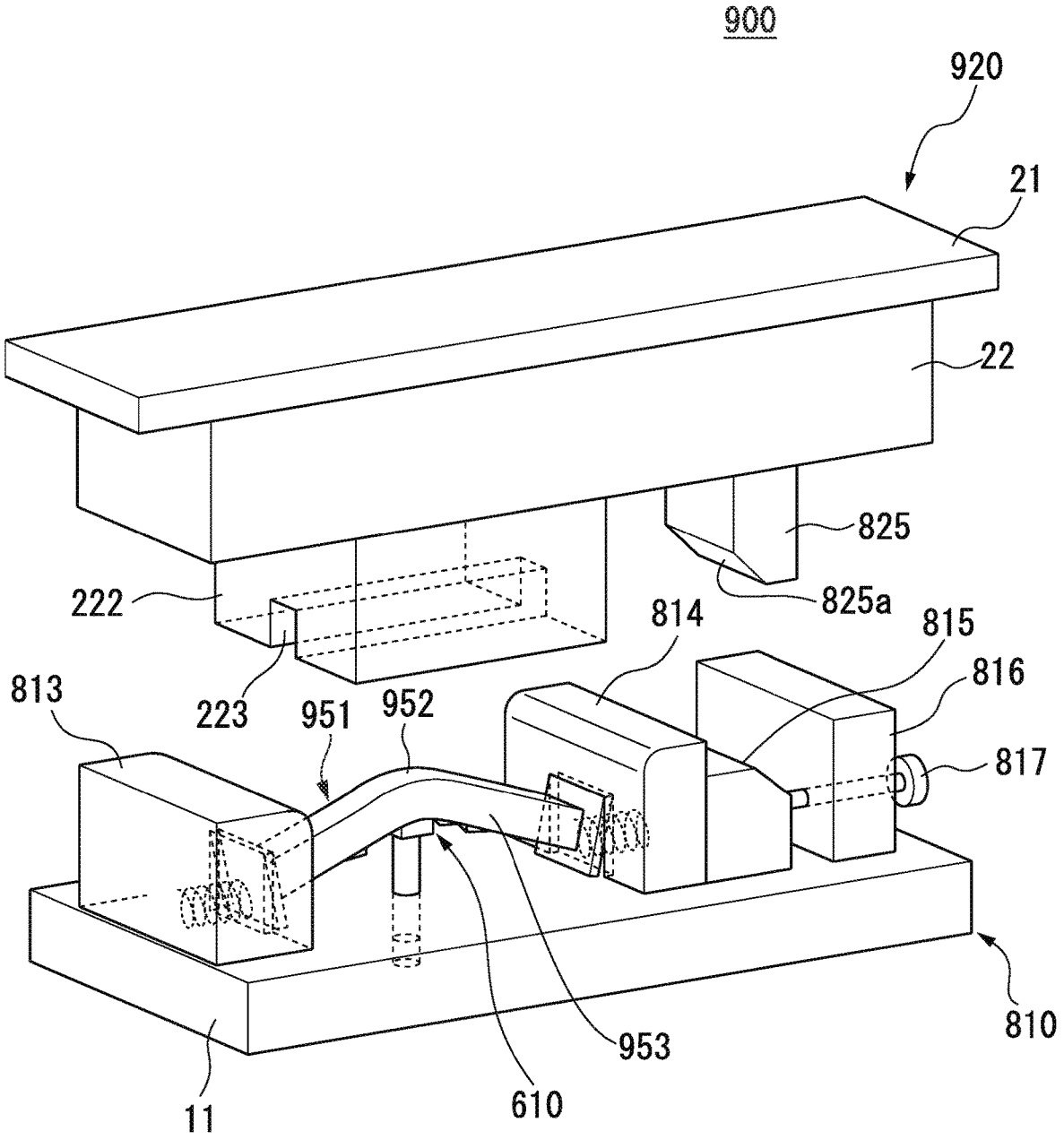

FIG. 81 is a perspective view showing a device for manufacturing a press-formed product according to a ninth embodiment of the present invention.

Figure 82A:
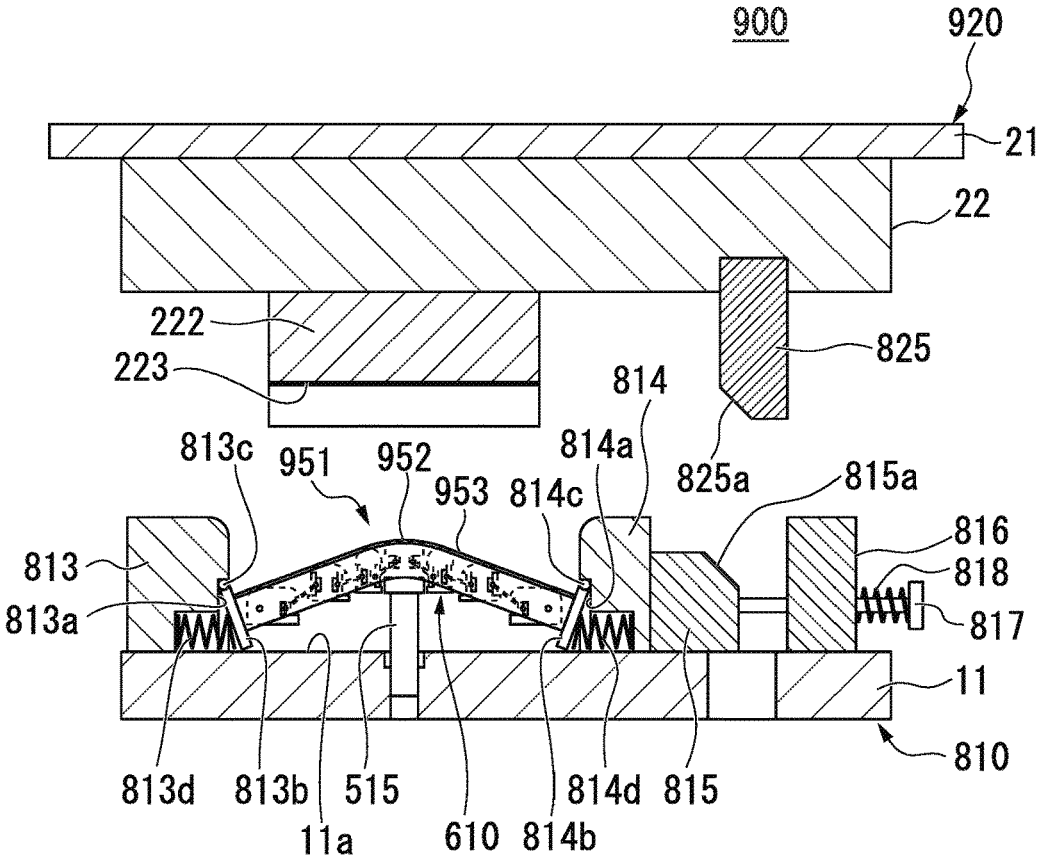

FIG. 82A is a longitudinal sectional view showing the device for manufacturing a press-formed product according to the ninth embodiment of the present invention.

Figure 82B:
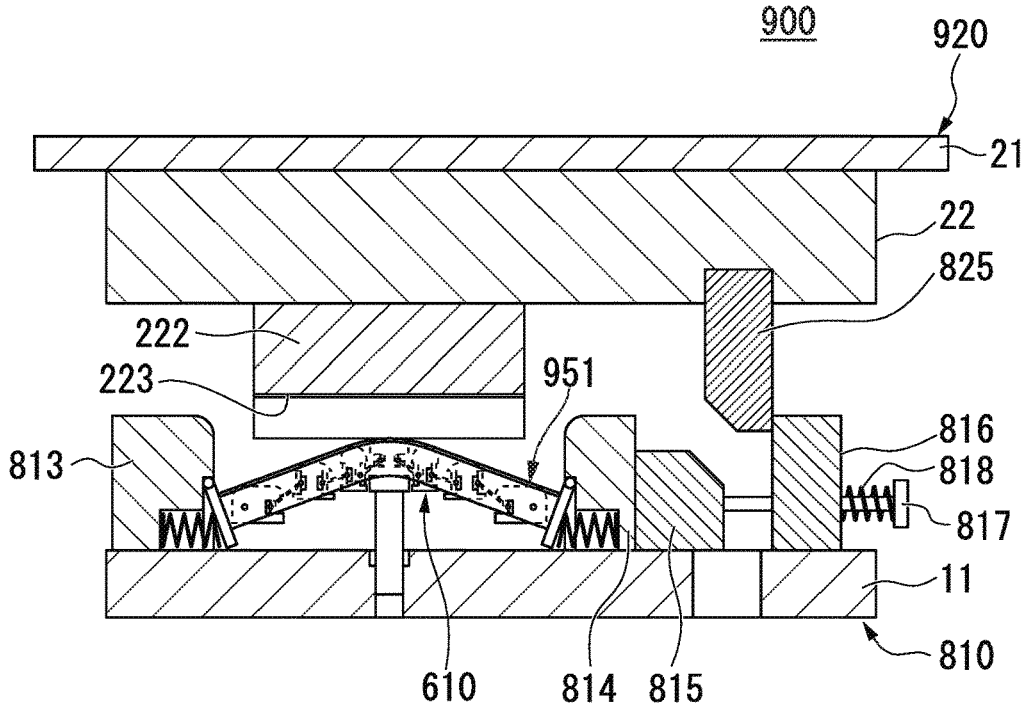

FIG. 82B is a longitudinal sectional view showing the device for manufacturing a press-formed product according to the ninth embodiment of the present invention, and is a view showing a state where an upper press tool is lowered.

Figure 82C:
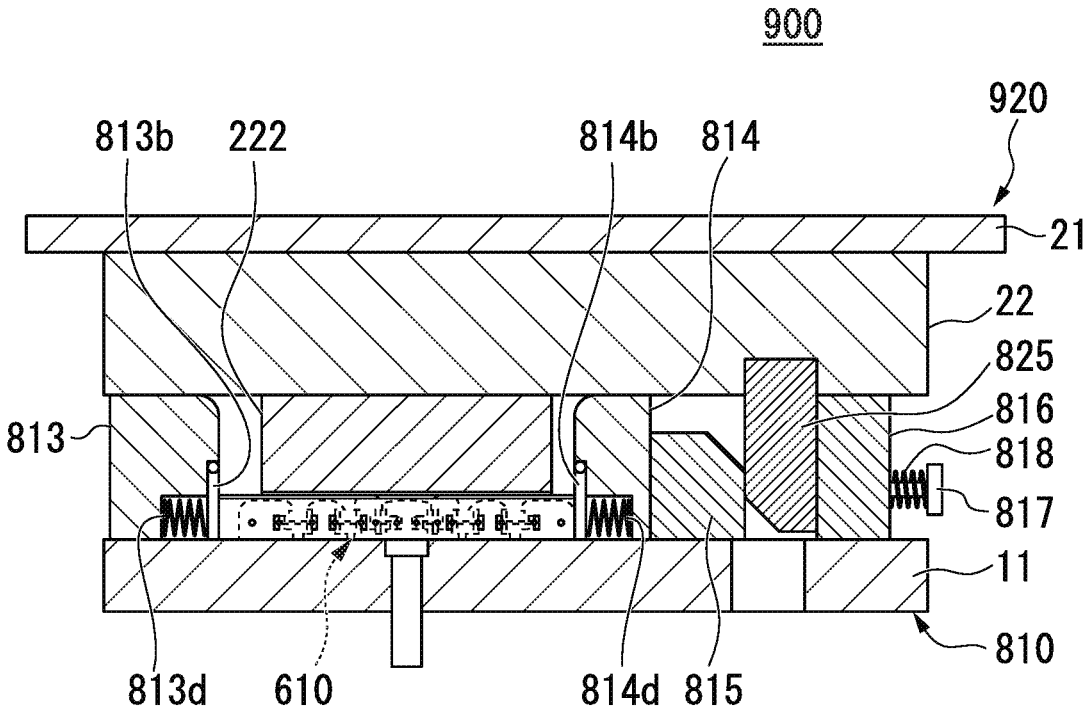

FIG. 82C is a longitudinal sectional view showing the device for manufacturing a press-formed product according to the ninth embodiment of the present invention, and is a view showing a state where the upper press tool is lowered to a bottom dead center.

Figure 83A:
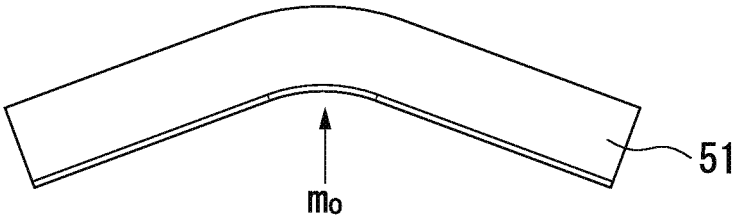

FIG. 83A is a view for explaining a method in which multiple times of compression are applied to an intermediate press-formed product.

Figure 83B:
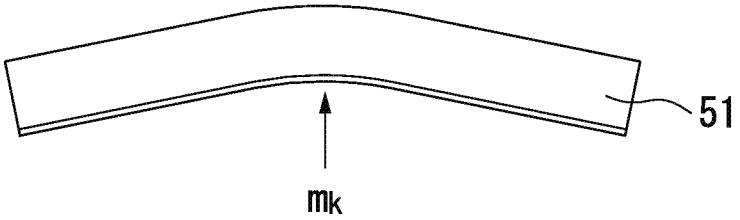

FIG. 83B is a view for explaining a method in which multiple times of compression are applied to the intermediate press-formed product.

Figure 83C:
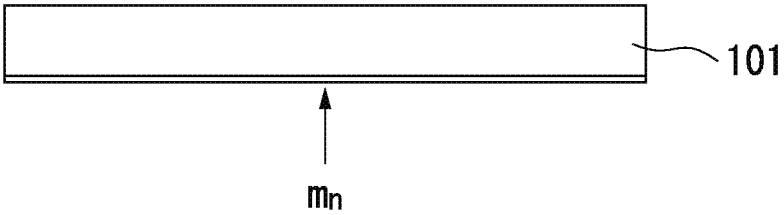

FIG. 83C is a view for explaining a method in which multiple times of compression are applied to the intermediate press-formed product.

EMBODIMENTS OF THE INVENTION

Hereinafter, embodiments of the present invention will be described in detail with reference to the drawings. In addition, in the present specification and the drawings, the same reference numerals are assigned to the components having substantially the same function as each other, and descriptions thereof are omitted.

First Embodiment

Figure 2:
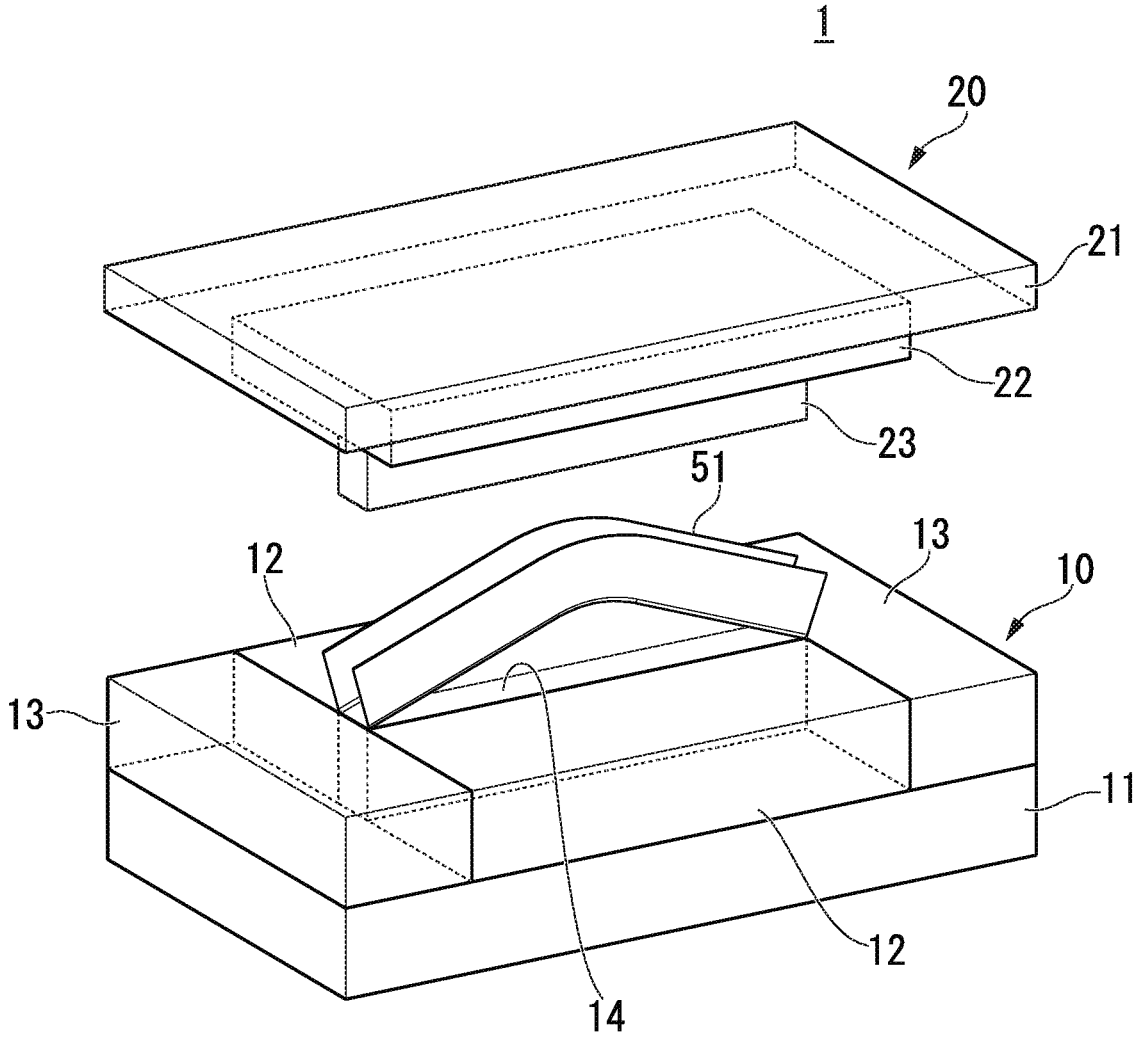
FIG. 2 is a perspective view showing the device for manufacturing a press-formed product according to the first embodiment of the present invention.

FIG. 2 is a perspective view showing a device 1 for manufacturing a press-formed product (hereinafter, simply referred to as a manufacturing device 1) according to a first embodiment of the present invention. The manufacturing device 1 presses an intermediate press-formed product 51 so as to manufacture a press-formed product 101 (refer to FIGS. 5A to 5C). Hereinafter, first, the intermediate press-formed product 51 will be described.

Figure 1A:
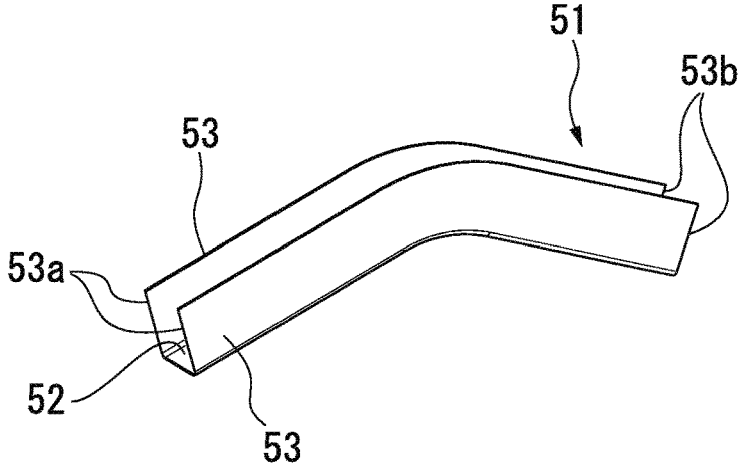
FIG. 1A is a perspective view showing an intermediate press-formed product which is used in a device for manufacturing a press-formed product according to a first embodiment of the present invention.
Figure 1B:
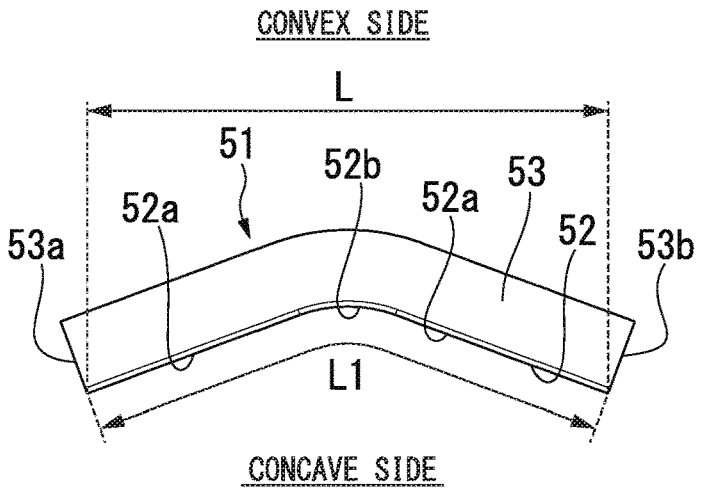
FIG. 1B is a front view showing the intermediate press-formed product.
Figure 1C:
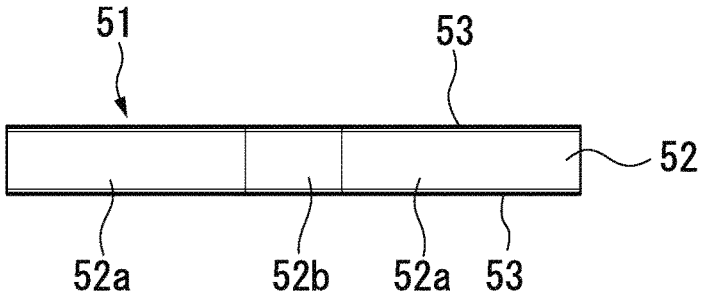
FIG. 1C is a plan view showing the intermediate press-formed product.
Figure 1D:
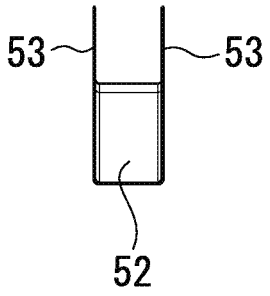
FIG. 1D is a side view showing the intermediate press-formed product.

FIGS. 1A to 1D are views showing the intermediate press-formed product 51. In addition, FIG. 1A is a perspective view, FIG. 1B is a front view, FIG. 1C is a plan view, and FIG. 1D is a side view. As shown in FIG. 1A to 1D, the intermediate press-formed product 51 is a steel (long material) which is long in one direction, and is configured of a web portion 52, and a pair of vertical wall portions 53 which are provided on both sides of the web portion 52 in a width direction and face each other. The web portion 52 includes two linear portions 52*a* (flat portions) and a bending portion 52*b* which is provided between the two linear portions 52*a*.

The bending portion 52*b* of the web portion 52 is a portion which is provided on the center portion of the web portion 52*b* in a longitudinal direction and is curved in an arc shape. Here, in surfaces of the bending portion 52*b*, a surface (extension surface) which is extended by bending is referred to as a convex side (extension side), and the other surface (a surface (constriction surface) which is constricted by bending) is referred to as a concave side (constriction side) (refer to FIG. 1B). Hereinafter, these are similarly applied to all drawings in the present specification.

The pair of vertical wall portions 53 is provided on the convex side of the bending portion 52*b* of the web portion 52. In addition, when the intermediate press-formed product 51 is viewed from the front, the pair of vertical wall portions 53 extends so as to have a constant width between one end and the other end of the web portion 52. A curvature of the center portion of the vertical wall portion 53 in the longitudinal direction is the same as a curvature of the bending portion 52*b* of the web portion 52.

The intermediate press-formed product 51 is manufactured by press-forming a steel sheet. For example, a rectangular steel sheet in a plan view is press-formed so as to be straight steel having the web portion 52 and the pair of vertical wall portions 53, and thereafter, the intermediate press-formed product 51 can be manufactured by bending the steel. In addition, the intermediate press-formed product 51 may be directly manufactured by press-forming the steel sheet without performing the bending.

In addition, preferably, in the intermediate press-formed product 51, a slenderness ratio λ, represented by the following Expression (1) is 100 or more.

$$\lambda = L1/r \quad (1)$$

In Expression (1), L1 is the entire length of the intermediate press-formed product (refer to FIG. 1B), and r is a cross-sectional secondary radius which is represented by the following Expression (2) using a cross-sectional secondary moment 1 and a cross-sectional area A of the intermediate press-formed product 51.

$$r = (1/A)^{1/2} \quad (2)$$

Since the slenderness ratio λ is 100 or more, it is possible to easily perform the bending when the intermediate press-formed product 51 is manufactured.

As shown in FIG. 1B, a shortest distance L between both ends (both edges) of the intermediate press-formed product 51 in the longitudinal direction is shorter than the entire length L1 of the intermediate press-formed product 51. Here, the entire length L1 of the intermediate press-formed product 51 means the entire length of the curved web portion 52. In addition, the shortest distance L means the shortest distance between short sides 53*a* and 53*b* (both edges of vertical wall portion) of the vertical wall portion 53.

Next, the manufacturing device 1 according to the present embodiment will be described. As shown in FIG. 2, the manufacturing device 1 includes a lower press tool 10 (first press tool) and an upper press tool 20 (second press tool). Moreover, the lower press tool 10 and the upper press tool 20 are installed on a press forming machine (not shown). The press forming machine may be a general press forming machine. However, preferably, the press forming machine is a servo-type press forming machine in which bottom dead centers and lowering speeds of the press tools can be arbitrarily adjusted.

The lower press tool 10 includes a base portion 11, a pair of long-side walls 12 which is fixed to the base portion 11 and faces each other, and a pair of short-side walls 13 (a pair of restriction walls) which is fixed to the base portion 11 and faces each other. The upper press tool 20 includes a main body portion 21 and a punch portion 22 which has a convex portion 23. Moreover, in the lower press tool 10, a groove portion 14 is formed by the pair of long-side walls 12 and the pair of short-side walls 13.

When the press-formed product 101 is manufactured, the intermediate press-formed product 51 is disposed between the lower press tool 10 and the upper press tool 20. In addition, by lowering the upper press tool 20, the intermediate press-formed product 51 is pressed and pushed into the groove portion 14.

Figure 3A:
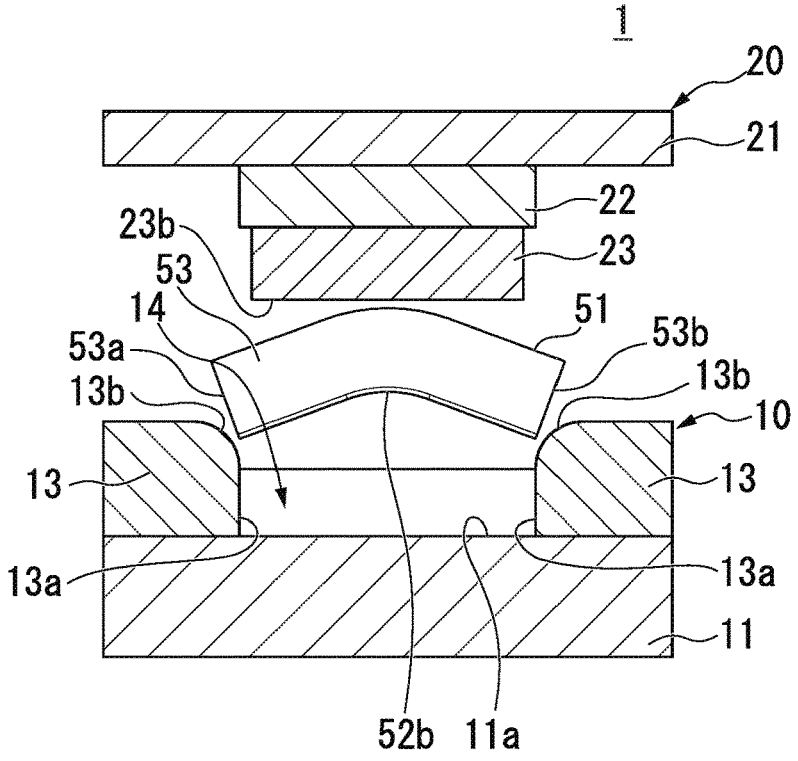
FIG. 3A is a front view showing the device for manufacturing a press-formed product according to the first embodiment of the present invention.
Figure 3B:
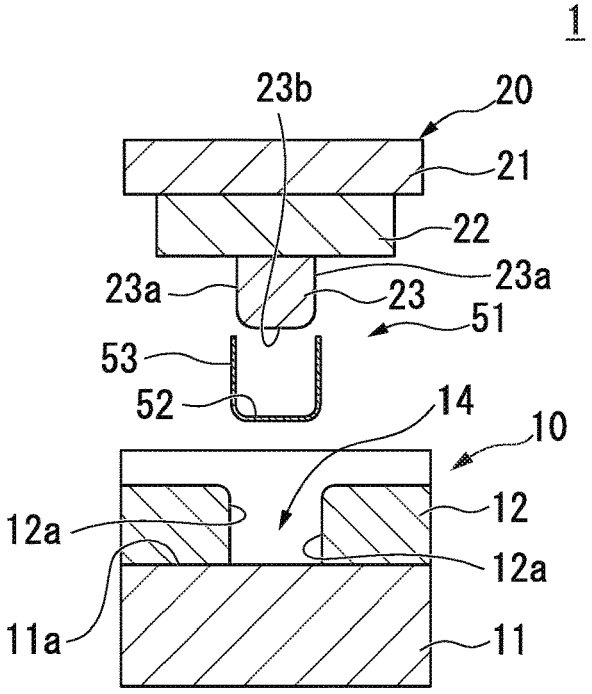
FIG. 3B is a side view showing the device for manufacturing a press-formed product according to the first embodiment of the present invention.

FIG. 3A is a longitudinal sectional view showing the manufacturing device 1, and FIG. 3B is a cross sectional view showing the manufacturing device 1. As shown in FIGS. 3A and 3B, wall surfaces 13*a* (side surfaces) of the pair of short-side walls 13 and wall surfaces 12*a* of the pair of the long-side walls 12 are perpendicular to an upper surface 11*a* of the base portion 11. In addition, a convex surface 13*b* (guide surface) is provided on each of upper portions of the wall surfaces 13*a*.

As shown in FIG. 3A, the groove portion 14 which is formed by the pair of long-side walls 12 and the pair of short-side walls 13 has a length corresponding to the shortest distance L (refer to FIG. 1B) between both ends of the intermediate press-formed product 51. That is, the length of the groove portion 14 (the distance between the wall surfaces 13*a* of the pair of short-side walls 13) is the same as the shortest distance L between both ends of the intermediate press-formed product 51.

As shown in FIG. 3B, the groove portion 14 has a width corresponding to a gap between the pair of vertical wall portions 53 of the intermediate press-formed product 51. That is, the width (the distance between the wall surfaces 12*a* of the pair of long-side walls 12) of the groove portion 14 is the same as the width of the intermediate press-formed product 51. In addition, a depth of the groove portion 14 is the same as the width of the vertical wall portion 53 of the intermediate press-formed product 51.

In addition, as shown in FIG. 3B, the convex portion 23 of the punch portion 22 includes a pair of side surfaces 23*a* which is provided on both sides in the width direction, and a distal surface 23*b* which faces the groove portion 14. When the upper press tool 20 lowers and the upper press tool 20 and the lower press tool 10 approach each other, the convex portion 23 of the punch portion 22 enters the groove portion 14 of the lower press tool 10. In addition, the convex portion 23 may be integrated with the punch portion 22, and may be separated from the punch portion 22.

The length of the convex portion 23 is less than or equal to the shortest distance L of the intermediate press-formed product 51, and the width (the distance between the pair of side surfaces 23*a*) of the convex portion 23 is the same as the distance between the inner surfaces of the pair of vertical wall portions 53 of the intermediate press-formed product 51.

Next, a method for manufacturing the press-formed product 101 by the intermediate press-formed product 51 using the manufacturing device 1 will be described. First, as shown in FIG. 3A, the intermediate press-formed product 51 is disposed immediately on the groove portion 14 of the lower press tool 10. At this time, the intermediate press-formed product 51 is disposed such that the convex side (extension side, refer to FIG. 1B) of the bending portion 52*b* of the intermediate press-formed product 51 faces the upper press tool 20. Accordingly, the convex portion 23 of the punch portion 22 can come into contact with the convex side of the bending portion 52*b*. In addition, in the state where the intermediate press-formed product 51 is disposed in the manufacturing device 1, the short sides 53*a* and 53*b* of the vertical wall portion 53 of the intermediate press-formed product 51 come into contact with the convex surfaces 13*b* of the short-side walls 13.

Figure 4A:
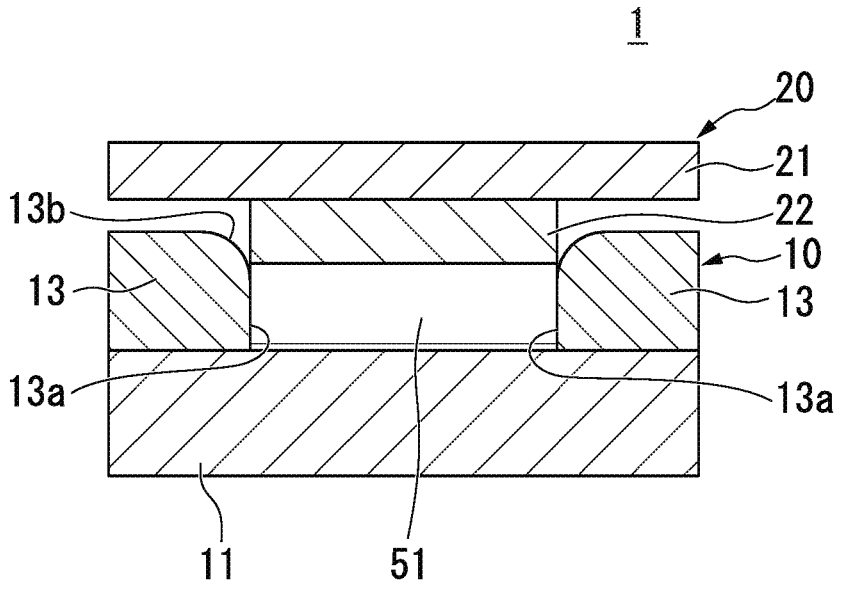
FIG. 4A is a front view showing the device for manufacturing a press-formed product according to the first embodiment of the present invention, and is a view showing a state where an upper press tool is lowered to a bottom dead center.
Figure 4B:
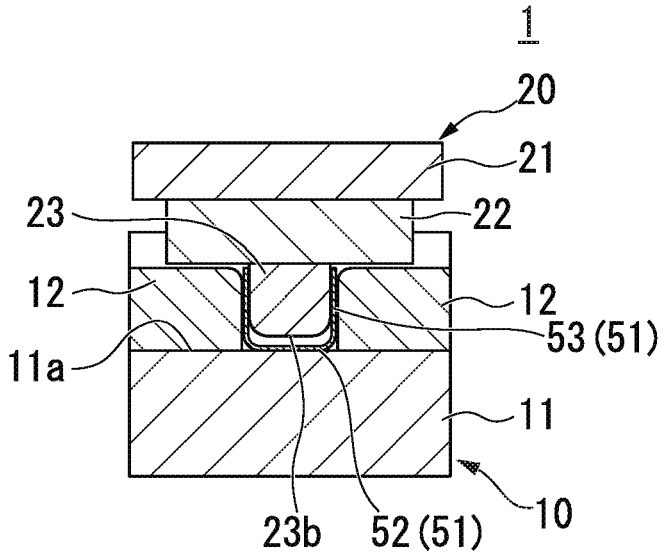
FIG. 4B is a side view showing the device for manufacturing a press-formed product according to the first embodiment of the present invention, and is a view showing a state where the upper press tool is lowered to the bottom dead center.

Subsequently, as shown in FIGS. 4A and 4B, the upper press tool 20 lowers, and the intermediate press-formed product 51 is press-formed. At this time, since the convex portion 23 of the punch portion 22 presses the convex side of the bending portion 52*b* of the intermediate press-formed product 51, the curvature of the bending portion 52*b* decreases, and the intermediate press-formed product 51 linearly extends. Here, as described above, since the distance between the pair of short-side walls 13 is the same as the shortest distance L between both ends of the intermediate press-formed product 51 in the longitudinal direction, both ends of the intermediate press-formed product 51 in the longitudinal direction are restricted by the pair of short-side walls 13. Accordingly, by lowering the upper press tool 20, compressive stress is applied to the intermediate press-formed product 51 in the longitudinal direction. Simultaneously, by decreasing the curvature of the bending portion 52*b*, inclination angles of the short sides 53*a* and 53*b* of the intermediate press-formed product 51 gradually become perpendicular. In this way, the intermediate press-formed product 51 is pushed into the groove portion 14 while the short sides 53*a* and 53*b* come into contact with the convex surface 13*b*.

In the press forming, since the distance between the wall surfaces 13*a* of the pair of short-side walls 13 is the same as the shortest distance L between both ends of the intermediate press-formed product 51 in the longitudinal direction and the convex side of the bending portion 52*b* of the intermediate press-formed product 51 is pressed, it is possible to decrease the curvature of the bending portion 52*b* of the intermediate press-formed product 51 while restricting both ends of the intermediate press-formed product 51 in the longitudinal direction. As a result, since the entire length L1 (refer to FIG. 1B) of the web portion 52 of the intermediate press-formed product 51 is longer than the shortest distance L between both ends of the intermediate press-formed product 51 in the longitudinal direction, compressive stress is applied to the web portion 52 and the vertical wall portions 53 of the intermediate press-formed product 51 in the longitudinal direction, and it is possible to compress the intermediate press-formed product 51 in the longitudinal direction. That is, thicknesses (cross-sectional areas) of the web portion 52 and the vertical wall portion 53 of the intermediate press-formed product 51 can increase by the compression of the intermediate press-formed product 51.

In addition, when compressive stress is applied to the intermediate press-formed product 51, as shown in FIG. 4B, since the web portion 52 of the intermediate press-formed product 51 is interposed between the upper surface 11*a* of the base portion 11 of the lower press tool 10 and the distal surface 23*b* of the convex portion 23 of the upper press tool 20, it is possible to prevent buckling distortion of the web portion 52. Similarly, since the vertical wall portions 53 of the intermediate press-formed product 51 are interposed between the wall surfaces 12*a* (refer to FIG. 3B) of the pair of long-side walls 12 of the lower press tool 10 and the side surfaces 23*a* of the convex portion 23 of the upper press tool 20, it is possible to prevent buckling distortion of the vertical wall portions 53. In addition, since the short sides 53*a* and 53*b* of the intermediate press-formed product 51 are pushed into the groove portion 14 while coming into contact with the convex surfaces 13*b* of the short-side walls 13, it is possible to prevent buckling distortion of the end portions of the intermediate press-formed product 51 in the longitudinal direction. Accordingly, the buckling distortion of the web portion 52 and the vertical wall portions 53 of the intermediate press-formed product 51 is prevented, and it is possible to increase the thicknesses of the web portion 52 and the vertical wall portions 53.

According to the above-described press forming, the press-formed product 101 is manufactured from the intermediate press-formed product 51.

Figure 5A:
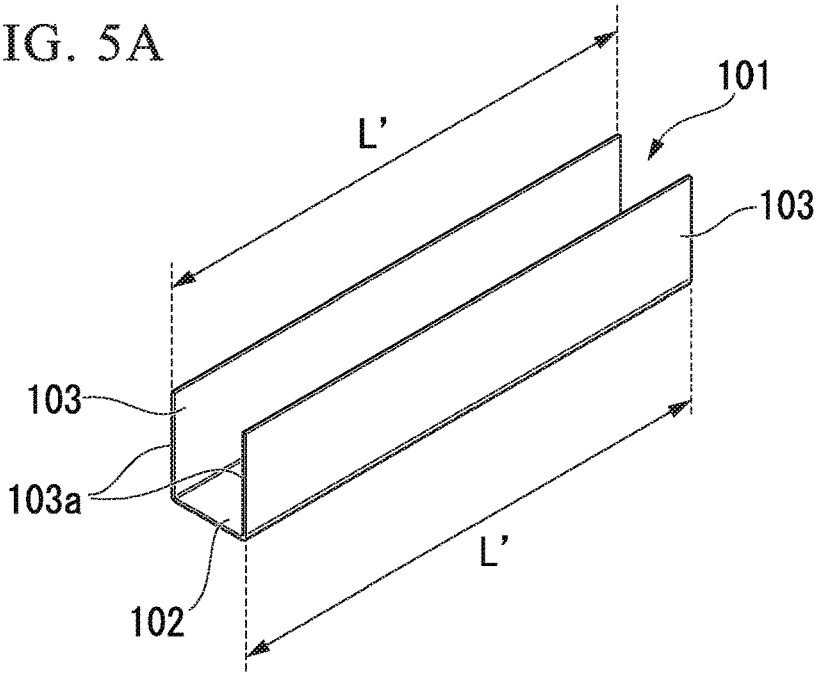
FIG. 5A is a perspective view showing a press-formed product according to the first embodiment of the present invention.
Figure 5B:
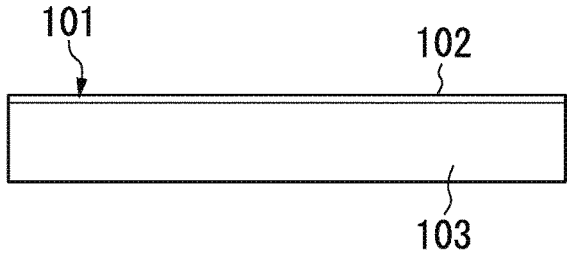
FIG. 5B is a front view showing the press-formed product.
Figure 5C:
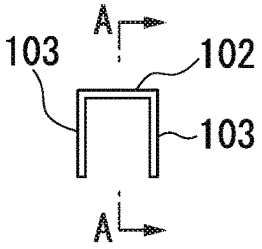
FIG. 5C is a side view showing the press-formed product.

FIGS. 5A to 5C are views showing the press-formed product 101 according to the present embodiment. In addition, FIG. 5A is a perspective view, FIG. 5B is a front view, and FIG. 5C is a side view. As described above, the press-formed product 101 is obtained by allowing the curvature of the bending portion 52*b* of the intermediate press-formed product 51 to be zero while constricting both ends of the intermediate press-formed product 51. Accordingly, as shown in FIGS. 5A to 5C, the press-formed product 101 has a straight shape, and the entire length L' of the press-formed product 101 is the same as the shortest distance L between both ends of the intermediate press-formed product 51 in the longitudinal direction.

Figure 6A:
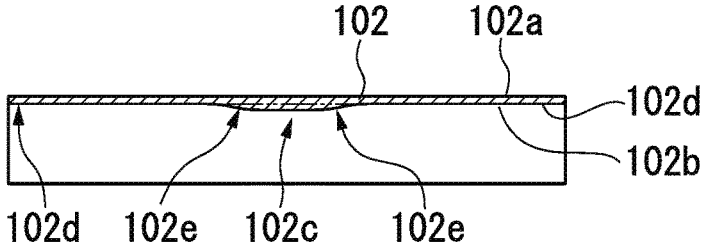
FIG. 6A is a sectional view taken along line A-A of FIG. 5C.
Figure 6B:
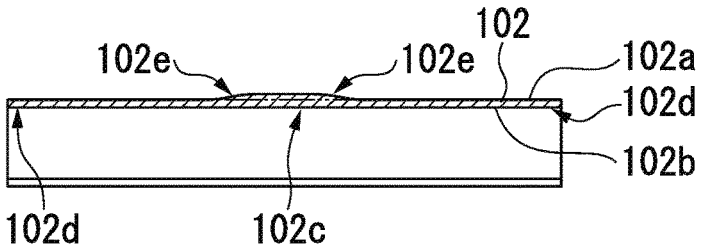
FIG. 6B is a sectional view taken along line A-A of FIG. 5C.
Figure 6C:
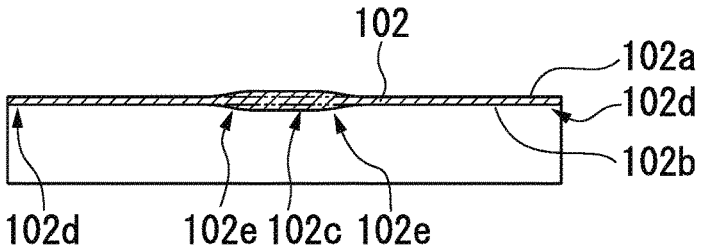
FIG. 6C is a sectional view taken along line A-A of FIG. 5C.

FIGS. 6A to 6C are sectional views taken along line A-A of FIG. 5C, and are views showing examples in which the thickness of the press-formed product 101 increases (the cross-sectional area increases). FIG. 6A shows a case where an upper surface 102*a* of the web portion 102 of the press-formed product 101 is a flat surface and a lower surface 102*b* is a rising surface due to the increase in the thickness. As shown in FIG. 6A, the web portion 102 of the press-formed product 101 includes a thick section 102*c* (high cross-sectional area portion) having the thickest thickness, a thin section 102*d* (low cross-sectional area portion) having a thickness which is thinner than that of the thick section 102*c*, and an intermediate portion 102*e* which is provided between the thick section 102*c* and the thin section 102*d* and in which the thickness continuously changes along the longitudinal direction. In addition, when the press-formed product 101 is viewed from the cross section perpendicular to the longitudinal direction, the thick section 102*c* is a portion having the largest cross-sectional area, and the thin section 102*d* is a portion having the smallest cross-sectional area.

Here, the bending portion 52*b* of the intermediate press-formed product 51 becomes the thick section 102*c* of the press-formed product 101, and the linear portion 52*a* of the intermediate press-formed product 51 becomes the thin section 102*d*. In the intermediate press-formed product 51, since the length of the bending portion 52*b* is shorter than that of the linear portion 52*a* (refer to FIG. 1B), the length of the thin section 102*d* is longer than the length of the thick section 102*c*.

FIG. 6B shows a case where the lower surface 102*b* of the web portion 102 is a flat surface and the upper surface 102*a* is a rising surface due to the increase in the thickness. In addition, FIG. 6C shows a case where the upper surface 102*a* and the lower surface 102*b* of the web portion 102 are rising surfaces due to the increases in the thicknesses.

Figure 6D:
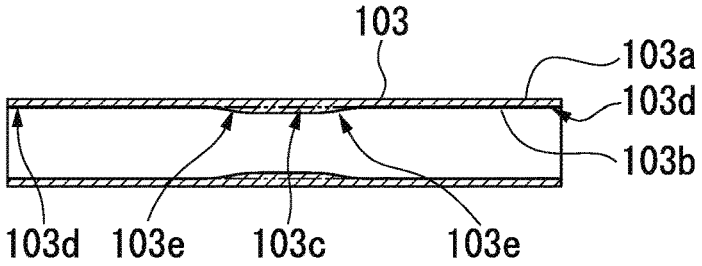
FIG. 6D is a bottom view showing the press-formed product.
Figure 6E:
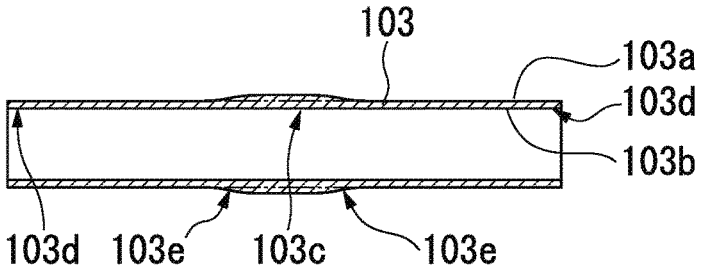
FIG. 6E is a bottom view showing the press-formed product.
Figure 6F:
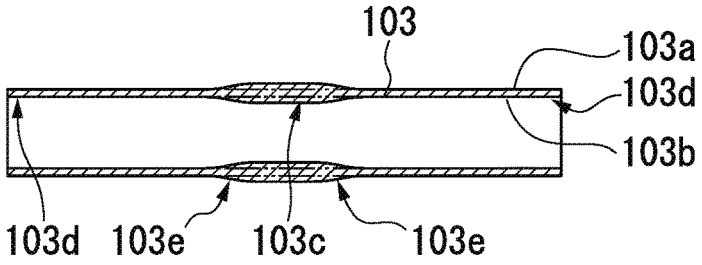
FIG. 6F is a bottom view showing the press-formed product.

In addition, FIGS. 6D to 6F are bottom views of the press-formed product 101, and views showing examples in which the thicknesses increase (the cross-sectional areas increase). FIG. 6D shows a case where an outer surface 103*a* of each of the vertical wall portions 103 is a flat surface and an inner surface 103*b* is a rising surface due to the increase in the thickness. As shown in FIG. 6D, the vertical wall portion 103 includes a thick section 103*c* (high cross-sectional area portion) having the thickest thickness, a thin section 103*d* (low cross-sectional area portion) having a thickness which is thinner than that of the thick section 103*c*, and an intermediate portion 103*e* which is provided between the thick section 103*c* and the thin section 103*d* and in which the thickness continuously changes along the longitudinal direction. In addition, similarly to the web portion 102, the length of the thin section 103*d* of the vertical wall portion 103 is longer than the length of the thick section 103*c*.

FIG. 6E shows a case where the inner surface 103*b* of the vertical wall portions 103 is a flat surface and the outer surface 103*a* is a rising surface due to the increase in the thickness. In addition, FIG. 6F shows a case where the outer surface 103*a* and the inner surface 103*b* of the vertical wall portion 103 are rising surfaces due to the increases in the thicknesses.

As shown in FIGS. 6A to 6F, whether each surface of the web portion 102 and the vertical wall portions 103 of the press-formed product 101 is a flat surface or a rising surface due to the increase in the thickness is determined by the gap between the groove portion 14 of the lower press tool 10 and the convex portion 23 of the upper press tool 20, the bottom dead center of the upper press tool 20, or the like.

As described above, since the thick section 102*c* or the thick section 103*c* is provided on the web portion 102 and the vertical wall portions 103 of the press-formed product 101, and the thickness of each of the web portion 102 and the vertical wall portions 103 partially increases (the cross-sectional area partially increases when viewed from the cross section perpendicular to the longitudinal direction), it is possible to increase rigidity of the press-formed product 101. In addition, since the press-formed product 101 is manufactured by compressing the intermediate press-formed product 51 in the longitudinal direction, it is possible to increase yield strength of the press-formed product 101 by work hardening.

In addition, since the intermediate portion 102*e* is provided between the thick section 102*c* and the thin section 102*d*, it is possible to prevent stress from being concentrated in a boundary between the thick section 102*c* and the thin section 102*d*.

In addition, the thickness of the thick section 102*c* of the press-formed product 101 is determined by the entire length, the thickness, the curvature, the material, or the like of the intermediate press-formed product 51. Preferably, the thickness of the press-formed product 101 is 105% or more of the thickness of the intermediate press-formed product 51, and more preferably, is 110% or more of the thickness of the intermediate press-formed product 51. In addition, an upper limit of the thickness of the thick section 102*c* of the press-formed product 101 is not particularly limited. However, the upper limit of the thickness of the thick section 102*c* may be 140% or less of the thickness of the intermediate press-formed product 51, may be 135% or less thereof, and may be 130% or less thereof.

In addition, since the length of the thin section 102*d* is longer than the length of the thick section 102*c*, it is possible to increase the rigidity of only a necessary portion, and it is possible to decrease weight of the component. Similarly, since the length of the thin section 103*d* is longer than the length of the thick section 103*c*, it is possible to increase the rigidity of only a necessary portion, and it is possible to decrease the weight of the component.

For example, the press-formed product 101 can be suitably used in an automobile component such as center pillar reinforcement, a floor cross member, or locker reinforcement.

In the present embodiment, the case is described, in which the straight press-formed product 101 is manufactured by allowing the curvature of the bending portion 52*b* of the intermediate press-formed product 51 to be zero. However, the present embodiment is not limited to this, and the press-formed product 101 may be manufactured by decreasing the curvature of the bending portion 52*b* of the intermediate press-formed product 51 to a predetermined curvature. That is, the curvature of the bending portion 52*b* subjected to the press forming is not limited to only zero, and may be any curvature as long as it is smaller than the curvature of the bending portion 52*b* before the press forming.

As described above, according to the present embodiment, the intermediate press-formed product 51 having the bending portion 52*b* is prepared, the intermediate press-formed product 51 is compressed along the longitudinal direction by decreasing the curvature of the bending portion 52*b* of the intermediate press-formed product 51 while constantly maintaining the shortest distance between both ends of the intermediate press-formed product 51 in the longitudinal direction, and the material becomes a surplus by the compression. Accordingly, the thickness (cross-sectional area) of a portion of the web portion 52 increases due to the surplus material. Simultaneously, the thickness (cross-sectional area) of a portion of the vertical wall portion 53 also increases. In this way, it is possible to manufacture the press-formed product 101 which includes the web portion 102 and the vertical wall portions 103 having the increased thickness (increased cross-sectional area) without performing welding, is lightweight, and has high rigidity.

In addition, in the present embodiment, the case is described in which the distance between the pair of short-side walls 13 of the manufacturing device 1 is the same as the shortest distance L of the intermediate press-formed product 51. However, the distance between the pair of short-side walls 13 of the manufacturing device 1 may be any distance as long as it is smaller than the entire length L1 (the length in a case where the intermediate press-formed product 51 linearly extends) of the intermediate press-formed product 51. In this case, since the intermediate press-formed product 51 can be compressed along the longitudinal direction, it is possible to manufacture the press-formed product 101 having the increase thickness without performing welding.

[Modification Example of Press-Formed Product]

Figure 7A:
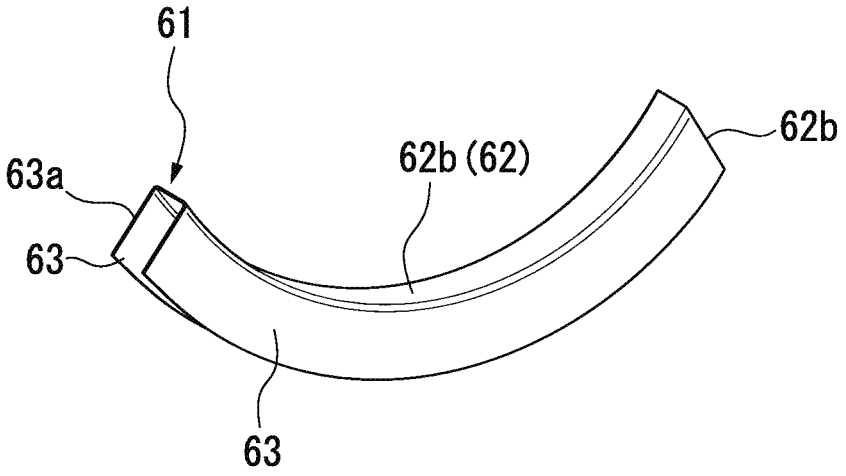
FIG. 7A is a perspective view showing a modification example of the intermediate press-formed product which is used in the device for manufacturing a press-formed product according to the first embodiment of the present invention.
Figure 7B:
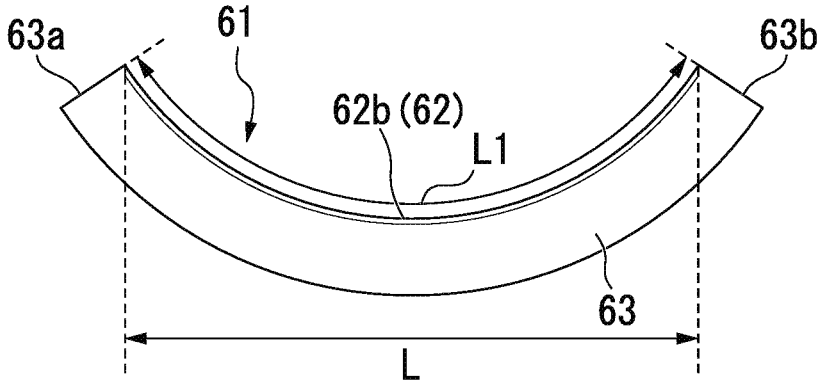
FIG. 7B is a front view showing the intermediate press-formed product.
Figure 7C:
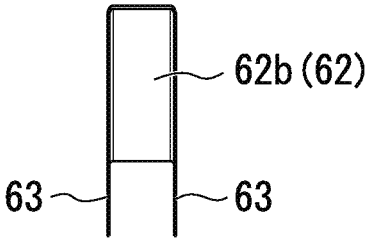
FIG. 7C is a side view showing the intermediate press-formed product.

In the present embodiment, the case is described in which the press-formed product 101 is manufactured by the intermediate press-formed product 51. However, it is possible to manufacture various press-formed products using other intermediate press-formed products instead of the intermediate press-formed product 51. FIGS. 7A to 7C are view showing an intermediate press-formed product 61. In addition, FIG. 7A is a perspective view, FIG. 7B is a front view, and FIG. 7C is a side view. As shown in FIGS. 7A to 7C, similarly to the intermediate press-formed product 51, the intermediate press-formed product 61 includes a web portion 62 and a pair of vertical wall portions 63. Here, the web portion 62 of the intermediate press-formed product 61 is configured of a bending portion 62*b*, and the entire web portion 62 has a curved shape.

Figure 8:
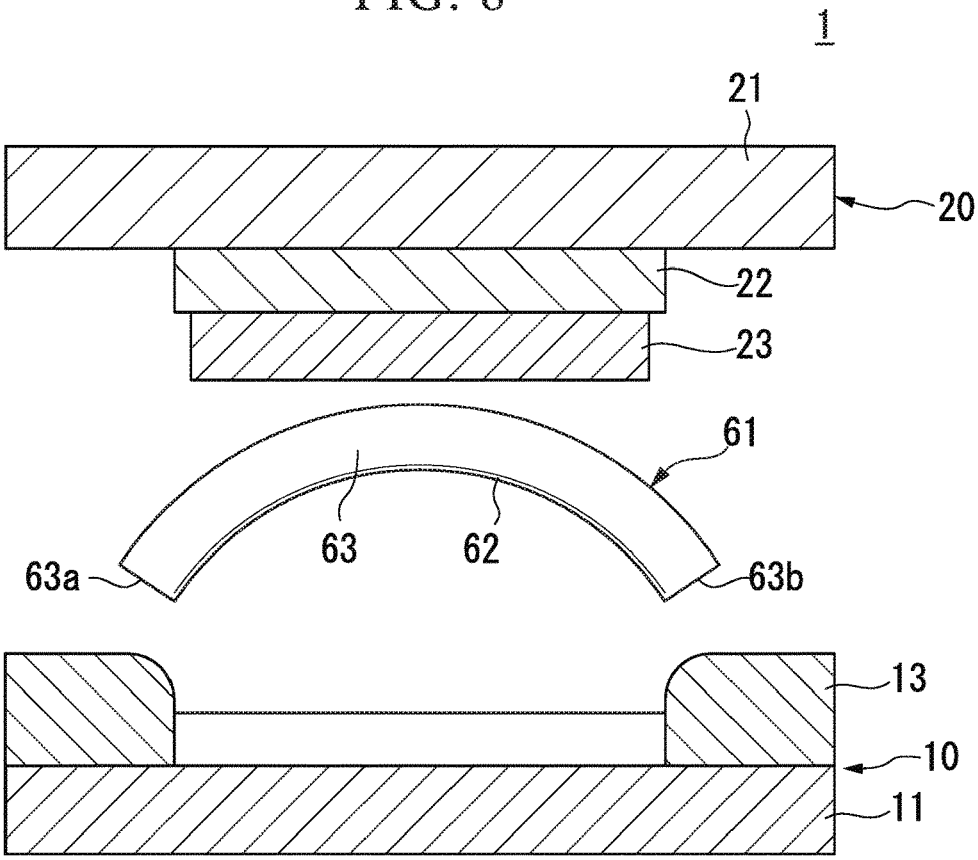
FIG. 8 is a front view showing the device for manufacturing a press-formed product according to the first embodiment of the present invention.
Figure 9A:
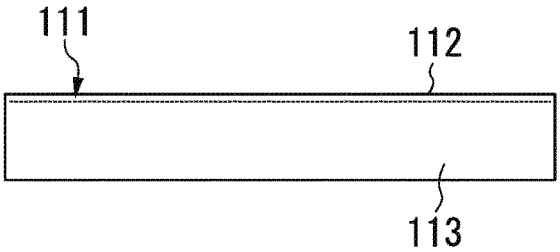
FIG. 9A is a view showing a modification example of the press-formed product according to the first embodiment of the present invention.
Figure 9B:
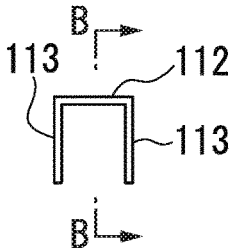
FIG. 9B is a side view showing the modification example of the press-formed product according to the first embodiment of the present invention.

FIG. 8 is a view showing a state where the intermediate press-formed product 61 is disposed in the manufacturing device 1. Similarly to the case where the press-formed product 101 is manufactured, it is possible to compress the intermediate press-formed product 61 along the longitudinal direction by lowering the upper press tool 20 of the manufacturing device 1. FIGS. 9A and 9B are view showing a press-formed product 111 which is manufactured by the intermediate press-formed product 61. In addition, FIGS. 9C to 9H show examples in which thicknesses of a web portion 112 and vertical wall portions 113 of the press-formed product 111 increase.

Figure 9C:
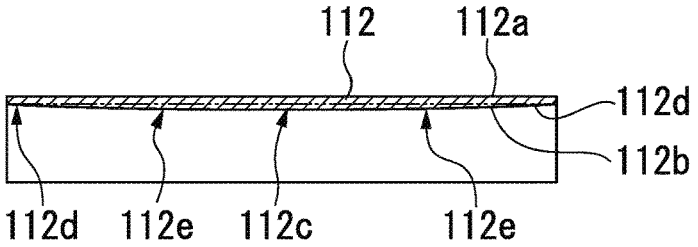
FIG. 9C is a sectional view taken along line B-B of FIG. 9B.
Figure 9D:
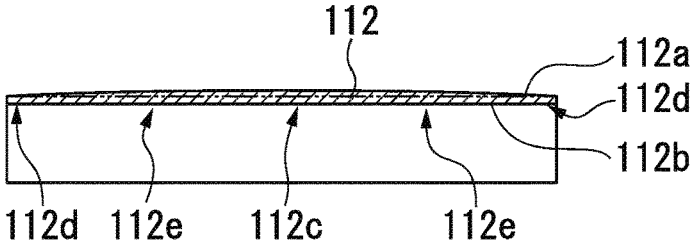
FIG. 9D is a sectional view taken along line B-B of FIG. 9B.
Figure 9E:
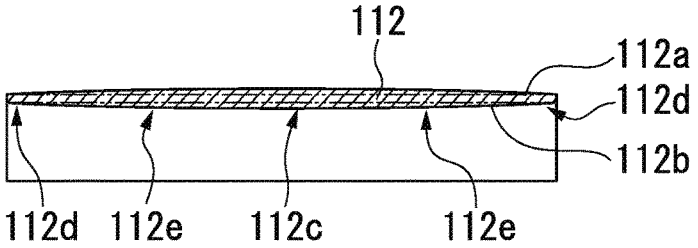
FIG. 9E is a sectional view taken along line B-B of FIG. 9B.

FIGS. 9C to 9E are sectional views taken along line B-B of FIG. 9B. In FIG. 9C, an upper surface 112*a* of the web portion 112 is a flat surface and a lower surface 112*b* is a rising surface due to the increase in the thickness. The web portion 112 includes a thick section 112*c* having the thickest thickness, a thin section 112*d* having a thickness which is thinner than that of the thick section 112*c*, and an intermediate portion 112*e* which is provided between the thick section 112*c* and the thin section 112*d* and in which the thickness continuously changes.

FIG. 9D shows a case where the lower surface 112*b* of the web portion 112 is a flat surface and the upper surface 112*a* is a rising surface due to the increase in the thickness. In addition, FIG. 9E shows a case where the upper surface 112*a* and the lower surfaces 112*b* of the web portion 112 are rising surfaces due to the increase in the thicknesses.

Figure 9F:
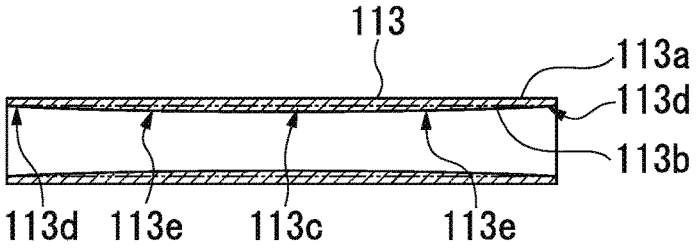
FIG. 9F is a bottom view showing the modification example of the press-formed product according to the first embodiment of the present invention.
Figure 9G:
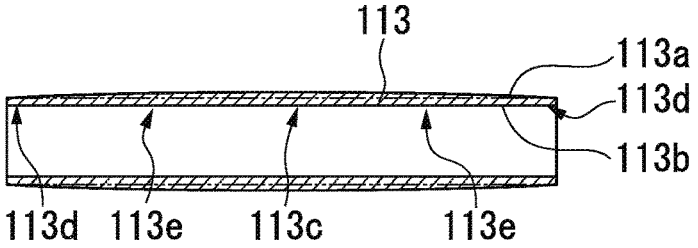
FIG. 9G is a bottom view showing the modification example of the press-formed product according to the first embodiment of the present invention.
Figure 9H:
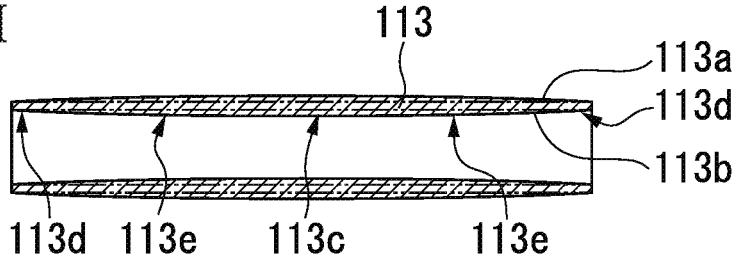
FIG. 9H is a bottom view showing the modification example of the press-formed product according to the first embodiment of the present invention.

FIGS. 9F to 9H show bottom views of the press-formed product 111. In FIG. 9F, an outer surface 113*a* of each of the vertical wall portions 113 is a flat surface, and the inner surface 113*b* is a rising surface due to the increase in the thickness. The vertical wall portion 113 includes a thick section 113*c* having the thickest thickness, a thin section 113*d* having a thickness which is thinner than that of the thick section 113*c*, and an intermediate portion 113*e* which is provided between the thick section 113*c* and the thin section 113*d* and in which the thickness continuously changes.

FIG. 9G shows a case where the inner surface 113*b* of each of the vertical wall portion 113 is a flat surface and the outer surface 113*a* is a rising surface due to the increase in the thickness. In addition, FIG. 9H shows a case where the inner surface 113*b* and the outer surface 113*a* of the vertical wall portion 113 are rising surfaces due to the increases in the thicknesses.

Figure 10A:
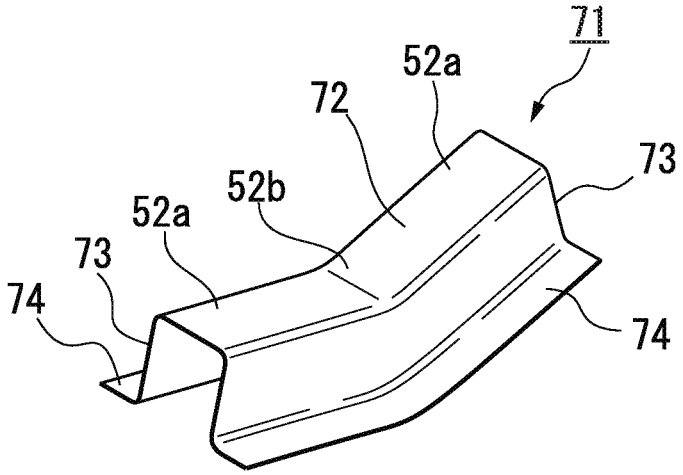
FIG. 10A is a perspective view showing another modification example of the intermediate press-formed product which is used in the device for manufacturing a press-formed product according to the first embodiment of the present invention.
Figure 10B:
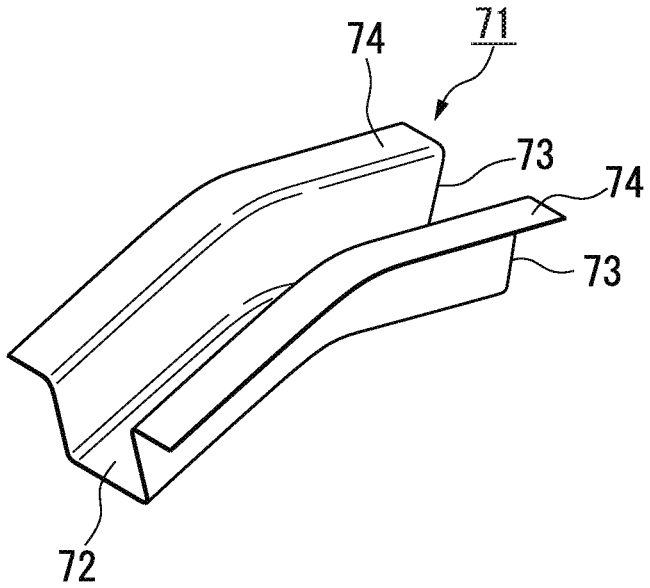
FIG. 10B is a view showing the intermediate press-formed product, and is a perspective view when viewed from a direction different from that of FIG. 10A.
Figure 10C:
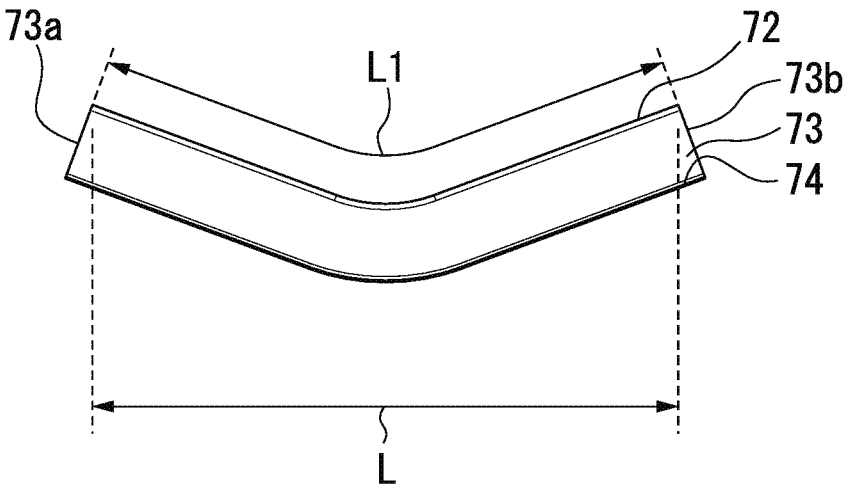
FIG. 10C is a front view showing the intermediate press-formed product.

In addition, in the manufacturing device 1, an intermediate press-formed product 71 shown in FIGS. 10A to 10C can be used. As shown in FIGS. 10A to 10C, the intermediate press-formed product 71 includes a web portion 72, a pair of vertical wall portions 73 which is connected to both sides of the web portion 72 in the width direction, and a flanged portion 74 which is connected to each of the pair of vertical wall portions 73. In addition, the intermediate press-formed product 71 is different from the intermediate press-formed product 51 (refer to FIGS. 1A to 1D) in that the flanged portions 74 are provided.

Figure 11A:
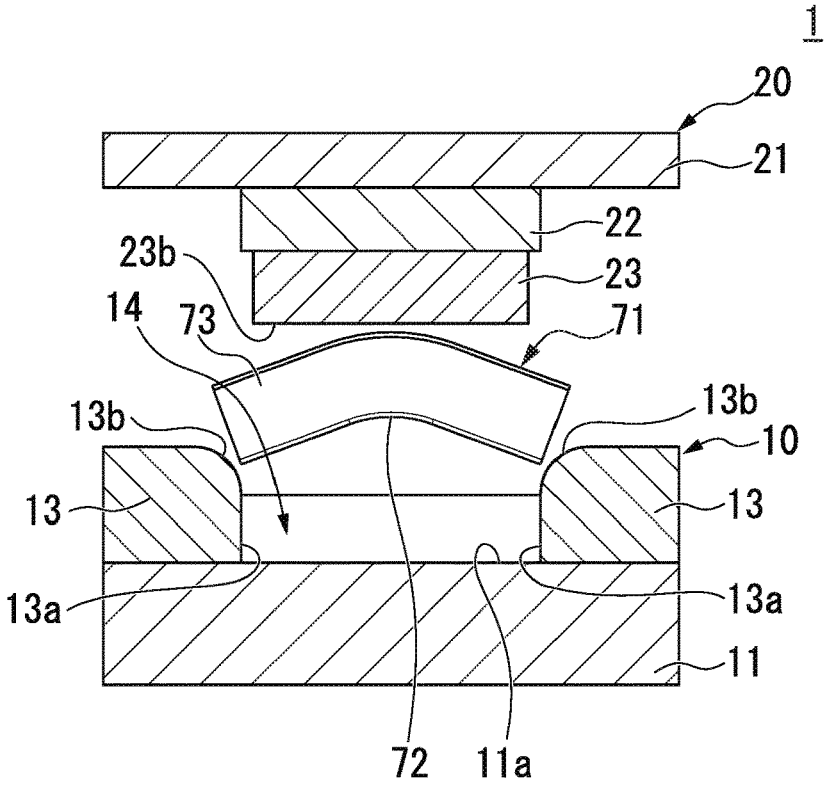
FIG. 11A is a front view showing the device for manufacturing a press-formed product according to the first embodiment of the present invention.
Figure 11B:
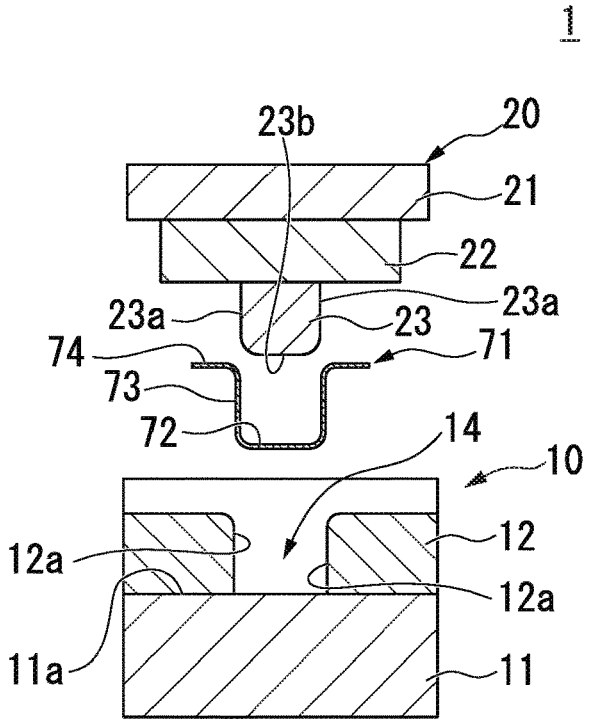
FIG. 11B is a side view showing the device for manufacturing a press-formed product according to the first embodiment of the present invention.
Figure 12A:
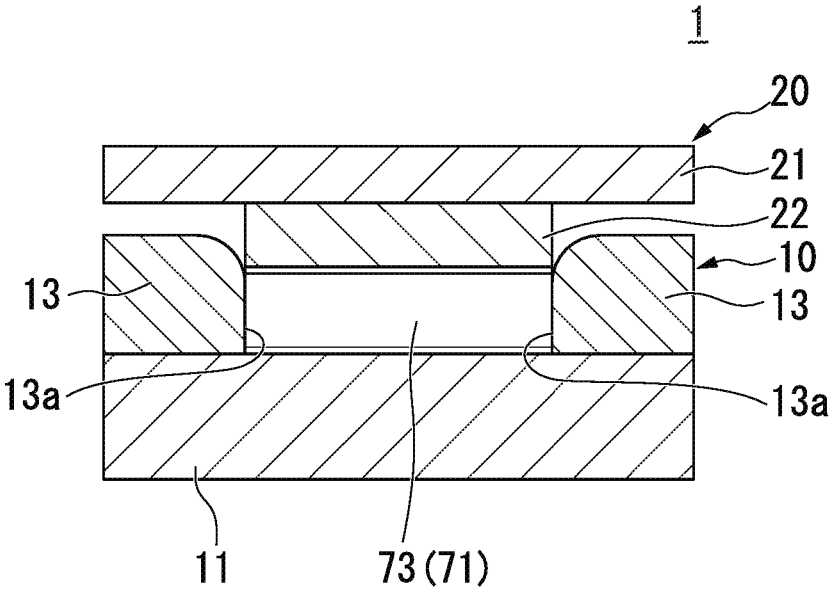
FIG. 12A is a front view showing the device for manufacturing a press-formed product according to the first embodiment of the present invention, and is a view showing a state where the upper press tool is lowered to the bottom dead center.
Figure 12B:
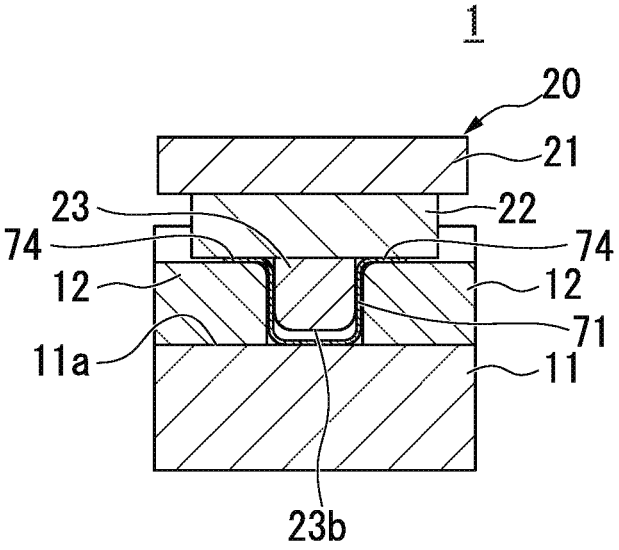
FIG. 12B is a side view showing the device for manufacturing a press-formed product according to the first embodiment of the present invention, and is a view showing the state where the upper press tool is lowered to the bottom dead center.

FIGS. 11A and 11B are views showing a state where the intermediate press-formed product 71 is disposed in the manufacturing device 1, and FIGS. 12A and 12B are views showing the upper press tool 20 of the manufacturing device 1 is lowered to the bottom dead center. Similarly to the case where the press-formed product 101 is manufactured, the intermediate press-formed product 71 can be compressed along the longitudinal direction by lowering the upper press tool 20 of the manufacturing device 1. In addition, as shown in FIG. 12B, the flanged portions 74 of the intermediate press-formed product 71 are interposed between the punch portion 22 and the upper surfaces of the long-side walls 12 so as to be restricted during the press forming. Accordingly, it is possible to prevent wrinkles from occurring on the flanged portions 74.

Figure 13A:
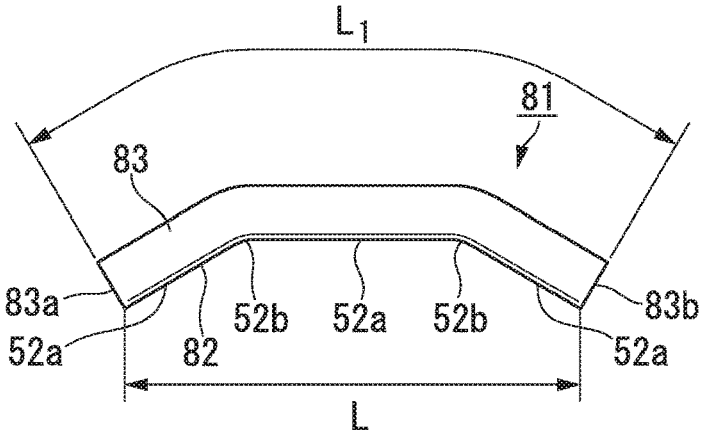
FIG. 13A is a front view showing still another modification example of the intermediate press-formed product which is used in the device for manufacturing a press-formed product according to the first embodiment of the present invention.
Figure 13B:
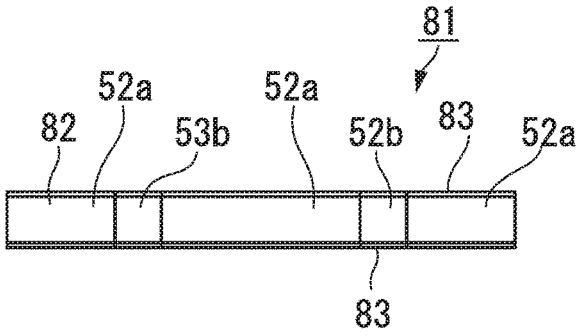
FIG. 13B is a plan view showing the intermediate press-formed product.
Figure 13C:
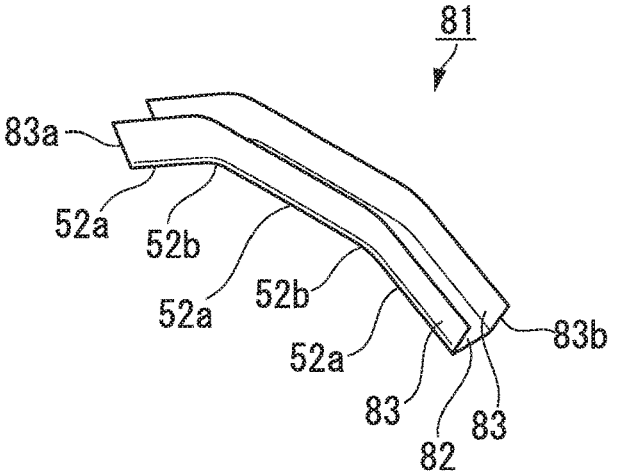
FIG. 13C is a perspective view showing the intermediate press-formed product.

Moreover, in the manufacturing device 1, an intermediate press-formed product 81 shown in FIGS. 13A to 13C can be used. As shown in FIGS. 13A to 13C, the intermediate press-formed product 81 includes a web portion 82 and a pair of vertical wall portions 83 which is connected to both sides of the web portion 82 in the width direction. In addition, the intermediate press-formed product 81 is different from the intermediate press-formed product 51 (refer to FIGS. 1A to 1D) in that it includes three linear portions 52*a* and two bending portions 52*b*.

Figure 14:
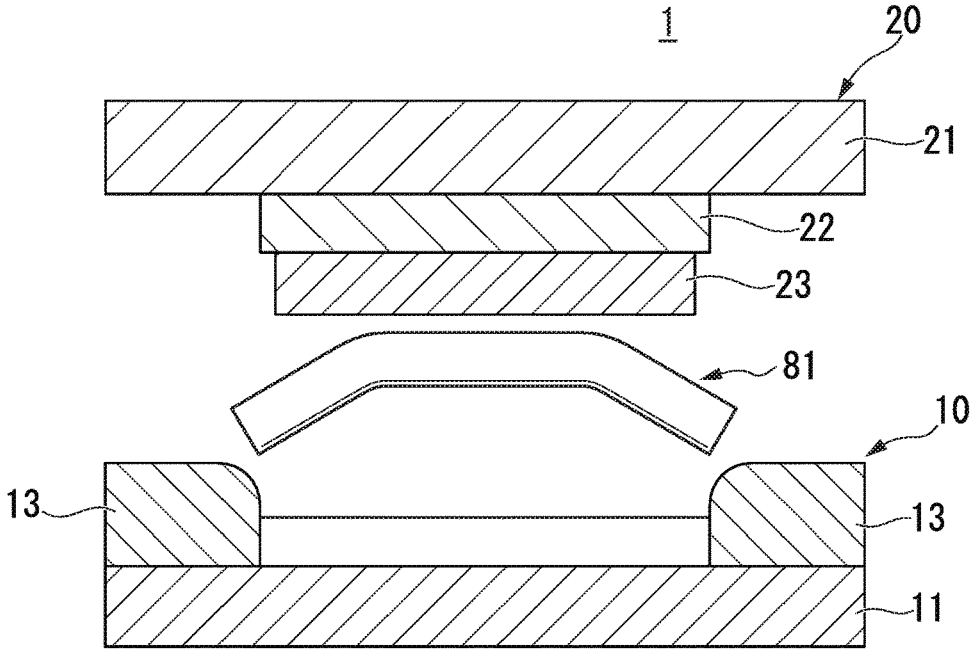
FIG. 14 is a front view showing the device for manufacturing a press-formed product according to the first embodiment of the present invention.
Figure 15A:
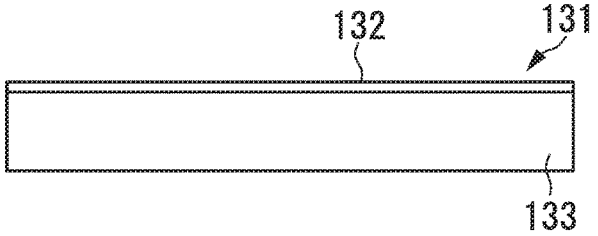
FIG. 15A is a front view showing still another modification example of the press-formed product according to the first embodiment of the present invention.
Figure 15B:
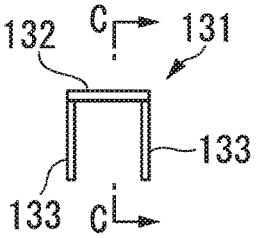
FIG. 15B is a side view showing still another modification example of the press-formed product according to the first embodiment of the present invention.

FIG. 14 shows a state where the intermediate press-formed product 81 is disposed in the manufacturing device 1. By lowering the upper press tool 20 from the state shown in FIG. 14, it is possible to compress the intermediate press-formed product 81 in the longitudinal direction. In addition, it is possible to manufacture a press-formed product 131 which is shown in FIGS. 15A and 15B from the intermediate press-formed product 81. FIGS. 15C to 15H show examples in which thicknesses of a web portion 132 and vertical wall portions 133 of the press-formed product 131 increase.

Figure 15C:
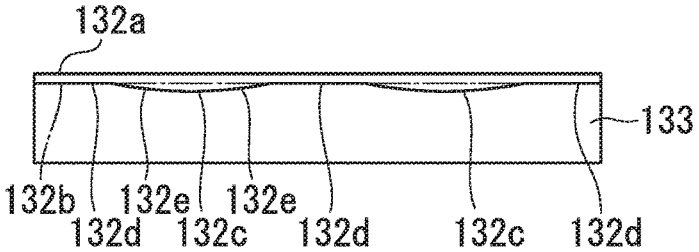
FIG. 15C is a sectional view taken along line C-C of FIG. 15B.
Figure 15D:
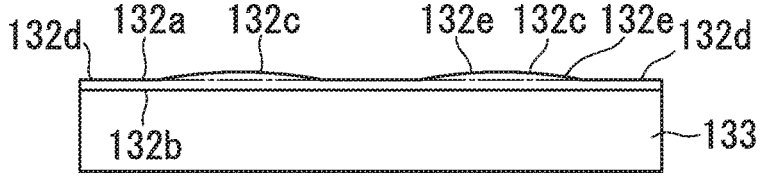
FIG. 15D is a sectional view taken along line C-C of FIG. 15B.
Figure 15E:
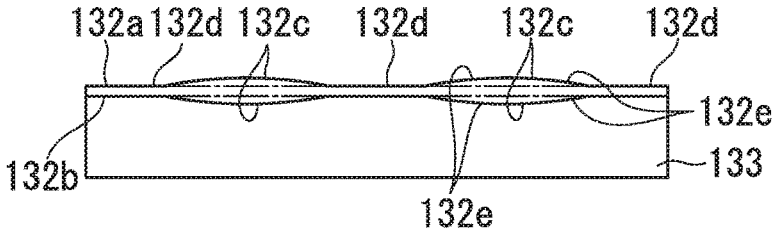
FIG. 15E is a sectional view taken along line C-C of FIG. 15B.

FIGS. 15C to 15E are sectional views taken along line C-C of FIG. 15B. In FIG. 15C, in a state where an upper surface 132*a* of the web portion 132 is a flat surface, a lower surface 132*b* is a rising surface due to the increase in the thickness. The web portion 132 includes a thick section 132*c*, a thin section 132*d*, and an intermediate portion 132*e* which is provided between the thick section 132*c* and the thin section 132*d* and in which the thickness continuously changes along the longitudinal direction. In addition, thick sections 132*c* are provided at two locations, and thin sections 132*d* are provided at three locations. In addition, the thick sections 132*c* are provided at the positions corresponding to the bending portions 52*b* of the intermediate press-formed product 81, and the thin sections 132*d* are provided at the positions corresponding to the linear portions 52*a* of the intermediate press-formed product 81.

FIG. 15D shows a case where the upper surface 132*a* is a rising surface due to the increase in the thickness in a state where the lower surface 132*b* of the web portion 132 is a flat surface. In addition, FIG. 15E shows a case where the upper surface 132*a* and the lower surfaces 132*b* of the web portion 132 are rising surfaces due to the increase in the thicknesses.

Figure 15F:
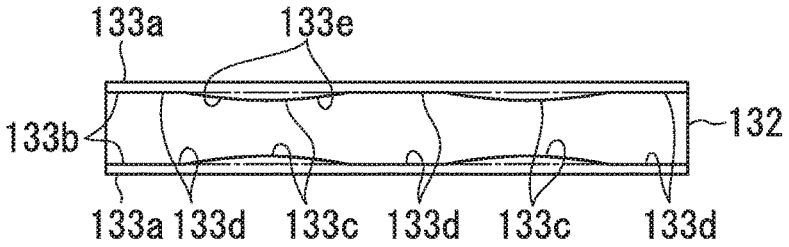
FIG. 15F is a bottom view showing still another modification example of the press-formed product according to the first embodiment of the present invention.
Figure 15G:
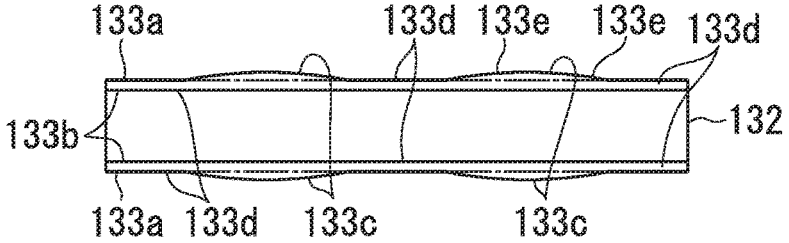
FIG. 15G is a bottom view showing still another modification example of the press-formed product according to the first embodiment of the present invention.
Figure 15H:
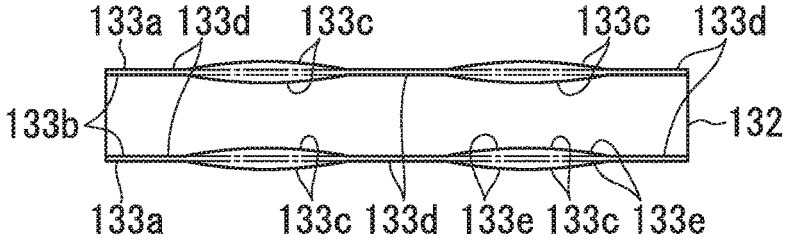
FIG. 15H is a bottom view showing still another modification example of the press-formed product according to the first embodiment of the present invention.

FIGS. 15F to 15H show bottom views of the press-formed product 131. In FIG. 15F, in a state where an outer surface 133*a* of each of the vertical wall portions 133 is a flat surface, an inner surface 133*b* is a rising surface due to the increase in the thickness. In the vertical wall portion 133, a thick section 133*c*, a thin section 133*d*, and an intermediate portion 133*e* which is provided between the thick section 133*c* and the thin section 133*d* are provided. Thick sections 133*c* are provided at two locations, and thin sections 133*d* are provided at three locations. The thick sections 133*c* are provided at the positions corresponding to the bending portions 52*b* of the intermediate press-formed product 81, and the thin sections 133*d* are provided at the positions corresponding to the linear portions 52*a* of the intermediate press-formed product 81.

FIG. 15G shows a case where the outer surface 133*a* is a rising surface due to the increase in the thickness in a state where the inner surface 133*b* of each of the vertical wall portions 133 is a flat surface. FIG. 15H shows a case where the outer surface 133*a* and the inner surface 133*b* of each of the vertical wall portions 133 are rising surfaces due to the increases in the thicknesses.

Figure 16A:
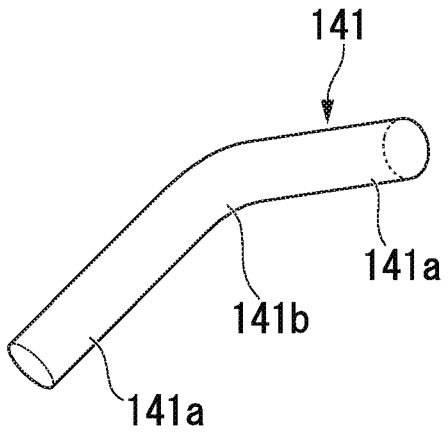
FIG. 16A is a perspective view showing still another modification example of the intermediate press-formed product which is used in the device for manufacturing a press-formed product according to the first embodiment of the present invention.
Figure 16B:
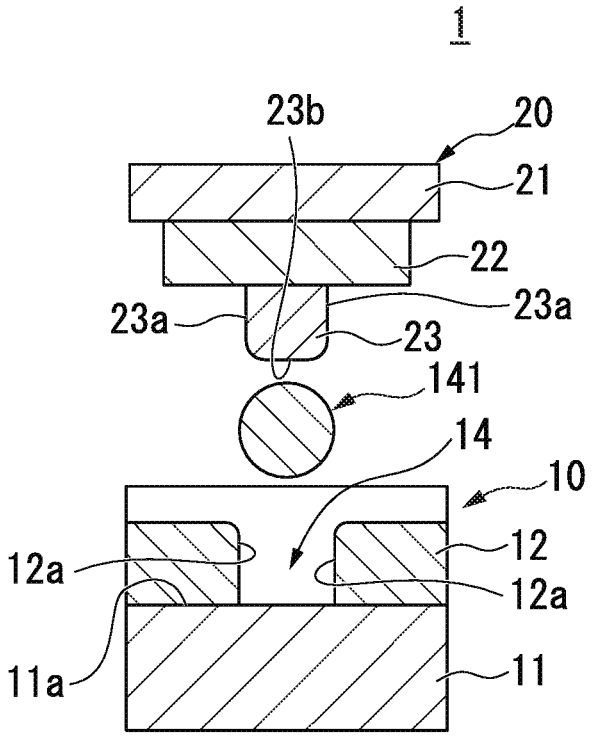
FIG. 16B is a side view showing the device for manufacturing a press-formed product according to the first embodiment of the present invention.

In addition, in the manufacturing device 1, as shown in FIGS. 16A and 16B, an intermediate press-formed product 141 having a bending portion 141*b* and linear portions 141*a* can be used. Moreover, the cross section of the intermediate press-formed product 141 is solid and circular. In this case, by press-forming the intermediate press-formed product 141 using the manufacturing device 1, it is possible to manufacture a press-formed product in which a cross-sectional area increases and the cross section is solid and circular.

Figure 17A:
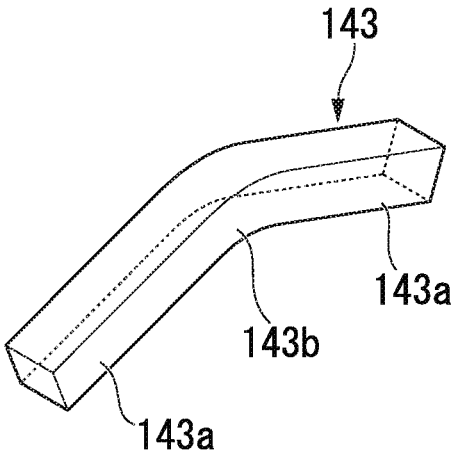
FIG. 17A is a perspective view showing still another modification example of the intermediate press-formed product which is used in the device for manufacturing a press-formed product according to the first embodiment of the present invention.
Figure 17B:
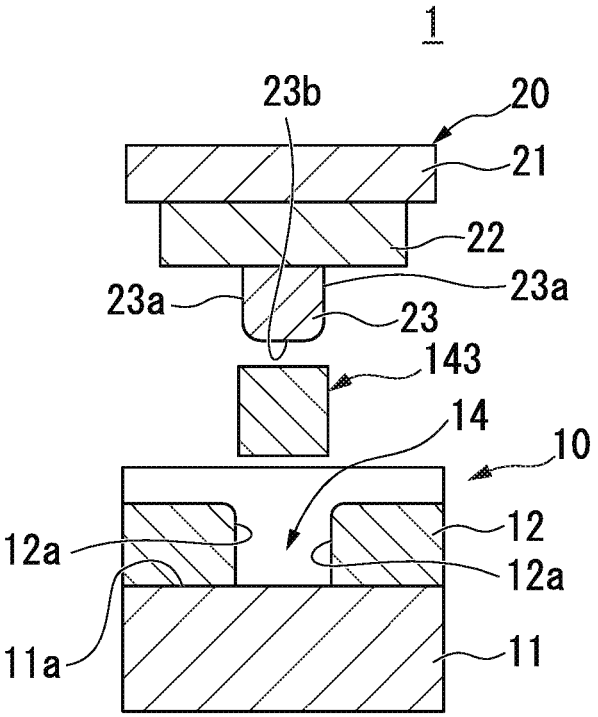
FIG. 17B is a side view showing the device for manufacturing a press-formed product according to the first embodiment of the present invention.

In addition, as shown in FIGS. 17A and 17B, an intermediate press-formed product 143 having a bending portion 143*b* and linear portions 143*a* can be used. In addition, the cross section of the intermediate press-formed product 143 is solid and rectangular. In this case, by press-forming the intermediate press-formed product 143 using the manufacturing device 1, it is possible to manufacture a press-formed product in which a cross-sectional area increases and the cross section is solid and rectangular.

Figure 18A:
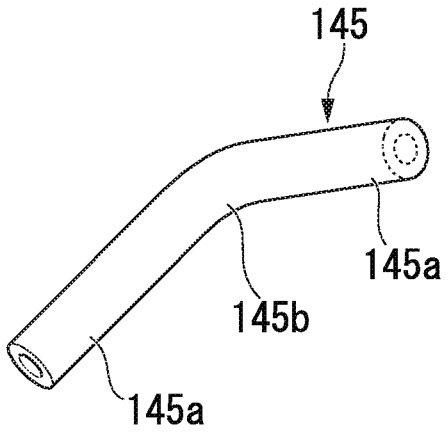
FIG. 18A is a perspective view showing still another modification example of the intermediate press-formed product which is used in the device for manufacturing a press-formed product according to the first embodiment of the present invention.
Figure 18B:
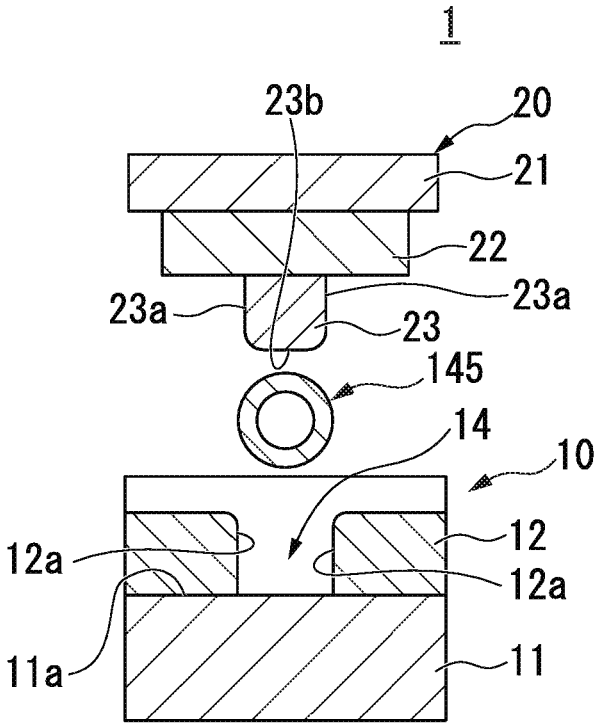
FIG. 18B is a side view showing the device for manufacturing a press-formed product according to the first embodiment of the present invention.

Moreover, as shown in FIGS. 18A and 18B, an intermediate press-formed product 145 having a bending portion

145*b* and linear portions 145*a* can be used. In addition, the cross section of the intermediate press-formed product 145 is hollow and circular. In this case, by press-forming the intermediate press-formed product 145 using the manufacturing device 1, it is possible to manufacture a press-formed product in which a cross-sectional area increases and the cross section is hollow and circular.

Figure 19A:
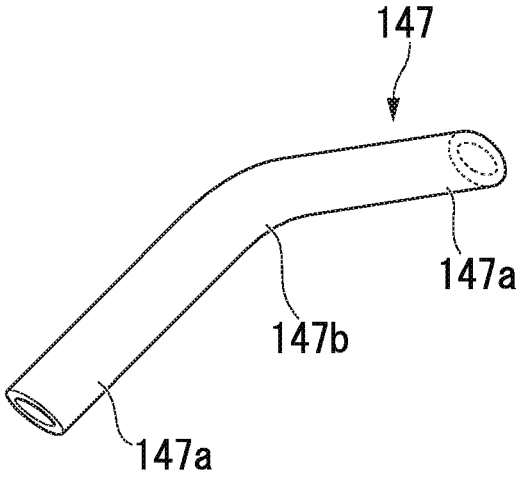
FIG. 19A is a perspective view showing still another modification example of the intermediate press-formed product which is used in the device for manufacturing a press-formed product according to the first embodiment of the present invention.
Figure 19B:
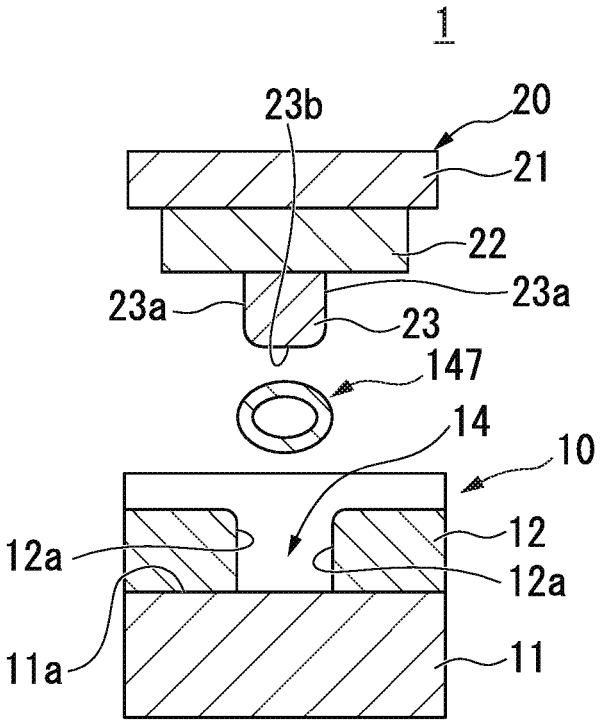
FIG. 19B is a side view showing the device for manufacturing a press-formed product according to the first embodiment of the present invention.

In addition, as shown in FIGS. 19A and 19B, an intermediate press-formed product 147 having a bending portion 147*b* and linear portions 147*a* can be used. In addition, the cross section of the intermediate press-formed product 147 is hollow and elliptical. In this case, by press-forming the intermediate press-formed product 147 using the manufacturing device 1, it is possible to manufacture a press-formed product in which a cross-sectional area increases and the cross section is hollow and elliptical.

Figure 20A:
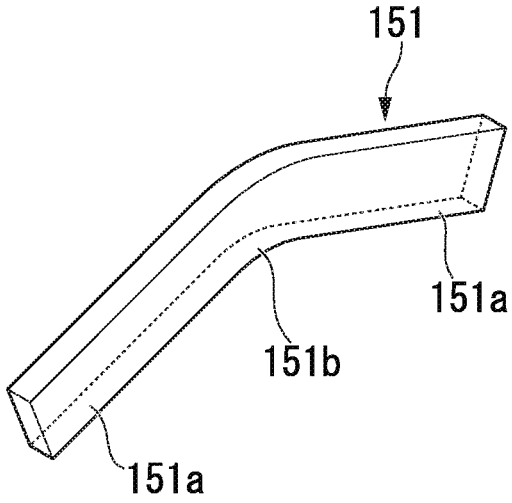
FIG. 20A is a perspective view showing still another modification example of the intermediate press-formed product which is used in the device for manufacturing a press-formed product according to the first embodiment of the present invention.
Figure 20B:
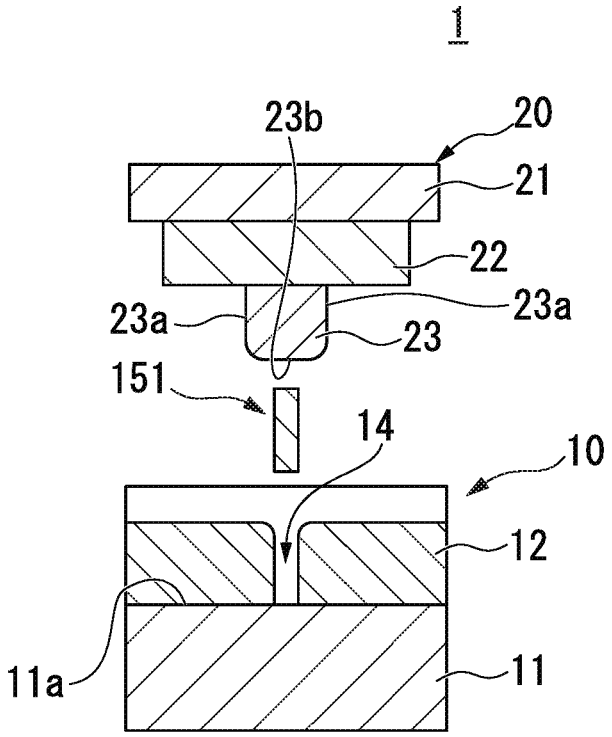
FIG. 20B is a side view showing the device for manufacturing a press-formed product according to the first embodiment of the present invention.

Moreover, as shown in FIGS. 20A and 20B, an intermediate press-formed product 151 having a bending portion 151*b* and linear portions 151*a* can be used. In addition, the cross section of the intermediate press-formed product 151 is solid and rectangular. In surfaces of the bending portion 151*b*, one of two side surfaces perpendicular to the width direction is a surface (extension surface) which is extended by bending, and the other of two side surfaces is a surface (constriction surface) which is constricted by bending. The intermediate press-formed product 151 is disposed in the manufacturing device 1 such that the extension surface of the bending portion 151*b* faces the upper press tool 20. In this case, by press-forming the intermediate press-formed product 151 using the manufacturing device 1, it is possible to manufacture a press-formed product in which a cross-sectional area increases and the cross section is solid and rectangular.

Figure 21A:
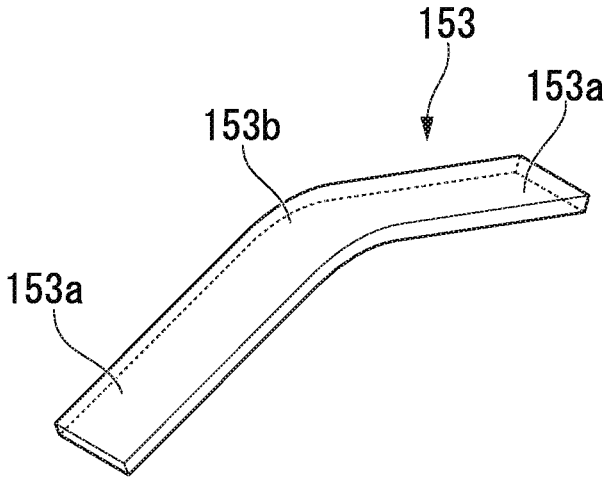
FIG. 21A is a perspective view showing still another modification example of the intermediate press-formed product which is used in the device for manufacturing a press-formed product according to the first embodiment of the present invention.
Figure 21B:
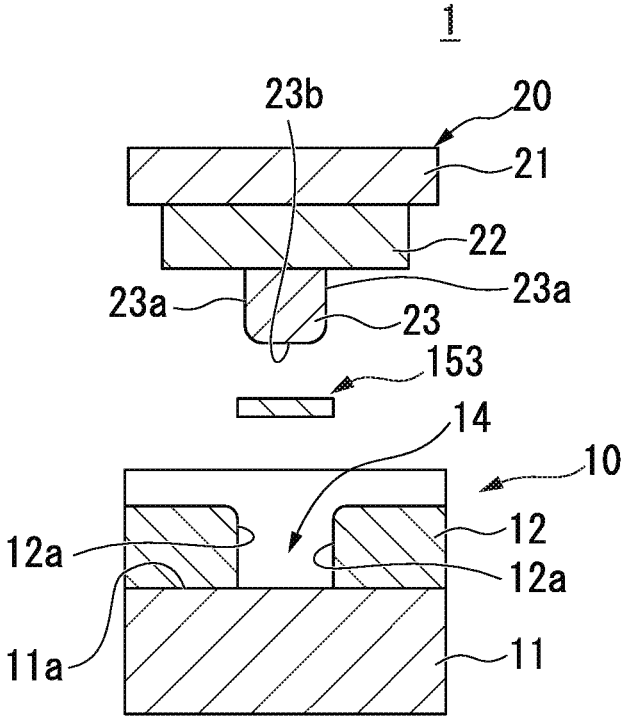
FIG. 21B is a side view showing the device for manufacturing a press-formed product according to the first embodiment of the present invention.

In addition, as shown in FIGS. 21A and 21B, an intermediate press-formed product 153 having a bending portion 153*b* and linear portions 153*a* can be used. In addition, the cross section of the intermediate press-formed product 153 is solid and rectangular. In surfaces of the bending portion 153*b*, one of two side surfaces perpendicular to the width direction is a surface (extension surface) which is extended by bending, and the other of two side surfaces is a surface (constriction surface) which is constricted by bending. The intermediate press-formed product 51 is disposed in the manufacturing device 1 such that the extension surface of the bending portion 153*b* faces the upper press tool 20. In this case, by press-forming the intermediate press-formed product 153 using the manufacturing device 1, it is possible to manufacture a press-formed product in which a cross-sectional area increases and the cross section is solid and rectangular.

Figure 22A:
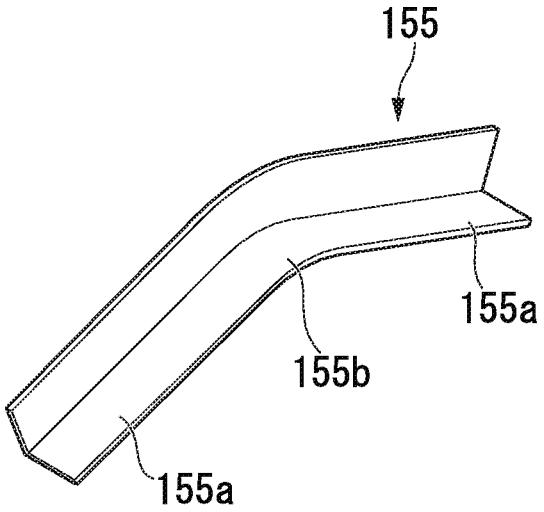
FIG. 22A is a perspective view showing still another modification example of the intermediate press-formed product which is used in the device for manufacturing a press-formed product according to the first embodiment of the present invention.
Figure 22B:
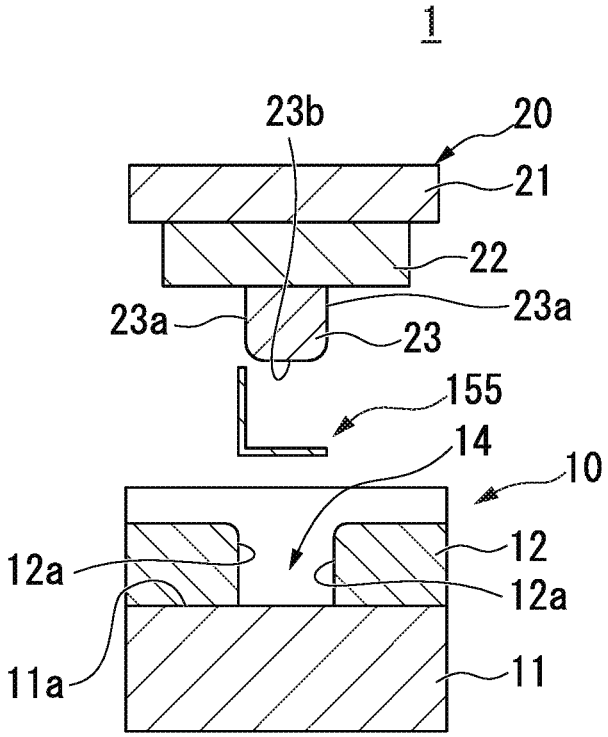
FIG. 22B is a side view showing the device for manufacturing a press-formed product according to the first embodiment of the present invention.

In addition, as shown in FIGS. 22A and 22B, an intermediate press-formed product 155 which includes a bending portion 155*b* and linear portions 155*a* and has an L-shaped cross section can be used. In this case, by press-forming the intermediate press-formed product 155 using the manufacturing device 1, it is possible to manufacture a press-formed product in which a cross-sectional area increases and which has a L-shaped cross section.

Figure 23A:
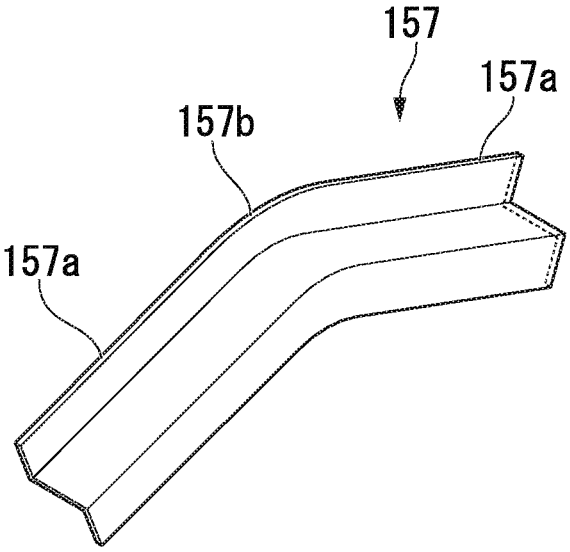
FIG. 23A is a perspective view showing still another modification example of the intermediate press-formed product which is used in the device for manufacturing a press-formed product according to the first embodiment of the present invention.
Figure 23B:
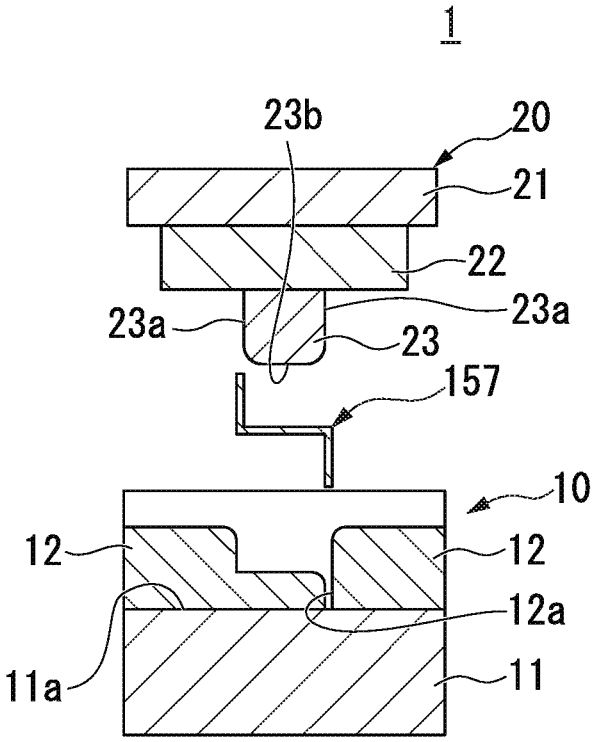
FIG. 23B is a side view showing the device for manufacturing a press-formed product according to the first embodiment of the present invention.

In addition, as shown in FIGS. 23A and 23B, an intermediate press-formed product 157 which includes a bending portion 157*b* and linear portions 157*a* and has a Z-shaped cross section can be used. In this case, by press-forming the intermediate press-formed product 157 using the manufacturing device 1, it is possible to manufacture a press-formed product in which a cross-sectional area increases and which has a Z-shaped cross section. At this time, in order to prevent buckling distortion during press working, as shown in FIG. 23B, preferably, one of the pair of long-side walls 12 of the manufacturing device 1 is formed in an L shape.

Second Embodiment

Next, a second embodiment of the present invention will be described.

Figure 24A:
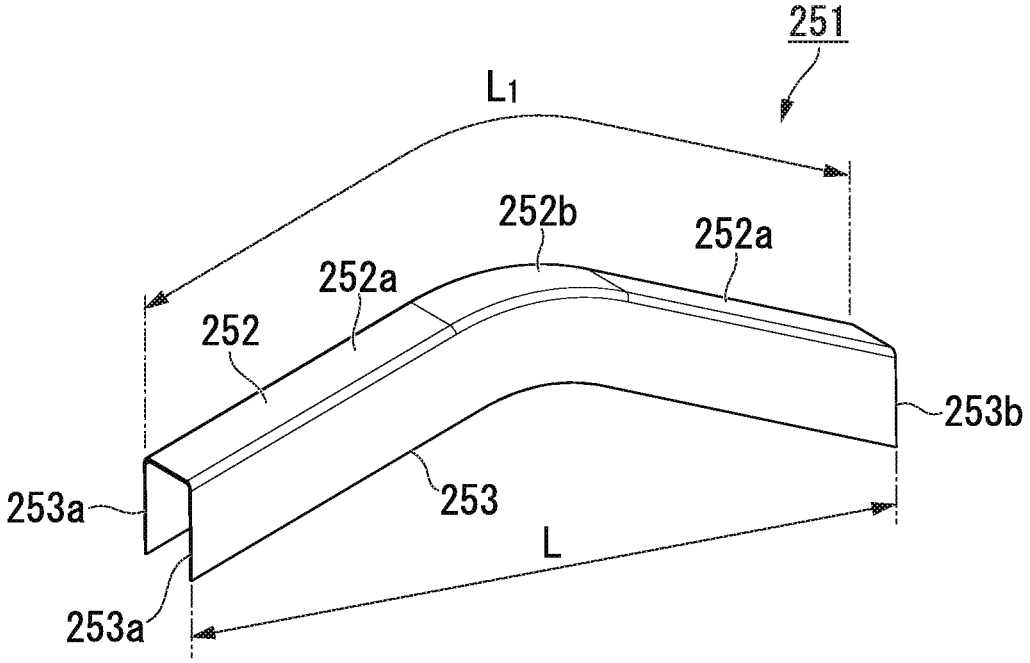
FIG. 24A is a perspective view showing an intermediate press-formed product which is used in a device for manufacturing a press-formed product according to a second embodiment of the present invention.
Figure 24B:
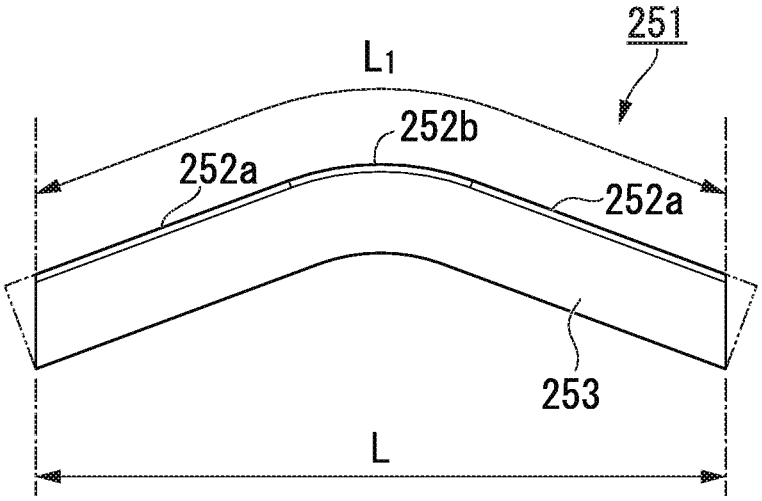
FIG. 24B is a front view showing the intermediate press-formed product.

FIGS. 24A and 24B are views showing an intermediate press-formed product 251 which is used in the second embodiment. In addition, FIG. 24A is a perspective view and FIG. 24B is a front view. As shown in FIGS. 24A and 24B, the intermediate press-formed product 251 is steel (long material) which is long in one direction, and is configured of a web portion 252, and a pair of vertical wall portions 253 which are provided on both sides of the web portion 252 in a width direction. The web portion 252 includes two linear portions 252*a* and a bending portion 252*b* which is provided between the two linear portions 252*a*. The bending portion 252*b* is a portion which is provided on the center portion of the web portion 252 in a longitudinal direction and is curved in an arc shape. In surfaces of the bending portion 252*b*, a surface which is extended by bending is an extension surface, and the other surface (a surface which is constricted by bending) is a constriction surface. The second embodiment is different from the first embodiment in that the pair of vertical wall portions 253 is provided on the constriction surface of the bending portion 252*b*. In addition, a short side 253*a* and a short side 253*b* of each of the vertical wall portions 253 of the intermediate press-formed product 251 are parallel with each other. That is, planes including end edges of both ends of the intermediate press-formed product 251 in the longitudinal direction are parallel with each other.

A steel sheet is press-formed, bending is performed on the steel sheet, and thereafter, the intermediate press-formed product 251 can be obtained by cutting both ends of the vertical wall portions 253 of the intermediate press-formed product 251 in the longitudinal direction. In addition, before the steel sheet is press-formed, template may be performed on the steel sheet in advance.

Figure 25A:
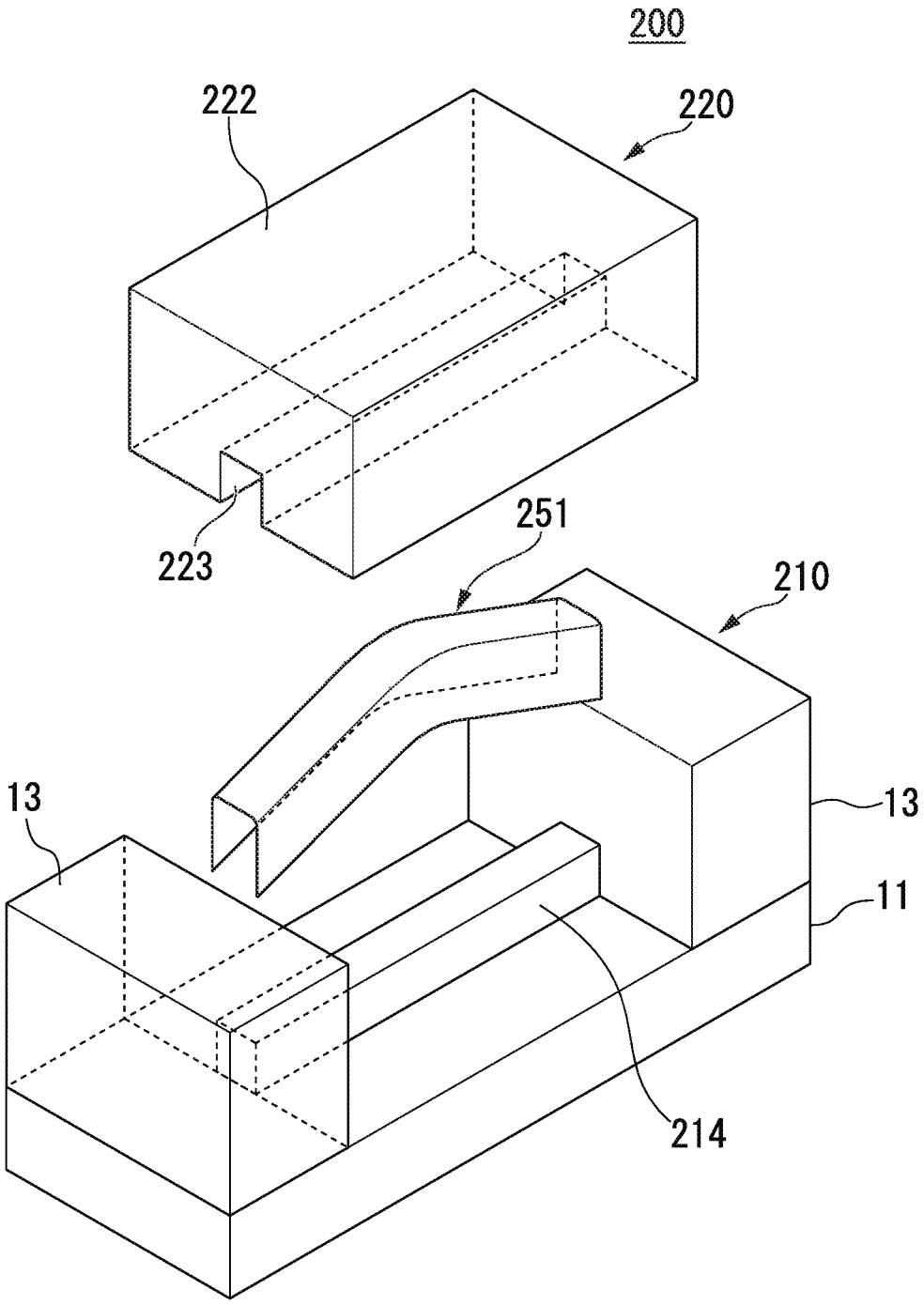
FIG. 25A is a perspective view showing the device for manufacturing a press-formed product according to the second embodiment of the present invention.
Figure 25B:
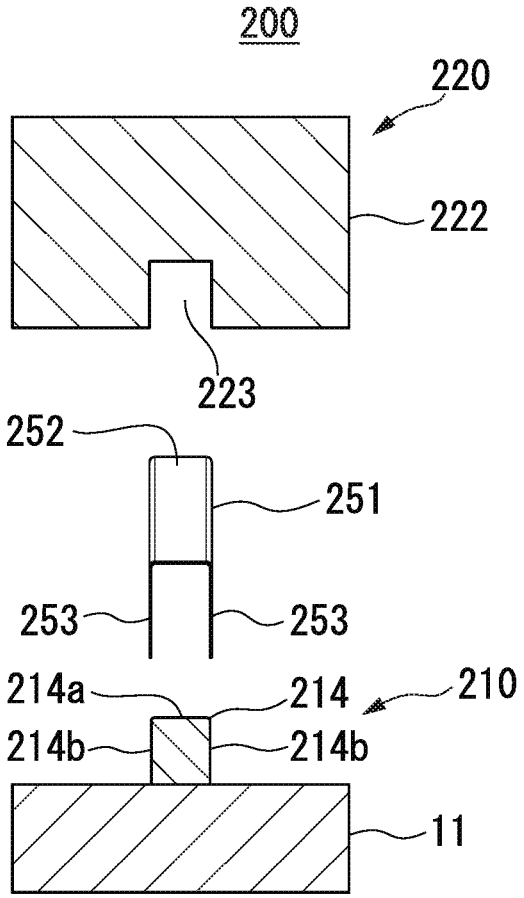
FIG. 25B is a side view showing the device for manufacturing a press-formed product according to the second embodiment of the present invention.

FIGS. 25A and 25B are views showing a device 200 for manufacturing a press-formed product (hereinafter, simply referred to as a manufacturing device 200) according to the second embodiment. In addition, FIG. 25A is a perspective view, and FIG. 25B is a side view. In the manufacturing device 1 according to the first embodiment, the upper press tool 20 includes the punch portion 22 having the convex portion 23, and the lower press tool 10 includes the pair of short-side walls 13 and the pair of long-side walls 12. Meanwhile, in the manufacturing device 200 according to the second embodiment, an upper press tool 220 includes a punch portion 222 which has a concave portion 223, and a lower press tool 210 includes a convex portion 214 which is provided on the base portion 11 instead of the pair of long-side walls 12. In addition, in the manufacturing device 200, the main body portion 21 (refer to FIG. 2) is not shown.

The width of the concave portion 223 of the punch portion 222 of the upper press tool 220 is the same as the entire width of the intermediate press-formed product 251. The length of the concave portion 223 is the same as a distance between the pair of short-side walls 13, and is the same as a distance (shortest distance) between both ends of the intermediate press-formed product 251 in the longitudinal direction. The depth of the concave portion 223 is a width of each of the vertical wall portions 253 of the intermediate press-formed product 251.

The width of the convex portion 214 of the lower press tool 210 is the same as a distance between inner surfaces of the pair of vertical wall portions 253 of the intermediate press-formed product 251. The length of the convex portion 214 is the same as a distance between the pair of short-side walls 13, and is the same as the distance L between both ends of the intermediate press-formed product 251 in the longitudinal direction.

Figure 26:
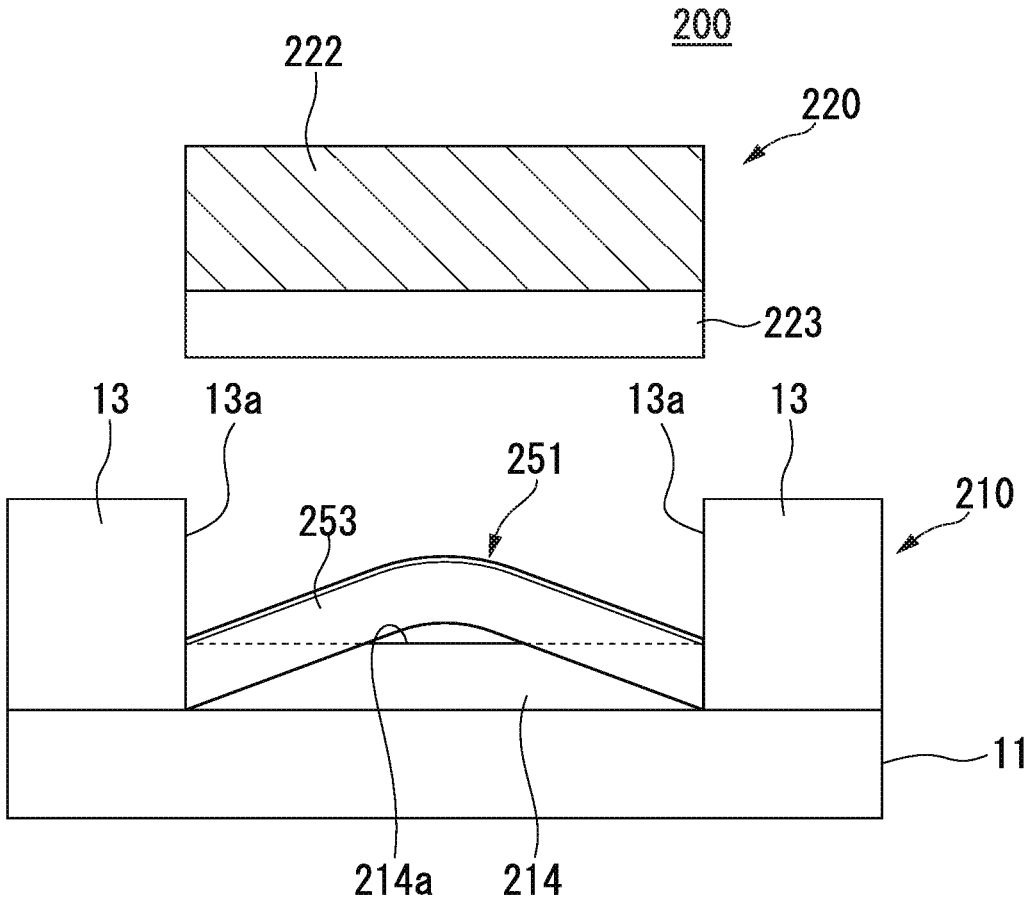
FIG. 26 is a front view showing the device for manufacturing a press-formed product according to the second embodiment of the present invention.

FIG. 26 is a front view showing a state where the intermediate press-formed product 251 is disposed in the manufacturing device 200. In addition, in FIG. 26, the upper press tool 220 is shown in a longitudinal sectional view. As shown in FIG. 26, the intermediate press-formed product 251 is disposed immediately on the convex portion 214 such that the convex portion 214 of the lower press tool 210 is interposed between the pair of vertical wall portions 253 of the intermediate press-formed product 251. At this time, since the distance between the pair of short-side walls 13 is the same as the distance L between both ends of the intermediate press-formed product 251 in the longitudinal direction, both ends of the intermediate press-formed product 251 in the longitudinal direction are restricted. In addition, as described above, since both ends of the intermediate press-formed product 251 in the longitudinal direction are parallel with each other, the intermediate press-formed product 251 can be disposed such that both ends of the intermediate press-formed product 251 in the longitudinal direction are parallel with the pair of short-side walls 13. Accordingly, it is possible to equally apply a load to the intermediate press-formed product 251 when the intermediate press-formed product 251 is press-formed, and as a result, it is possible to prevent buckling distortion of the intermediate press-formed product 251.

Figure 27A:
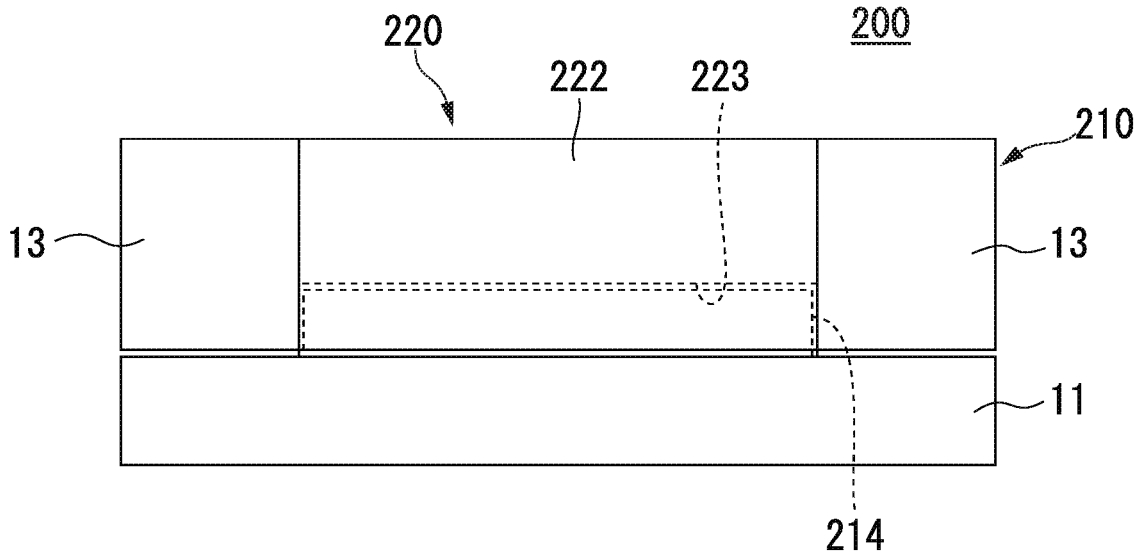
FIG. 27A is a front view showing the device for manufacturing a press-formed product according to the second embodiment of the present invention, and is a view showing a state where an upper press tool is lowered to a bottom dead center.
Figure 27B:
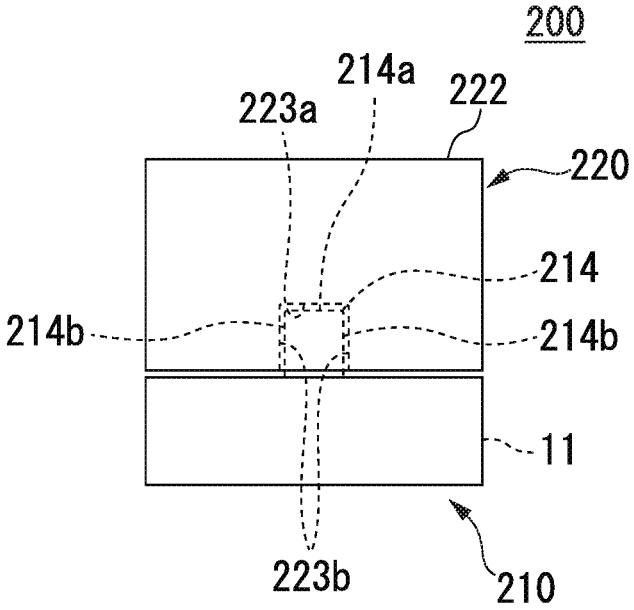
FIG. 27B is a side view showing the device for manufacturing a press-formed product according to the second embodiment of the present invention, and is a view showing a state where the upper press tool is lowered to the bottom dead center.
Figure 28A:
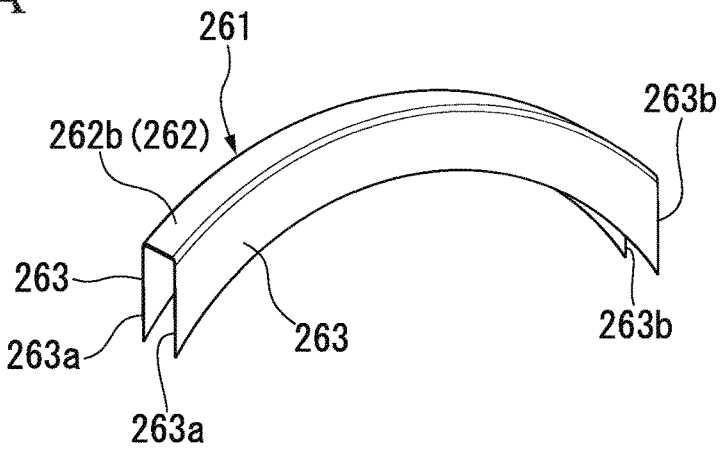
FIG. 28A is a perspective view showing a modification example of the intermediate press-formed product which is used in the device for manufacturing a press-formed product according to the second embodiment of the present invention.
Figure 28B:
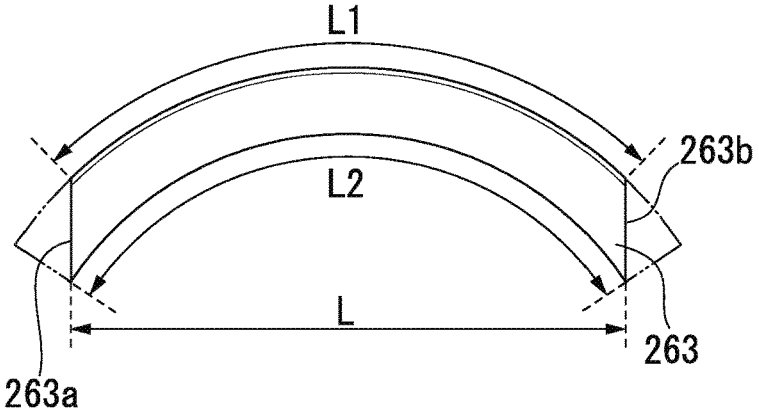
FIG. 28B is a front view showing the intermediate press-formed product.
Figure 28C:
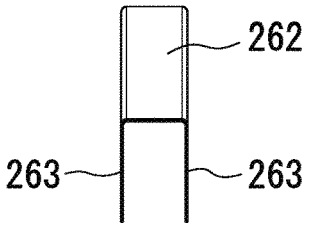
FIG. 28C is a side view showing the intermediate press-formed product.
Figure 28D:
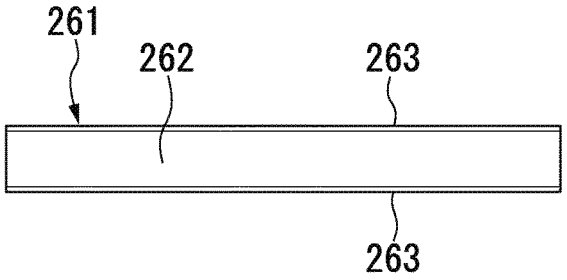
FIG. 28D is a plan view showing the intermediate press-formed product.

FIGS. 27A and 27B are views showing a state where the upper press tool 220 is lowered to the bottom dead center. In addition, FIG. 27A is a front view, and FIG. 27B is a side view. Similarly to the case of the first embodiment, by lowering the upper press tool 220, the curvature of the bending portion 252*b* of the intermediate press-formed product 251 decreases while both ends of the intermediate press-formed product 251 in the longitudinal direction are restricted. As a result, it is possible to compress the intermediate press-formed product 251 in the longitudinal direction, and the thicknesses of the web portion 252 and the vertical wall portions 253 of the intermediate press-formed product 251 increase.

In the present embodiment, as shown in FIG. 27B, press forming is performed such that the curvature of the bending portion 252*b* of the intermediate press-formed product 251 decrease while the intermediate press-formed product 251 is interposed between the concave portion 223 of the upper press tool 220 and the convex portion 214 of the lower press tool 210. Accordingly, when compressive stress is applied to the intermediate press-formed product 251 in the longitudinal direction, since the web portion 252 of the intermediate press-formed product 251 is interposed between a bottom surface 223*a* of the concave portion 223 of the upper press tool 220 and an upper surface 214*a* of the convex portion 214 of the lower press tool 210, it is possible to prevent buckling distortion of the web portion 252. Similarly, since the vertical wall portions 253 of the intermediate press-formed product 251 are interposed between side surfaces 223*b* of the concave portion 223 of the upper press tool 220 and side surfaces 214*b* of the convex portion 214 of the lower press tool 210, it is possible to prevent buckling distortion of the vertical wall portions 253.

In addition, in the manufacturing device 200, an intermediate press-formed product 261 shown in FIGS. 28A to 28D can be used. As shown in FIGS. 28A to 28D, the intermediate press-formed product 261 includes a web portion 262 and a pair of vertical wall portions 263. Here, the web portion 262 of the intermediate press-formed product 261 is configured of a bending portion 262*b*, and the entire web portion 262 has a curved shape. In addition, similarly to the intermediate press-formed product 251, short sides 263*a* and 263*b* of the vertical wall portions 263 of the intermediate press-formed product 261 are parallel with each other.

Figure 29:
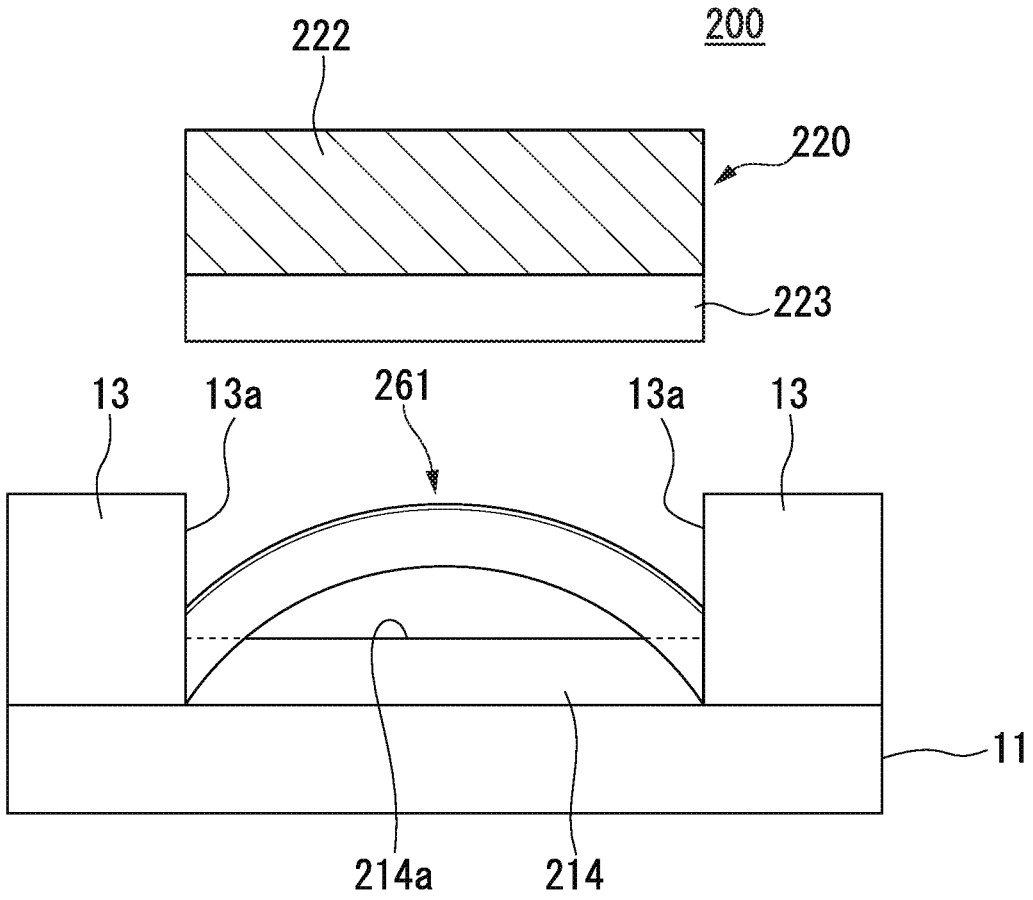
FIG. 29 is a front view showing the device for manufacturing a press-formed product according to the second embodiment of the present invention.

FIG. 29 is a view showing a state where the intermediate press-formed product 261 is disposed in the manufacturing device 200. Similarly to the intermediate press 251, the intermediate press-formed product 261 is compressed by lowering the upper press tool 220 in the longitudinal direction, and the thicknesses of the web portion 262 and the vertical wall portions 263 increase.

Third Embodiment

Next, a third embodiment of the present invention will be described.

Figure 30A:
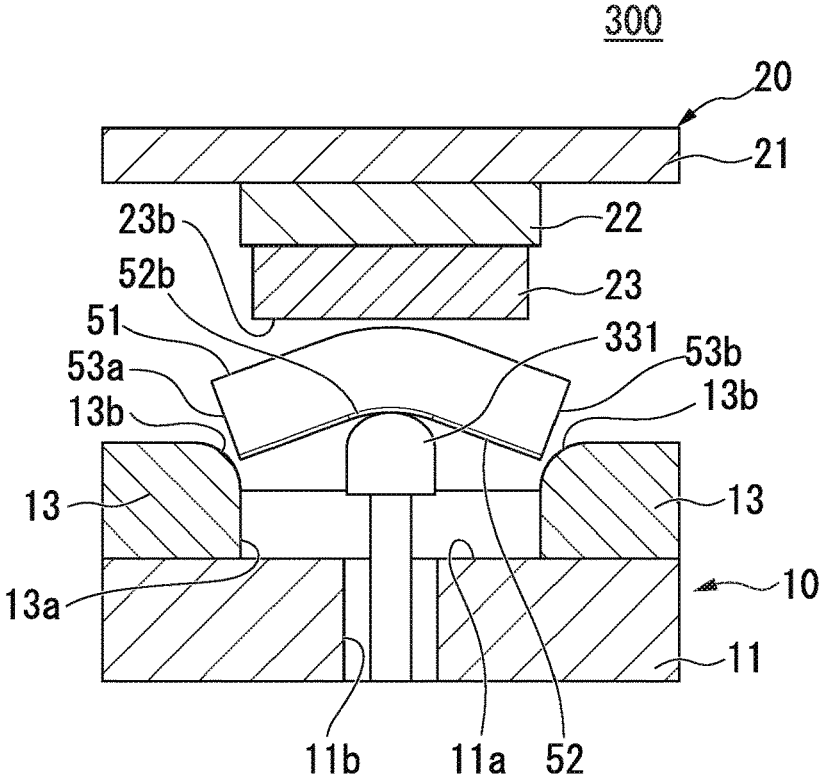
FIG. 30A is a front view showing a device for manufacturing a press-formed product according to a third embodiment of the present invention.
Figure 30B:
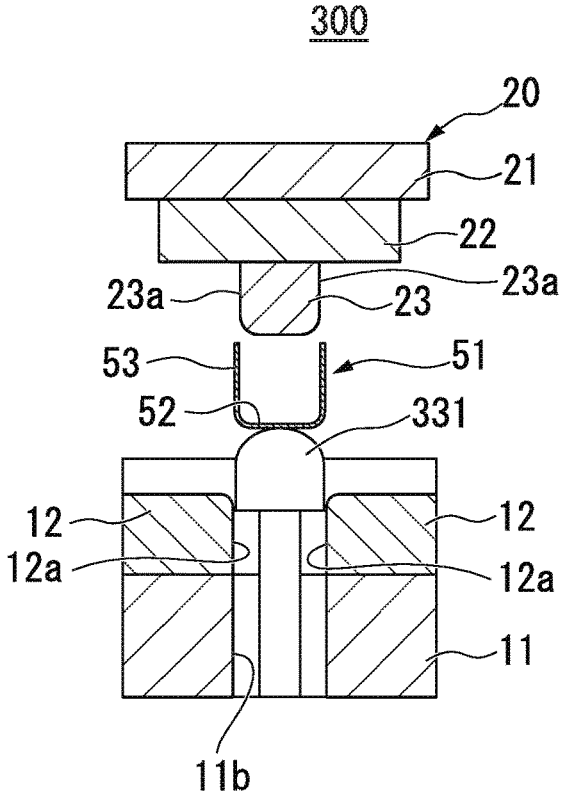
FIG. 30B is a side view showing the device for manufacturing a press-formed product according to the third embodiment of the present invention.

FIGS. 30A and 30B are views showing a device 300 for manufacturing a press-formed product (hereinafter, simply referred to as a manufacturing device 300) according to the third embodiment. The manufacturing device 300 according to the present embodiment is different from the manufacturing device 1 according to the first embodiment in that a blank holder pad 331 (blank holder tool) is provided.

As shown in FIGS. 30A and 30B, the blank holder pad 331 is inserted into a through hole 11*b* which is provided in the base portion 11 of the lower press tool 10. The blank holder pad 331 can be freely lifted and lowered in accordance with the movements of the upper press tool 20 and the lower press tool 10, and can be accommodated in the through hole 11*b*.

Figure 32A:
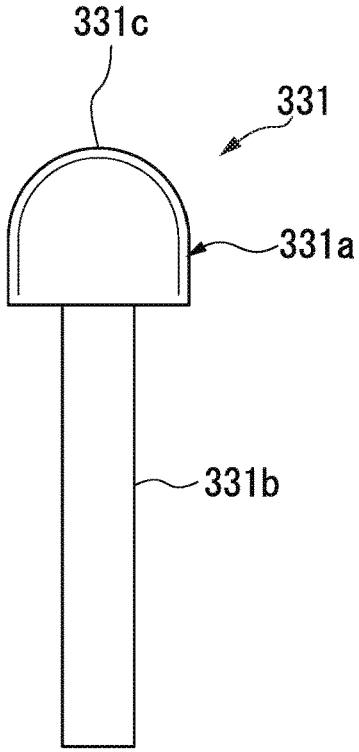
FIG. 32A is a front view showing a blank holder pad.
Figure 32B:
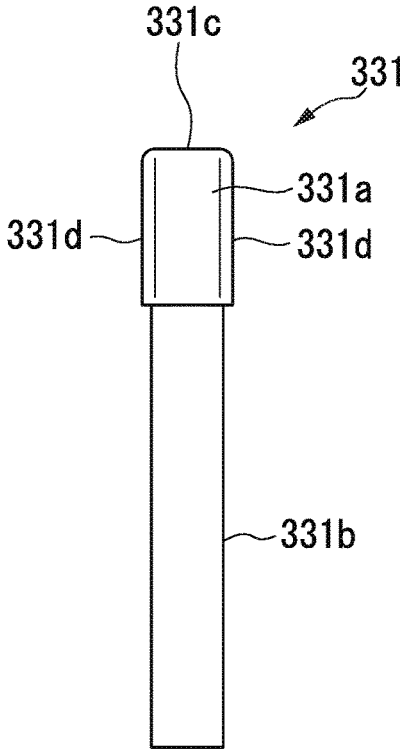
FIG. 32B is a side view showing the blank holder pad.
Figure 32C:
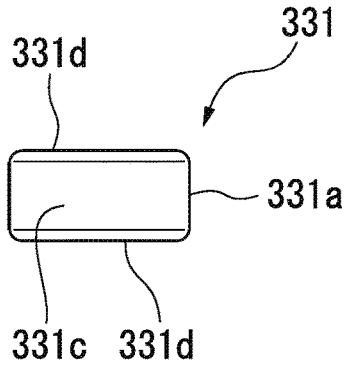
FIG. 32C is a plan view showing the blank holder pad.

FIGS. 32A to 32C are views showing the blank holder pad 331. As shown in FIGS. 32A to 32C, the blank holder pad 331 is configured of a main body portion 331*a* and a shaft portion 331*b* which is connected to the main body portion 331*a*. The shaft portion 331*b* is inserted into the through hole 11*b* which is provided in the lower press tool 10.

The main body portion 331*a* of the blank holder pad 331 includes an upper surface 331*c* and side surfaces 331*d*. The upper surface 331*c* is a convex surface which is provided on the apex portion of the main body portion 331*a* and comes into contact with the bending portion 52*b* of the web portion 52 of the intermediate press-formed product 51. Each of the side surfaces 331*d* is a flat surface which is a side portion of the main body portion 331*a*. In addition, the upper surface 331*c* has a curvature which is smaller than the curvature of the bending portion 52*b* (refer to FIG. 1B) of the intermediate press-formed product 51. Accordingly, it is possible to prevent buckling of the web portion 52 of the intermediate press-formed product 51.

Figure 31A:
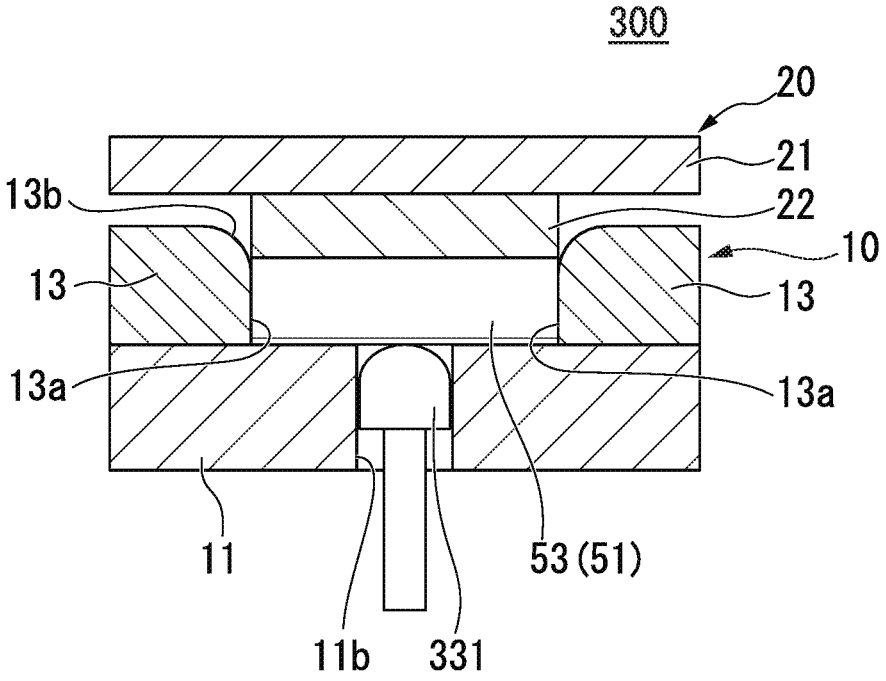
FIG. 31A is a front view showing the device for manufacturing a press-formed product according to the third embodiment of the present invention, and is a view showing a state where an upper press tool is lowered to a bottom dead center.
Figure 31B:
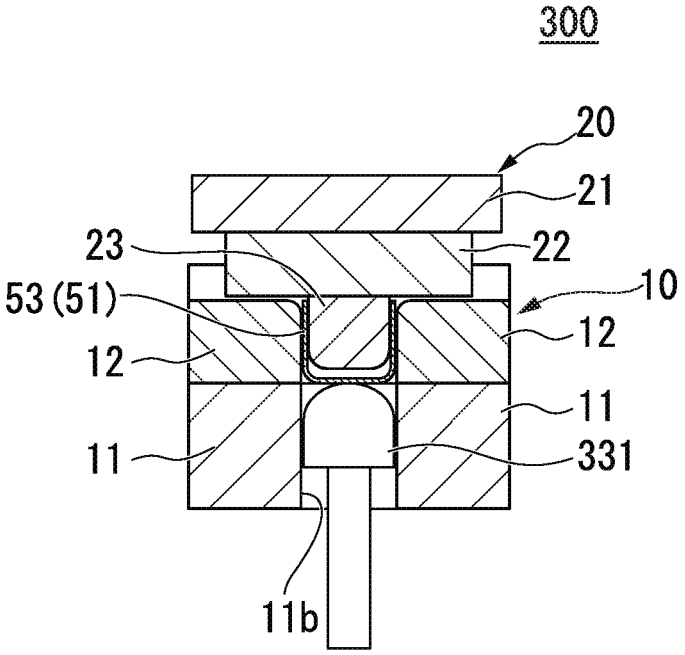
FIG. 31B is a side view showing the device for manufacturing a press-formed product according to the third embodiment of the present invention, and is a view showing a state where the upper press tool is lowered to the bottom dead center.

As shown in FIGS. 30A and 30B, when the intermediate press-formed product 51 is press-formed using the manufacturing device 300, after both ends of the intermediate press-formed product 51 come into contact with the convex surfaces 13*b* of the lower press tool 10, the blank holder pad 331 is lifted toward the intermediate press-formed product 51, and the blank holder pad 331 comes into contact with the bending portion 52*b* of the web portion 52 of the intermediate press-formed product 51. At this time, the blank holder pad 331 comes into contact with the concave side (constriction surface) of the bending portion 52*b* of the intermediate press-formed product 51. Thereafter, the upper press tool 20 lowers, and the convex portion 23 of the upper press tool 20 comes into contact with the convex side (extension surface)

of the bending portion 52*b* of the web portion 52 of the intermediate press-formed product 51. In addition, by further lowering the upper press tool 20, as shown in FIGS. 31A and 31B, the intermediate press-formed product 51 is compressed in the longitudinal direction while the web portion 52 of the intermediate press-formed product 51 is held by the blank holder pad 331 and the upper press tool 20. Moreover, as described above, since the blank holder pad 331 can be freely lifted and lowered, the blank holder pad 331 is lowered while being pressed by the upper press tool 20. Since the blank holder pad 331 is lowered while being pressed by the upper press tool 20 in the state where the blank holder pad 331 comes into contact with the web portion 52 of the intermediate press-formed product 51, it is possible to prevent buckling distortion of the web portion 52 of the intermediate press-formed product 51.

Figure 33A:
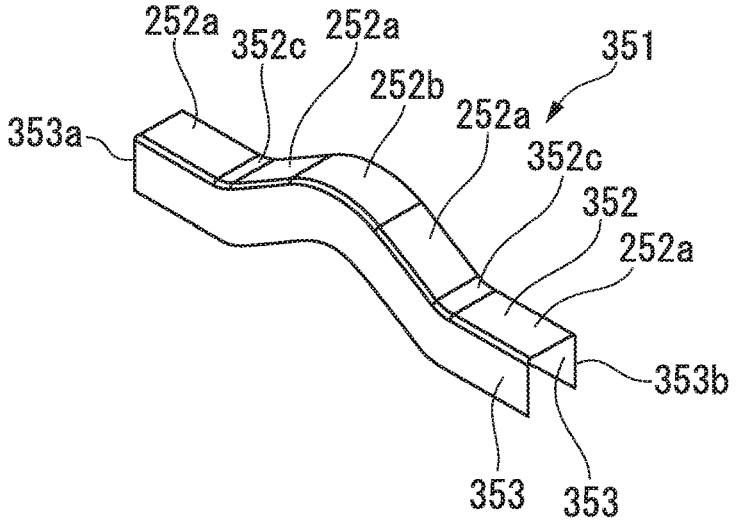
FIG. 33A is a perspective view showing a modification example of the intermediate press-formed product which is used in the device for manufacturing a press-formed product according to the third embodiment of the present invention.
Figure 33B:
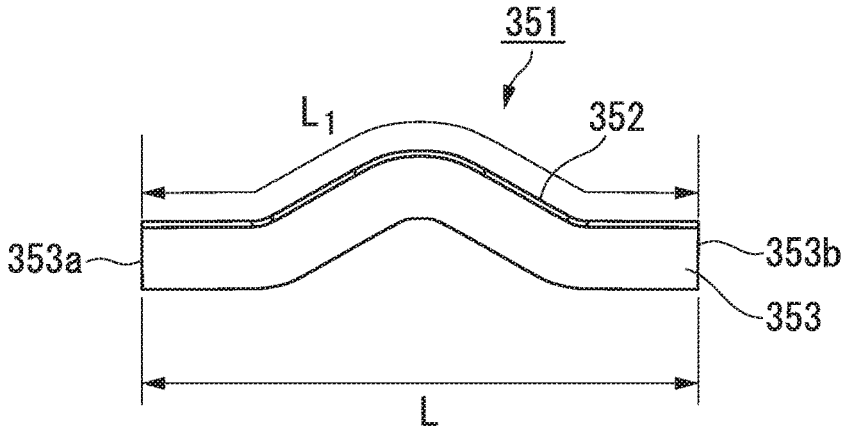
FIG. 33B is a front view showing the intermediate press-formed product.
Figure 33C:
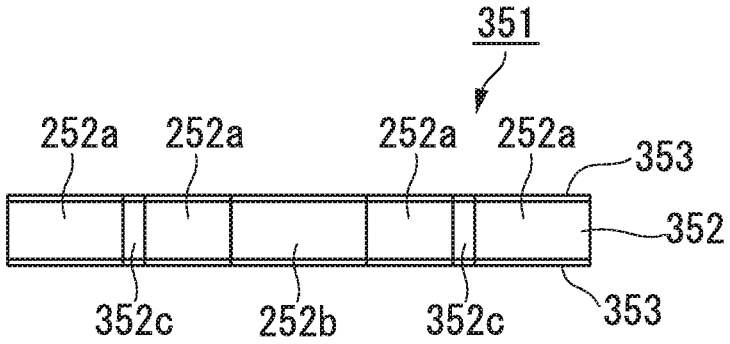
FIG. 33C is a plan view showing the intermediate press-formed product.

In addition, in the manufacturing device 300, instead of the intermediate press-formed product 51, an intermediate press-formed product 351 shown in FIGS. 33A to 33C can be used. As shown in FIGS. 33A to 33C, the intermediate press-formed product 351 includes a web portion 352, and a pair of vertical wall portions 353 which is connected to both sides of the web portion 352 in the width direction. In addition, the intermediate press-formed product 351 is different from the intermediate press-formed product 251 (refer to FIGS. 24A and 24B) in that four linear portions 252*a*, one bending portion 252*b*, and two bending portions 352*c* are provided. Moreover, each of the bending portions 352*c* of the intermediate press-formed product 351 protrudes in a direction opposite to the direction in which the bending portion 252*b* protrudes.

Figure 34A:
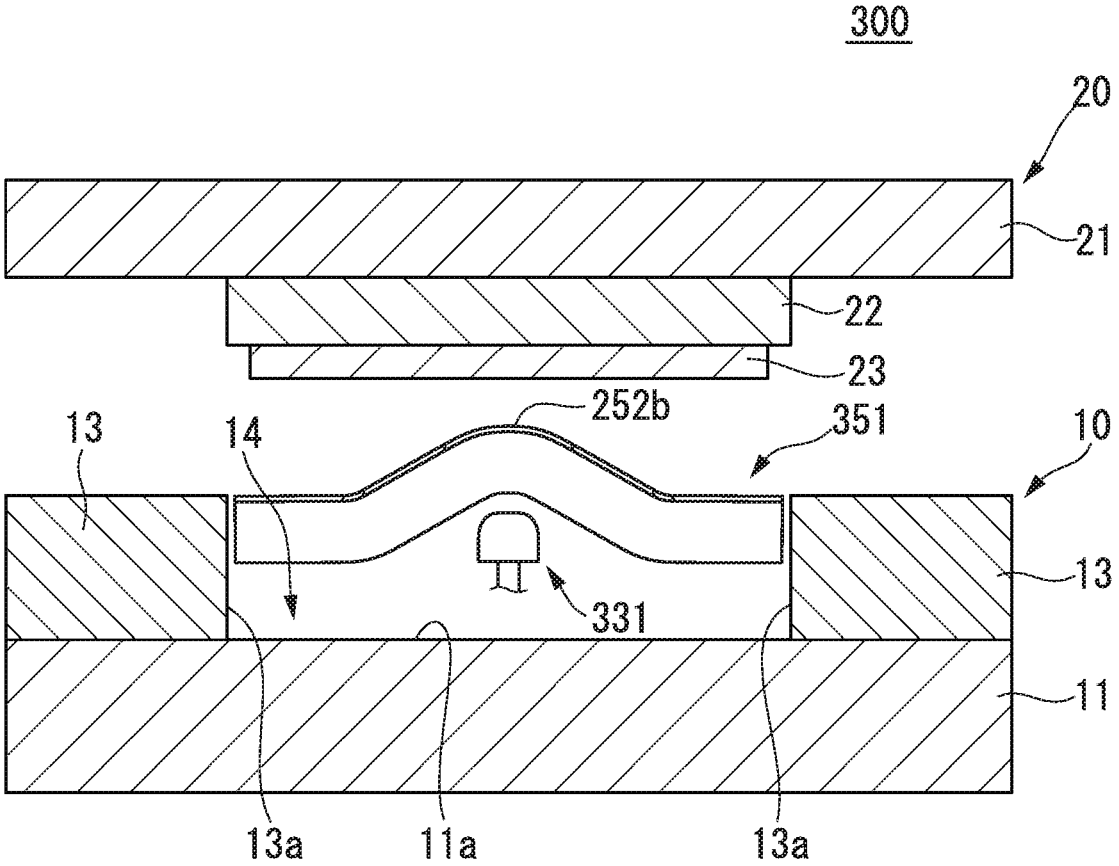
FIG. 34A is a front view showing the device for manufacturing a press-formed product according to the third embodiment of the present invention.
Figure 34B:
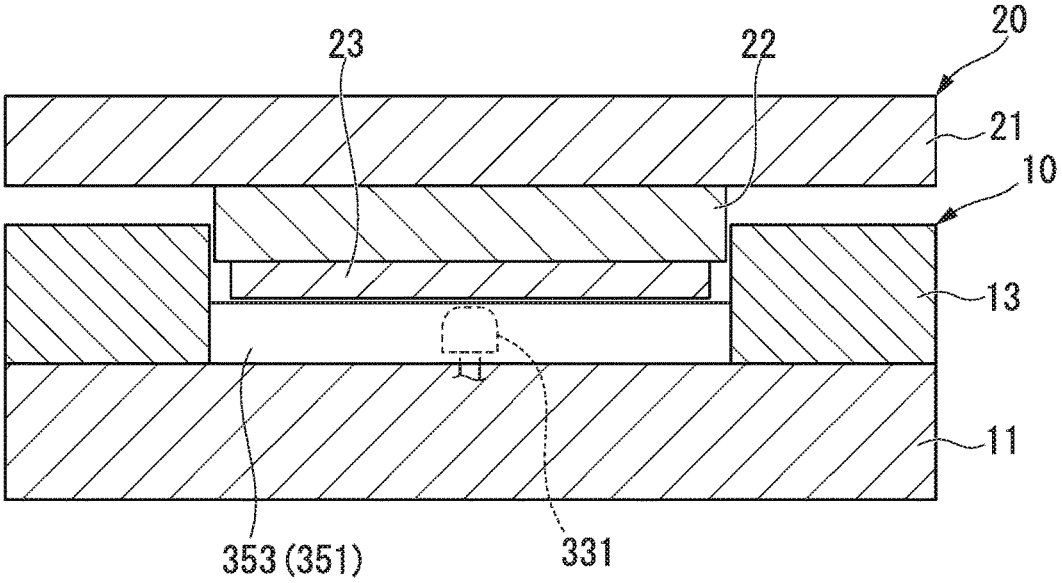
FIG. 34B is a front view showing the device for manufacturing a press-formed product according to the third embodiment of the present invention, and is a view showing a state where the upper press tool is lowered to the bottom dead center.

FIG. 34A is a view showing a state where the intermediate press-formed product 351 is disposed in the manufacturing device 300. In addition, FIG. 34B is a view showing a state where the upper press tool 20 of the manufacturing device 300 is lowered to the bottom dead center. Similarly to the case where the intermediate press-formed product 51 is press-formed using the manufacturing device 300, by lowering the upper press tool 20, it is possible to compress the intermediate press-formed product 351 in the longitudinal direction. At this time, the upper surface 331*c* of the blank holder pad 331 comes into contact with the bending portion 252*b* of the web portion 352 of the intermediate press-formed product 351, and the side surfaces 331*d* come into contact with the inner surfaces of the vertical wall portions 353 of the intermediate press-formed product 351. Accordingly, it is possible to prevent buckling distortion of the intermediate press-formed product 351.

Figure 35A:
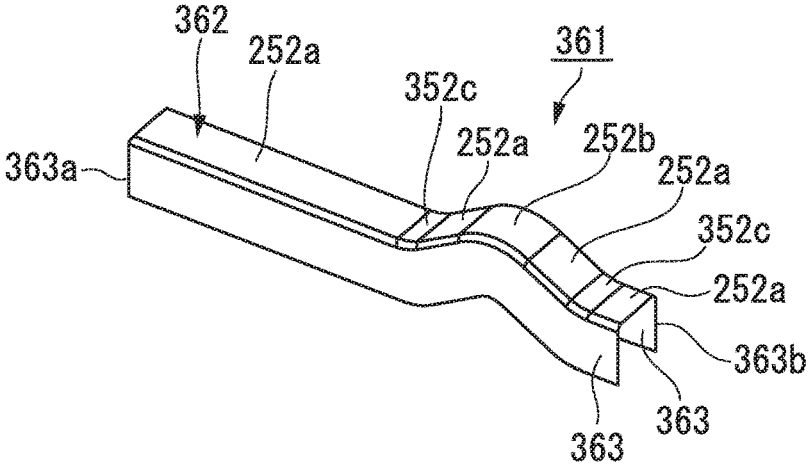
FIG. 35A is a perspective view showing another modification example of the intermediate press-formed product which is used in the device for manufacturing a press-formed product according to the third embodiment of the present invention.
Figure 35B:
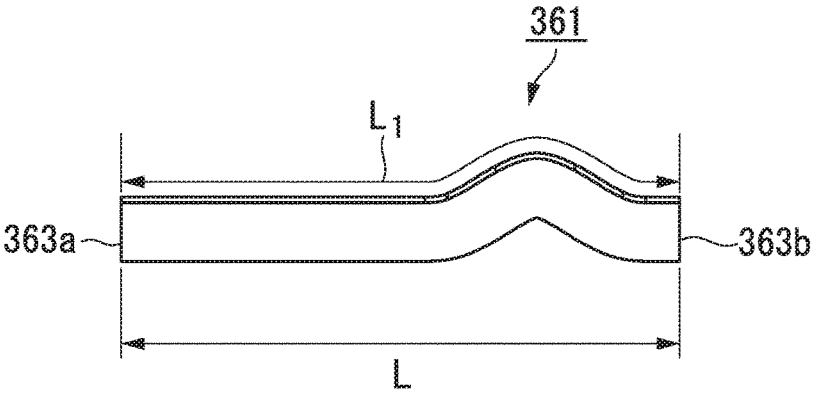
FIG. 35B is a front view showing the intermediate press-formed product.
Figure 35C:
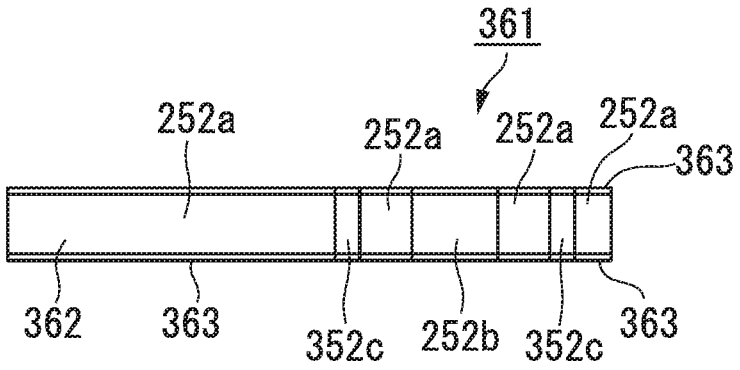
FIG. 35C is a plan view showing the intermediate press-formed product.

Moreover, in the manufacturing device 300, an intermediate press-formed product 361 shown in FIGS. 35A to 35C can be used. The intermediate press-formed product 361 includes a web portion 362 and a pair of vertical wall portions 363 which is connected to both sides of the web portion 362 in the width direction. In addition, in the intermediate press-formed product 361, the bending portion 252*b* of the intermediate press-formed product 351 is positioned to be biased toward one end side. That is, the intermediate press-formed product 361 is different from the intermediate press-formed product 351 shown in FIGS. 33A to 33C with respect to the position of the bending portion 252*b*.

Figure 36:
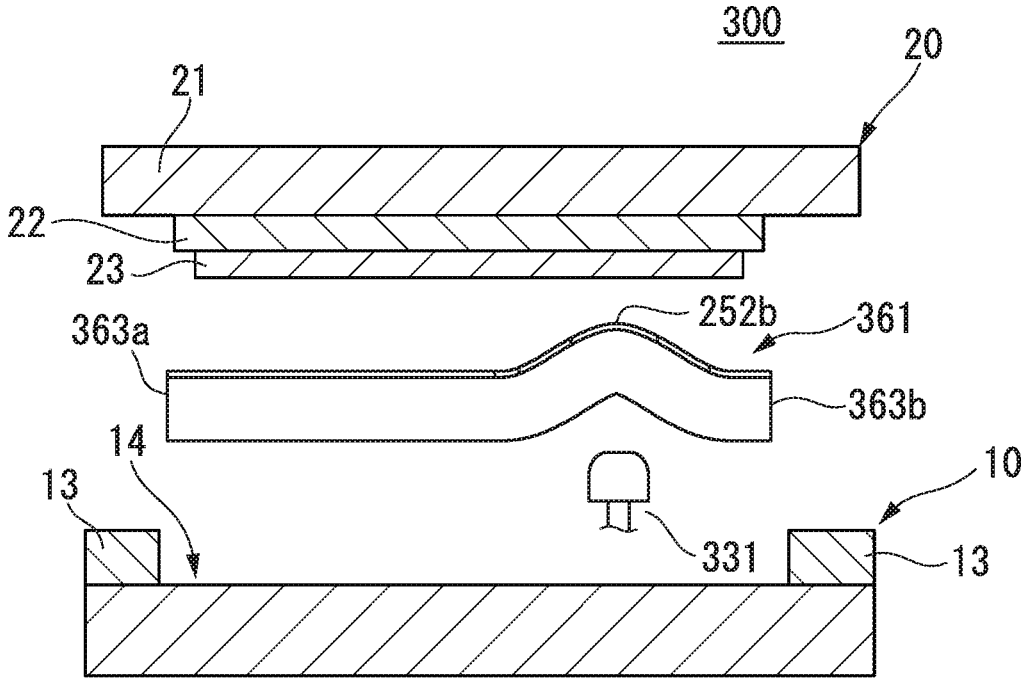
FIG. 36 is a front view showing the device for manufacturing a press-formed product according to the third embodiment of the present invention.

FIG. 36 is a view showing the intermediate press-formed product 361 and the manufacturing device 300. When the intermediate press-formed product 361 is press-formed, the blank holder pad 331 is disposed such that the upper surface 331*c* of the blank holder pad 331 comes into contact with the bending portion 252*b* of the intermediate press-formed product 361. In this way, by disposing the blank holder pad 331, similarly to the intermediate press-formed product 351, it is possible to prevent buckling distortion of the intermediate press-formed product 361.

Fourth Embodiment

Next, a fourth embodiment of the present invention will be described.

Figure 37A:
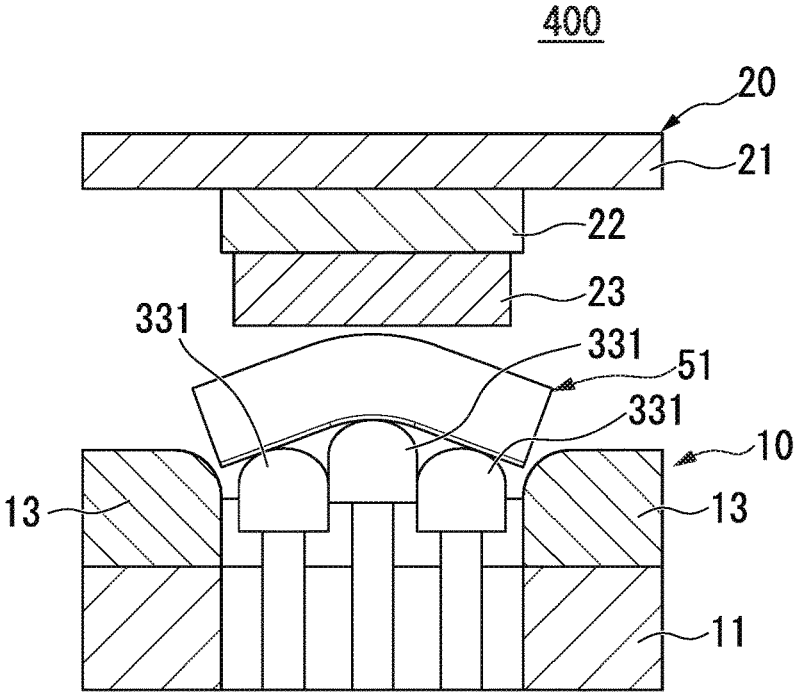
FIG. 37A is a front view showing a device for manufacturing a press-formed product according to a fourth embodiment of the present invention.
Figure 37B:
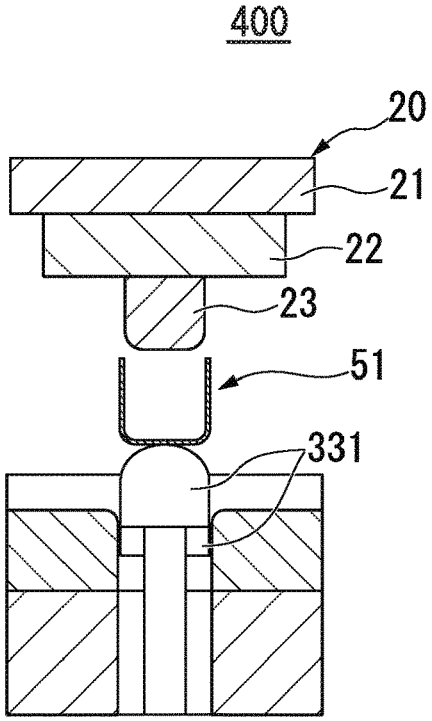
FIG. 37B is a side view showing the device for manufacturing a press-formed product according to the fourth embodiment of the present invention.

FIGS. 37A and 37B are views showing a device 400 for manufacturing a press-formed product (hereinafter, referred to as a manufacturing device 400) according to the fourth embodiment. The third embodiment shows the case where the manufacturing device 300 includes one blank holder pad 331. Meanwhile, as shown in FIGS. 37A and 37B, the manufacturing device 400 according to the present embodiment includes three blank holder pads 331.

Figure 38:
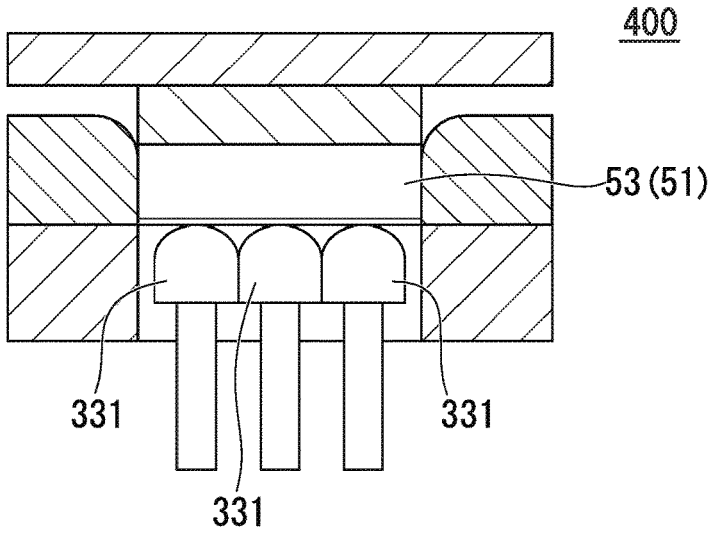
FIG. 38 is a front view showing the device for manufacturing a press-formed product according to the fourth embodiment of the present invention, and is a view showing a state where an upper press tool is lowered to a bottom dead center.

FIG. 38 is a view showing a state where the intermediate press-formed product 51 is press-formed using the manufacturing device 400. As described above, since the manufacturing device 400 includes three blank holder pads 331, it is possible to more reliably prevent buckle of the web portion 52 and the vertical wall portions 53 of the intermediate press-formed product 51. In addition, the number of the blank holder pads 331 may be two, or four or more.

Figure 39A:
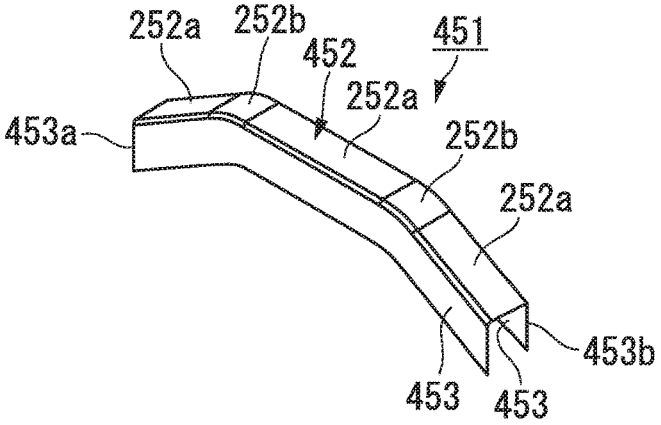
FIG. 39A is a perspective view showing still another modification example of the intermediate press-formed product which is used in the device for manufacturing a press-formed product according to the fourth embodiment of the present invention.
Figure 39B:
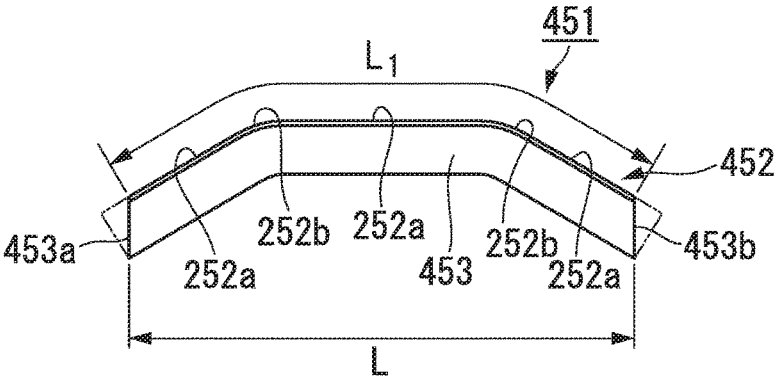
FIG. 39B is a front view showing the intermediate press-formed product.
Figure 39C:
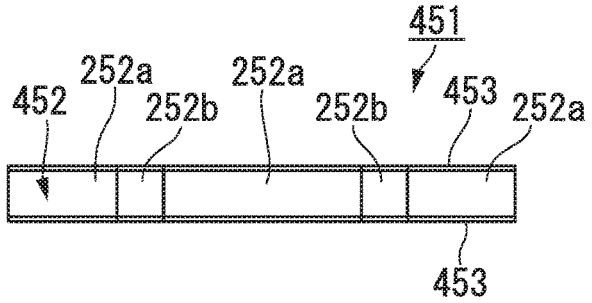
FIG. 39C is a plan view showing the intermediate press-formed product.

In addition, in the manufacturing device 400, an intermediate press-formed product 451 shown in FIGS. 39A to 39C can be used. The intermediate press-formed product 451 includes a web portion 452 and a pair of vertical wall portions 453 which is connected to both sides of the web portion 452 in the width direction. In addition, the intermediate press-formed product 451 is different from the intermediate press-formed product 251 (refer to FIGS. 24A and 24B) in that three linear portions 252*a* and two bending portions 252*b* are provided.

Figure 40A:
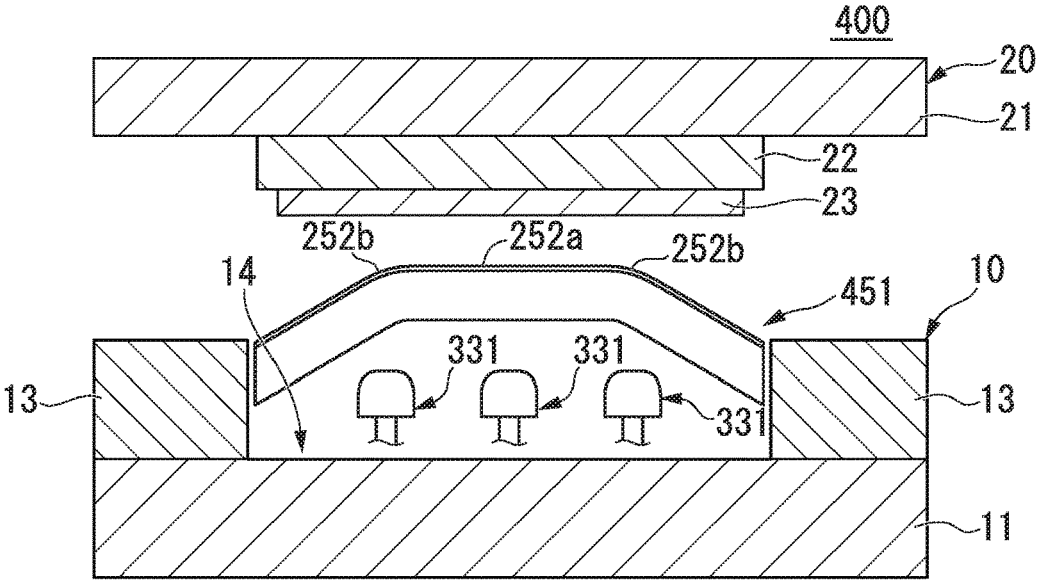
FIG. 40A is a front view showing the device for manufacturing a press-formed product according to the fourth embodiment of the present invention.
Figure 40B:
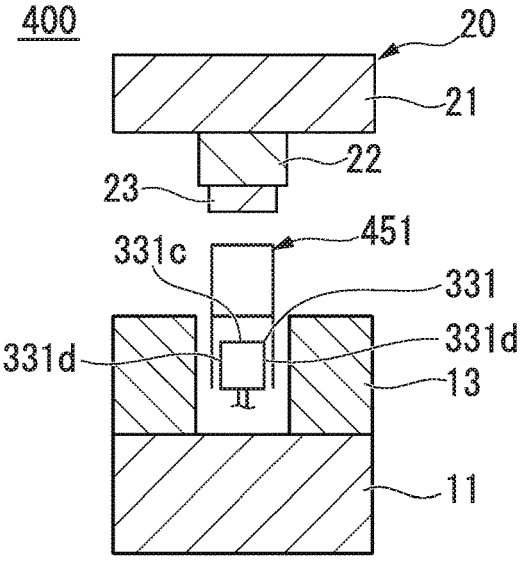
FIG. 40B is a side view showing the device for manufacturing a press-formed product according to the fourth embodiment of the present invention.

FIGS. 40A and 40B are view showing a state where the intermediate press-formed product 451 is disposed in the manufacturing device 400. As shown in FIGS. 40A and 40B, when the intermediate press-formed product 451 is press-formed, the blank holder pads 331 are disposed such that the upper surfaces 331*c* of the blank holder pads 331 come into contact with the bending portions 252*b* of the intermediate press-formed product 451. That is, two among three blank holder pads 331 are disposed so as to come into contact with the bending portions 252*b*, and the remaining one is disposed so as to come into contact with the linear portion 252*a*.

Figure 41:
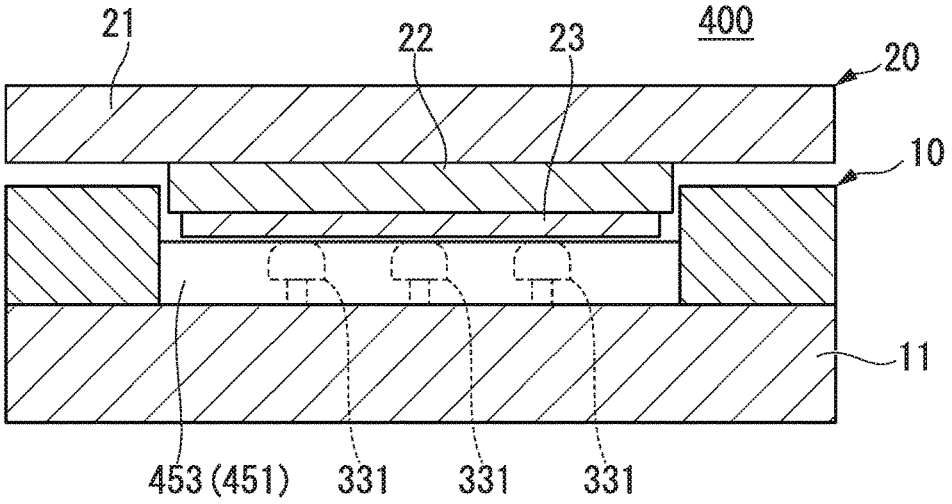
FIG. 41 is a front view showing the device for manufacturing a press-formed product according to the fourth embodiment of the present invention, and is a view showing a state where the upper press tool is lowered to the bottom dead center.

FIG. 41 is a view showing a state where the intermediate press-formed product 451 is press-formed. As shown in FIG. 41, the web portion 452 of the intermediate press-formed product 451 are interposed between the upper press tool 20 and the blank holder pads 331, and the vertical wall portions 453 of the intermediate press-formed product 451 are interposed between the lower press tool 10 and the blank holder pads 331. Accordingly, it is possible to prevent buckling distortion of the intermediate press-formed product 451.

Figure 42A:
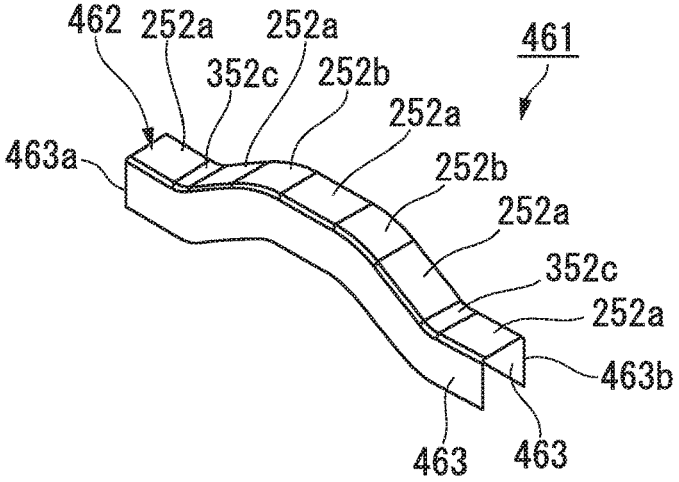
FIG. 42A is a perspective view showing still another modification example of the intermediate press-formed product which is used in the device for manufacturing a press-formed product according to the fourth embodiment of the present invention.
Figure 42B:
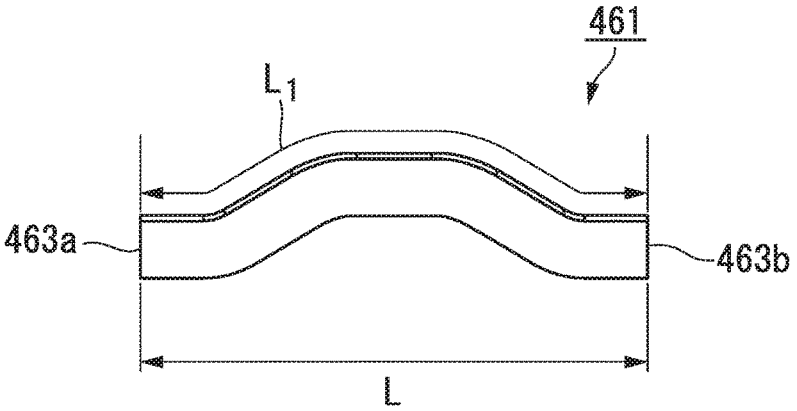
FIG. 42B is a front view showing the intermediate press-formed product.
Figure 42C:
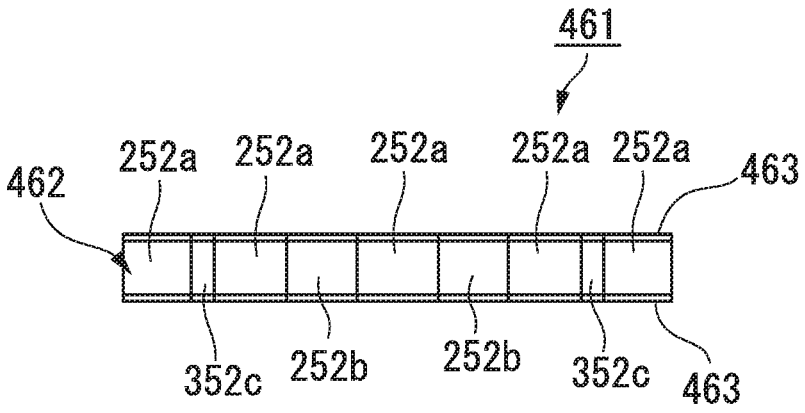
FIG. 42C is a plan view showing the intermediate press-formed product.

Moreover, in the manufacturing device 400, an intermediate press-formed product 461 shown in FIGS. 42A to 42C can be used. The intermediate press-formed product 461 includes a web portion 462 and a pair of vertical wall portions 463 which is connected to both sides of the web portion 462 in the width direction. In addition, the intermediate press-formed product 461 is different from the intermediate press-formed product 351 (refer to FIGS. 33A to 33C) in that five linear portions 252*a* and two bending portions 252*b* are provided.

Fifth Embodiment

Next, a fifth embodiment of the present invention will be described.

Figure 43:
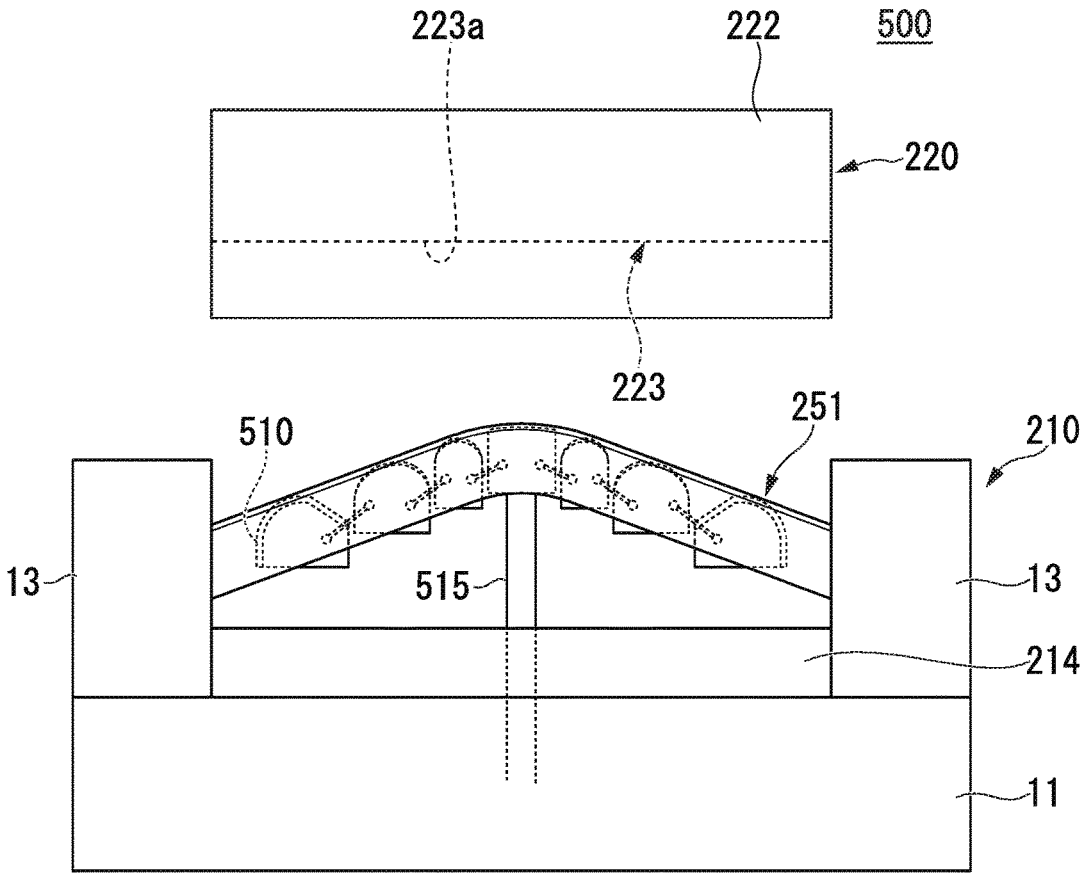
FIG. 43 is a front view showing a device for manufacturing a press-formed product according to a fifth embodiment of the present invention.

FIG. 43 is a front view showing a device 500 for manufacturing a press-formed product (hereinafter, simply referred to as a manufacturing device 500) according to the fifth embodiment. As shown in FIG. 43, the manufacturing device 500 is different from the manufacturing device 200 according to the second embodiment in that a mandrel 510 which is positioned between the pair of short-side walls 13 is provided.

Figure 44:
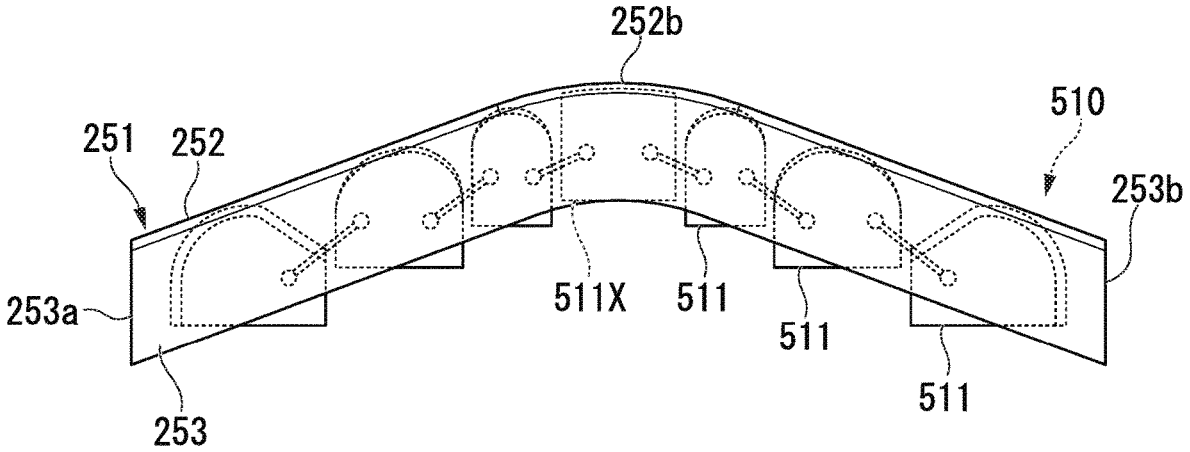
FIG. 44 is a view showing a mandrel and an intermediate press-formed product according to the fifth embodiment of the present invention.
Figure 45:
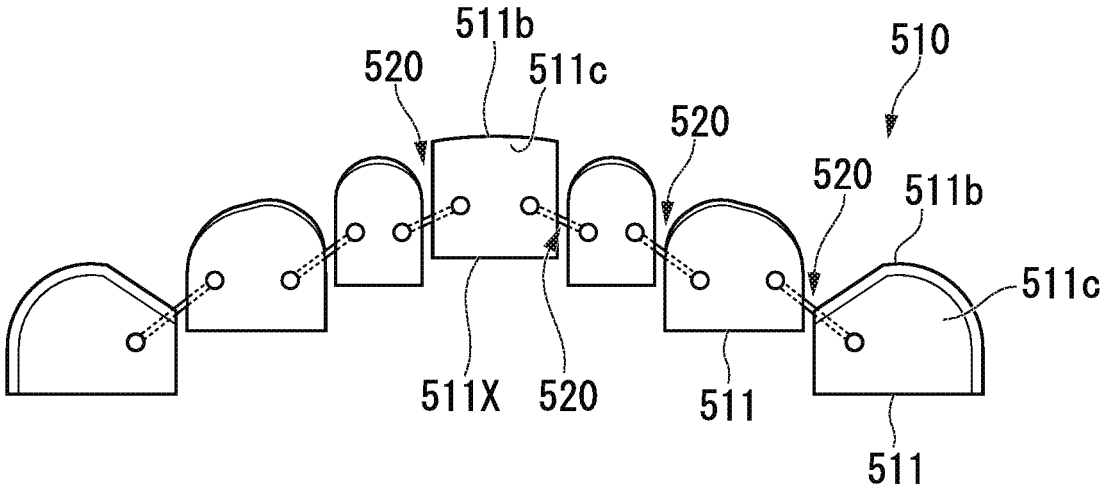
FIG. 45 is a front schematic view showing the mandrel according to the fifth embodiment of the present invention.

FIG. 44 is a front view showing the mandrel 510 according to the present embodiment and the intermediate press-formed product 251. In addition, FIG. 45 is a front schematic view showing the mandrel 510. As shown in FIGS. 44 and 45, the mandrel 510 is configured of a plurality of division bodies 511 and connection bodies 520 which connect the division bodies 511. The plurality of division bodies 511 of the mandrel 510 are inserted into a space which is surrounded by the web portion 252 and the pair of vertical wall portions 253 of the intermediate press-formed product 251. At this time, among the plurality of division bodies 511, a division body 511X which is positioned at the center in the longitudinal direction comes into contact with the concave side (constriction surface) of the bending portion 252*b* of the web portion 252 of the intermediate press-formed product 251. In addition, a shaft portion 515, which is inserted into a through hole provided at the center of the convex portion 214 of the lower press tool 210 in the longitudinal direction, is connected to the division body 511X (refer to FIG. 43). Accordingly, the mandrel 510 can be freely lifted and lowered in accordance with the movement of the upper press tool 220.

In addition, the entire length of the mandrel 510 is set so as to be less than or equal to the distance L (refer to FIGS. 24A and 24B) between both ends of the intermediate press-formed product 251 in the longitudinal direction. In other words, the entire length of the mandrel 510 is set so as to be less than or equal to the distance between the pair of short-side walls 13. The setting is realized so as to prevent interference between the mandrel 510 and the pair of short-side walls 13 when the division bodies 511 of the mandrel 510 are arranged in a line (refer to FIG. 49).

In addition, as shown in FIG. 45, each of the division bodies 511 includes an upper surface 511*b* which comes into contact with the web portion 252 of the intermediate press-formed product 251, and side surfaces 511*c* which come into contact with the vertical wall portions 253 of the intermediate press-formed product 251. The upper surface 511*b* of the division body 511 is a convex surface, and the side surface 511*c* of the division body 511 is a flat surface.

Figure 46:
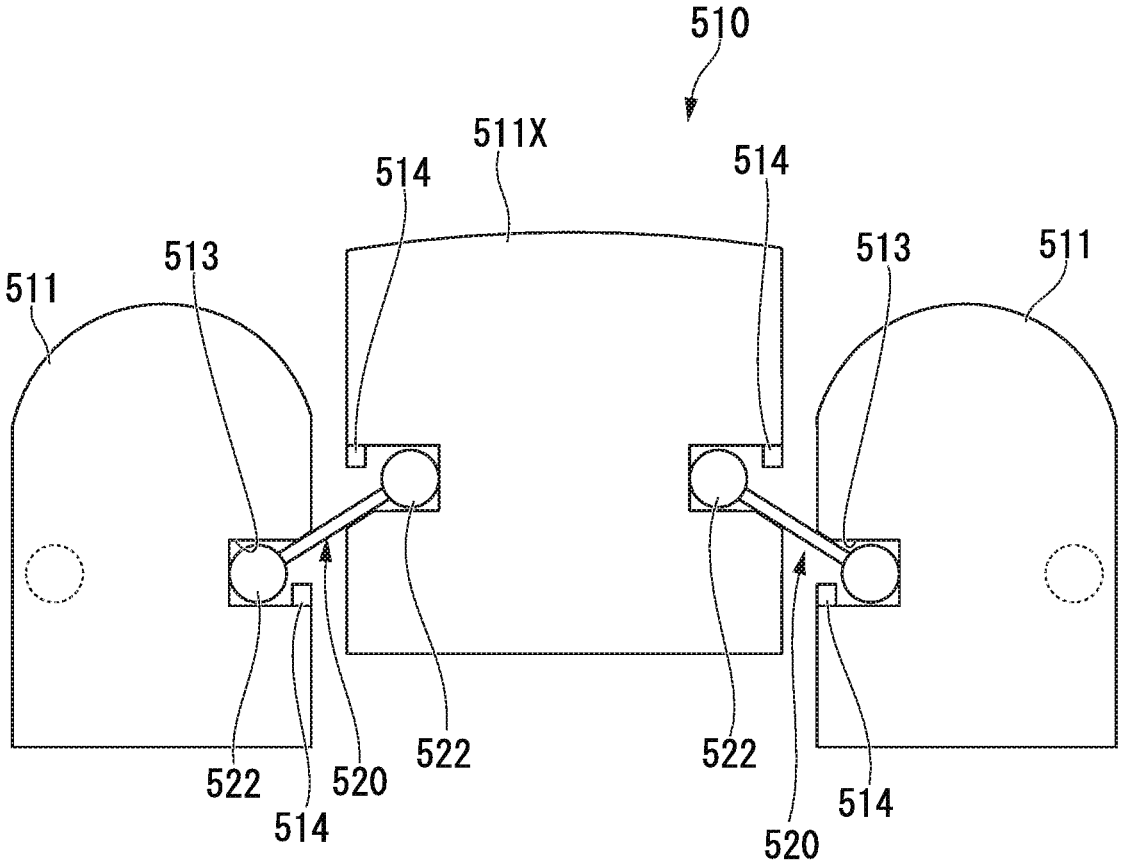
FIG. 46 is an enlarged front view showing the mandrel according to the fifth embodiment of the present invention.

FIG. 46 is an enlarged front view showing the mandrel 510. As shown in FIG. 46, each of the division bodies 511 of the mandrel 510 includes concave portions 513 which are provided on end portions of the division body 511 in the longitudinal direction and stoppers 514 which are provided on inner surfaces of the concave portions 513. In the concave portion 513, an engagement portion 522 of the connection body 520 connected to the adjacent division body 511 is inserted to the inside further relative to the stopper 514. The stopper 514 is a protrusion which is provided in the concave portion 513 of the division body 511, and regulates the movement of the engagement portion 522 of the connection body 520.

Figure 47:
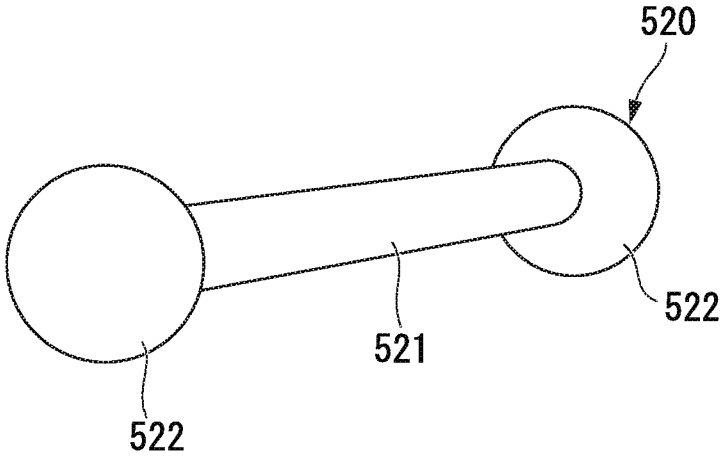
FIG. 47 is a perspective view showing a connection body of the mandrel according to the fifth embodiment of the present invention.

FIG. 47 is a perspective view showing the connection body 520. As shown in FIG. 47, the connection body 520 is configured of a rod-shaped main body portion 521, and the ball-shaped engagement portion 522 which is provided on each of both ends of the main body portion 521 in the longitudinal direction.

Figure 48:
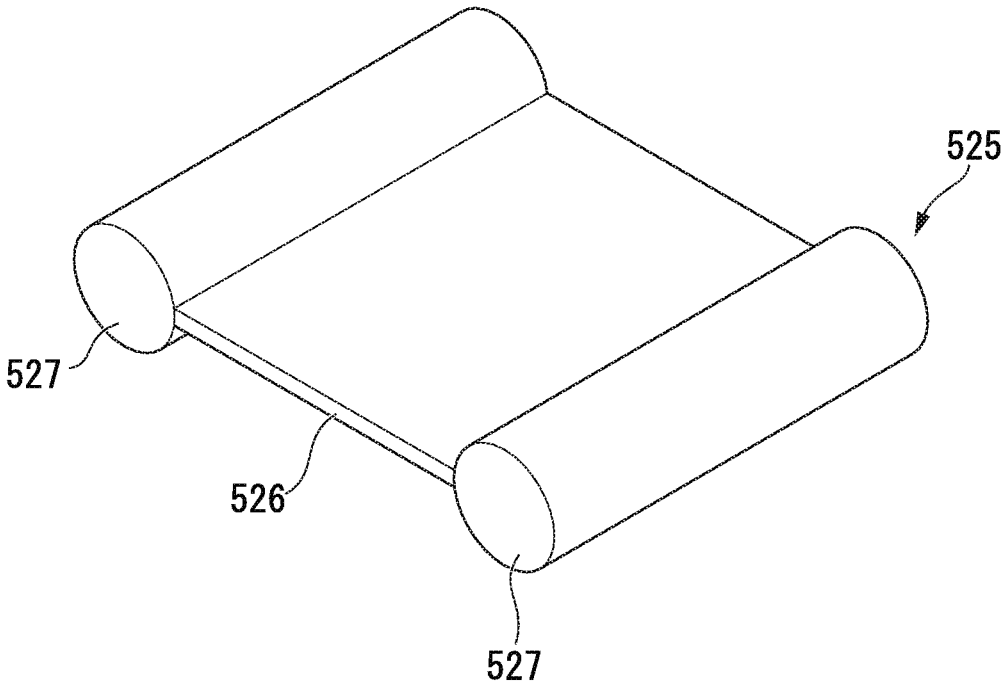
FIG. 48 is a perspective view showing a modification example of the connection body.

In addition, instead of the connection body 520 shown in FIG. 47, as shown in FIG. 48, a connection body 525 may be used, which is configured of a plate-shaped main body portion 526, and a columnar engagement portion 527 which is provided on each of both ends of the main body portion 526 in the longitudinal direction.

According to this configuration, the plurality of division bodies 511 of the mandrel 510 can approach each other or can be separated from each other. That is, as shown in FIG. 43, the plurality of division bodies 511 can be arranged in an arc shape or arranged linearly (in a line) along the shape of the intermediate press-formed product 251.

Figure 49:
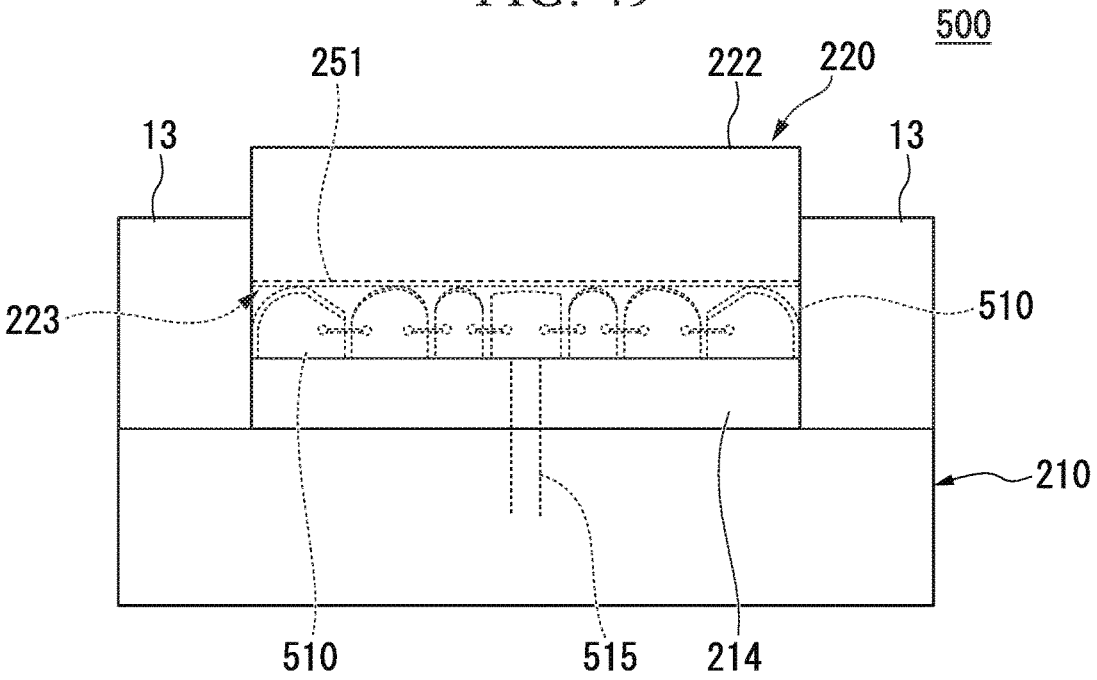
FIG. 49 is a front view showing the device for manufacturing a press-formed product according to the fifth embodiment of the present invention, and is a view showing a state where an upper press tool is lowered to a bottom dead center.

FIG. 49 is a front view showing the manufacturing device 500, and is a view showing a state where the upper press tool 220 is lowered to the bottom dead center. When the upper press tool 220 is lowered, the mandrel 510 is lowered while being pressed by the upper press tool 220. Accordingly, since the state where the mandrel 510 comes into contact with the web portion 252 and the vertical wall portions 253 of the intermediate press-formed product 251 is maintained while the mandrel 510 is lowered while being pressed by the upper press tool 220, it is possible to prevent buckling distortion of the web portion 252 and the vertical wall portions 253 during processing.

In addition, in the mandrel 510, the shape of the arrangement of the division bodies 511 is changed from an arc shape to a line shape (a positional relationship between the division bodies is changed) in accordance with the distortion of the web portion 252 of the intermediate press-formed product 251. Accordingly, while the upper press tool 220 is lowered to the bottom dead center, it is possible to allow the mandrel 510 to come into contact with the web portion 252 and the vertical wall portions 253 of the intermediate press-formed product 251.

In this way, in the manufacturing device 500, since the intermediate press-formed product 251 is press-formed while the mandrel 510 comes into contact with the web portion 252 and the vertical wall portions 253 of the intermediate press-formed product 251, it is possible to reliably prevent buckling distortion of the web portion 252 and the vertical wall portions 253.

Sixth Embodiment

Next, a sixth embodiment of the present invention will be described.

Figure 50:
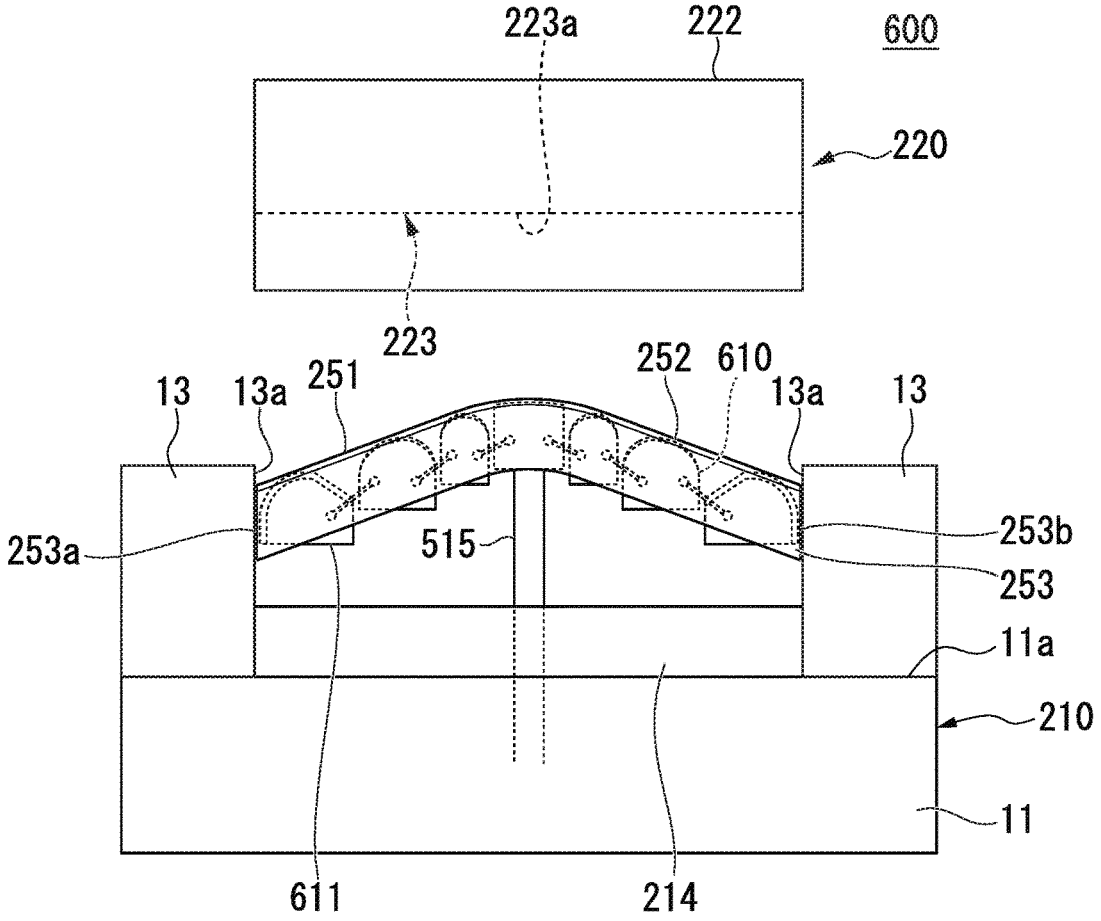
FIG. 50 is a front view showing a device for manufacturing a press-formed product according to a sixth embodiment of the present invention.

FIG. 50 is a front view showing a device 600 for manufacturing a press-formed product (hereinafter, simply referred to as a manufacturing device 600) according to the sixth embodiment. In the fifth embodiment, the manufacturing device 500 includes the mandrel 510. However, in the present embodiment, the manufacturing device 600 includes a mandrel 610 instead of the mandrel 510. Here, it is necessary to set the entire length of the mandrel 510 according to the fifth embodiment to be less than or equal to the distance between the pair of short-side walls 13. Accordingly, when the intermediate press-formed product 251 is press-formed, a portion of the web portion 252 and the vertical wall portions 253 of the intermediate press-formed product 251 does not come into contact with the mandrel 510. Meanwhile, as described below, since the entire length of the mandrel 610 according to the present embodiment can increase and decrease, the entireties of the web portion 252 and the vertical wall portions 253 of the intermediate press-formed product 251 can always come into contact with the mandrel 610.

Figure 51:
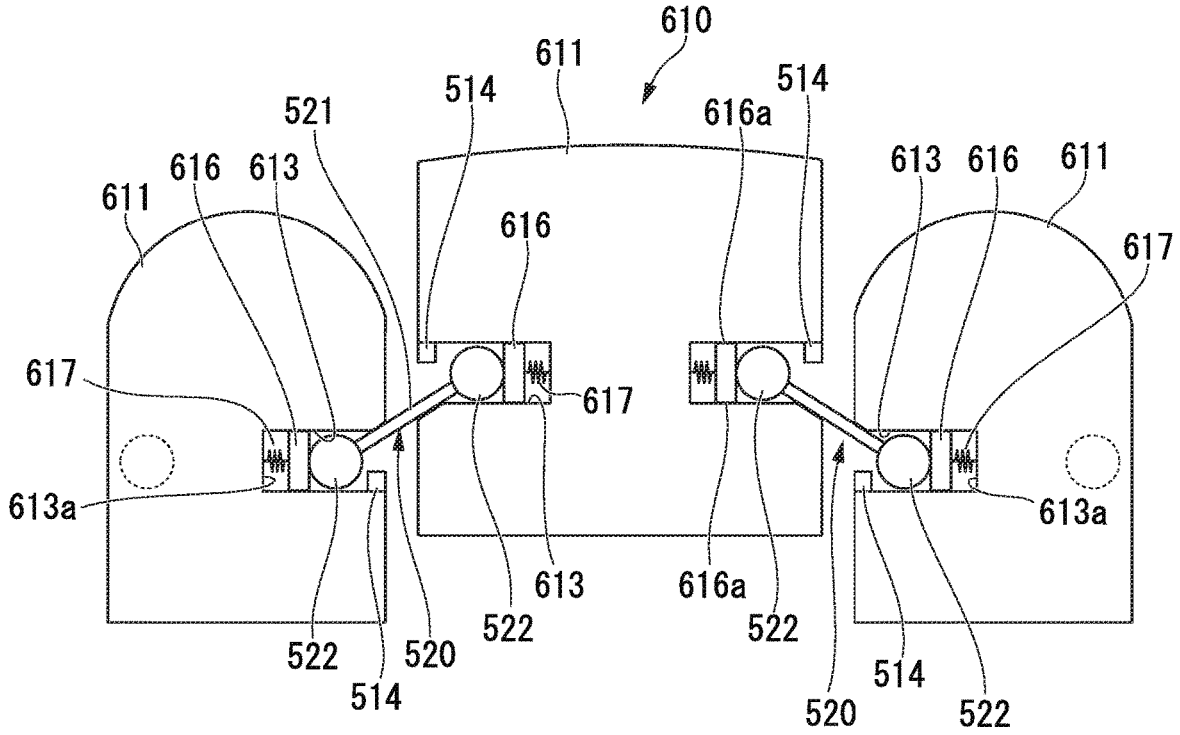
FIG. 51 is an enlarged front view showing a mandrel according to the sixth embodiment of the present invention.

FIG. 51 is an enlarged front view showing the mandrel 610. As shown in FIG. 51, the mandrel 610 according to the present embodiment is different from the mandrel 510 according to the fifth embodiment in that a plurality of division bodies 611 include slider bodies 616 and elastic bodies 617.

As shown in FIG. 51, each of the division bodies 611 of the mandrel 610 is configured of concave portions 613 which are provided on end portions of the division body 611 in the longitudinal direction, plate-shaped slider bodies 616 which are disposed inside the concave portions 613, elastic bodies 617 which biases the slider bodies 616 so as to be pushed out from the concave portions 613, and stoppers 514 which are provided on the inner surfaces of the concave portions 613.

The slide body 616 is biased toward the stopper 514 side by the elastic body 617. In addition, the slide body 616 moves inside the concave portion 613 within a range limited by the elastic body 617 in a state where end surfaces 616*a* of the slide body 616 come into contact with the inner surfaces of the concave portion 613.

One end of the elastic body 617 is connected to the slide body 616, and the other end thereof is connected to a bottom surface 613*a* of the concave portion 613. For example, the elastic body 617 is a coil spring or a plate spring. In addition, the engagement portion 522 of the connection body 520 which is inserted into the concave portion 613 is disposed between the slide body 616 and the stopper 514.

Figure 52:
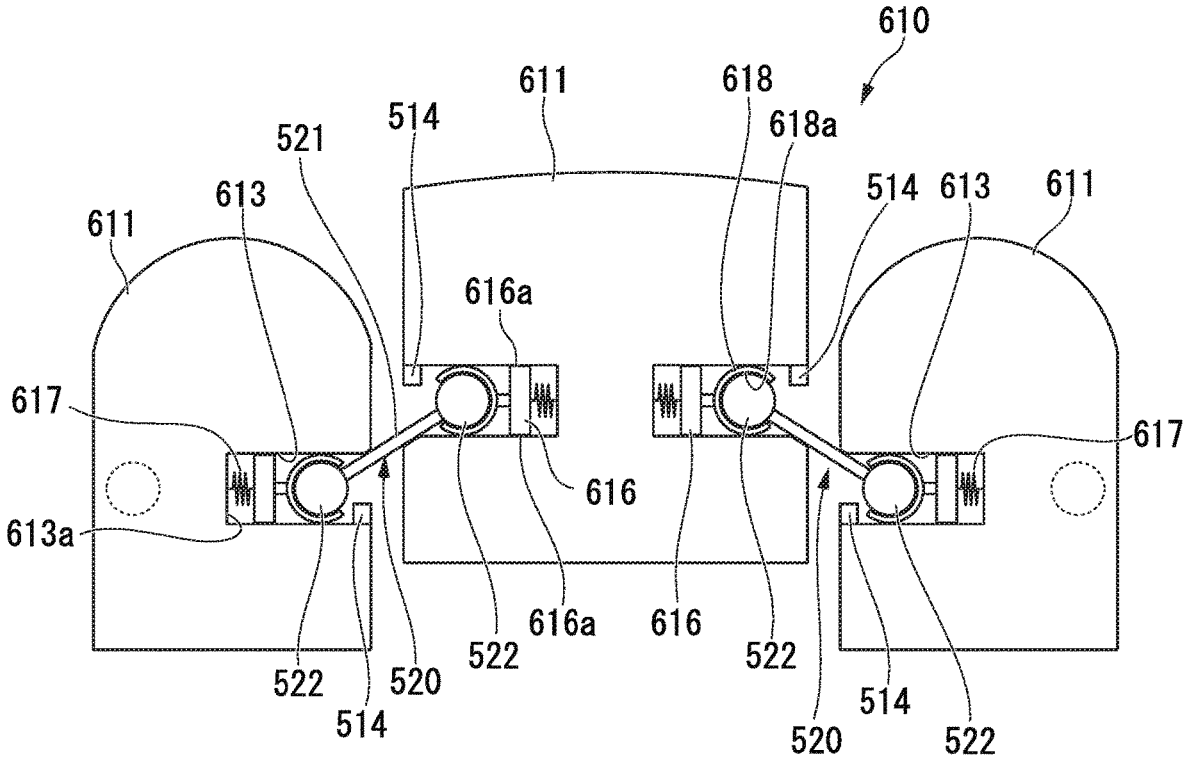
FIG. 52 is an enlarged front view showing a modification example of the mandrel according to the sixth embodiment of the present invention.

In addition, as shown in FIG. 52, each of the division bodies 611 of the mandrel 610 may further include a receiving portion 618 which is provided on the slide body 616 and has a receiving surface 618*a* which comes into contact with the engagement portion 522 of the connection body 520. In this case, since the engagement portion 522 of the connection body 520 is held by the receiving portion 618 of the slide body 616, a smooth movement of the engagement portion 522 of the connection body 520 is realized.

Figure 53:
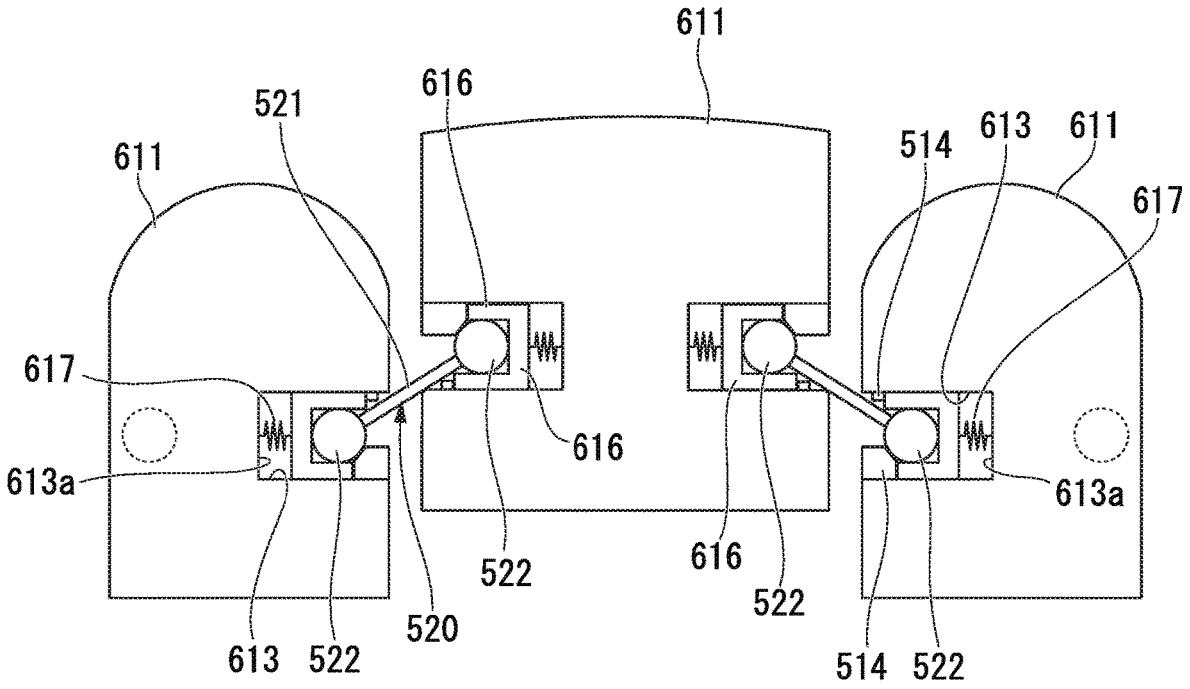
FIG. 53 is an enlarged front view showing another modification example of the mandrel according to the sixth embodiment of the present invention.

In addition, as shown in FIG. 53, the shape of the slide body 616 of the mandrel 610 may be a U shape, and for example, two stoppers 514 may be provided in the concave portion 613. In this case, a smooth movement of the slide body 616 can be realized.

Next, the movement of the mandrel 610 will be described. In a state where compressive stress is not applied to portions between the adjacent division bodies 611 (refer to FIG. 50), as shown in FIG. 51, the length of the elastic body 617 is an initial length. Accordingly, the engagement portion 522 of the connection body 520 is positioned so as to be close to the stopper 514. Since the engagement portion 522 of the connection body 520 is positioned so as to be close to the stopper 514, a range in which the connection body 520 can be inclined is relatively wide. Accordingly, the relative position of the adjacent division bodies 611 connected by the connection body 520 can be changed in an upward-downward direction.

If the upper press tool 220 is lowered from the state shown in FIG. 50 and the intermediate press-formed product 251 is pressed by the upper press tool 220, compressive stress which allows the adjacent division bodies 611 to approach each other is applied to the mandrel 610. At this time, the slide body 616 is pressed toward the bottom surface 613*a* of the concave portion 613 by the engagement portion 522 of each of the connection bodies 520, and the elastic body 617 is compressed. Since the elastic body 617 is compressed, the main body portion 521 of the connection body 520 enters the concave portion 613. Accordingly, the adjacent division bodies 611 approach each other.

According to the above-described operation, the adjacent division bodies 611 approach each other via the connection body 520, the division bodies 611 are adjacent to each other with a predetermined gap or come into contact with each other. In addition, the plurality of division bodies 611 are arranged in a line. Accordingly, by lowering the upper press tool 220, the entire length of the mandrel 610 decreases.

Figure 54:
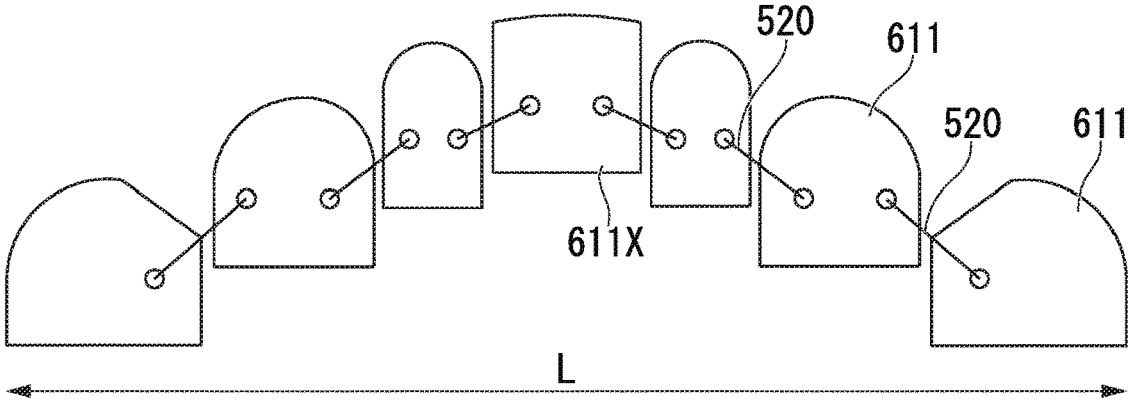
FIG. 54 is a view for explaining an operation of the mandrel according to the sixth embodiment of the present invention.
Figure 55:
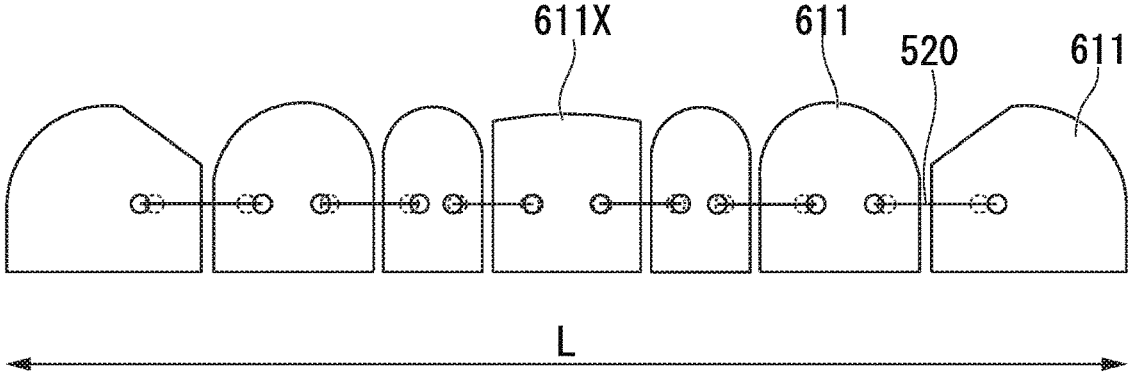
FIG. 55 is a view for explaining the operation of the mandrel according to the sixth embodiment of the present invention.
Figure 56:
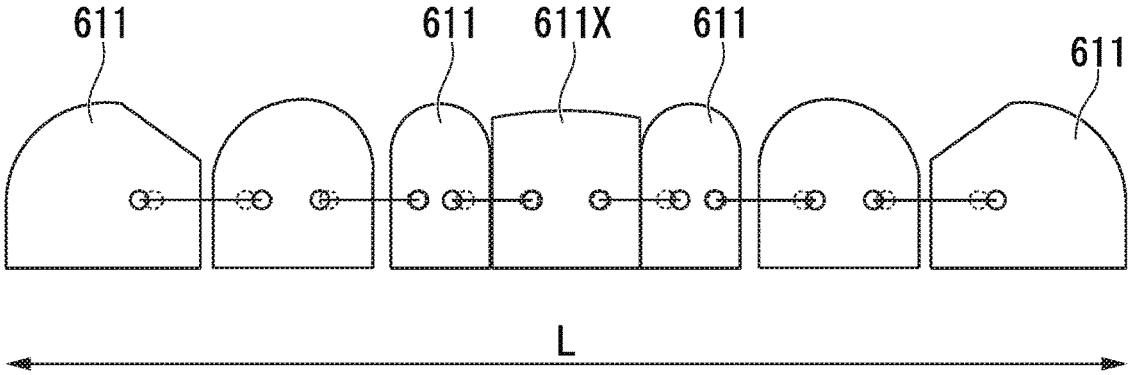
FIG. 56 is a view for explaining the operation of the mandrel according to the sixth embodiment of the present invention.

Next, the operation of the mandrel 610 when the intermediate press-formed product 251 is press-formed using the manufacturing device 600 will be described with reference to FIGS. 54 to 56. FIGS. 54 to 56 are front schematic views showing the division bodies 611 of the mandrel 610 and the connection bodies 520 which connect the division bodies 611 adjacent to each other.

As shown in FIG. 54, in a state before the upper press tool 220 of the manufacturing device 600 is lowered, in the mandrel 610, the central division body 611X is positioned at a higher position than other division bodies 611 in accordance with the shape of the web portion 252 of the intermediate press-formed product 251. The heights of other division bodies 611 decrease as the division bodies 611 are separated from the division body 611X.

In the state shown in FIG. 54, compressive stress is not applied to the mandrel 610. Accordingly, the elastic body 617 of each of the division bodies 611 is not compressed, and the division bodies 611 adjacent each other are separated from each other with a relatively wide gap.

If the upper press tool 220 of the manufacturing device 600 is lowered and the intermediate press-formed product 251 is pressed by the upper press tool 220, the heights of the division bodies 611 approach the same height as each other in accordance with the distortion of the web portion 252 of the intermediate press-formed product 251. In addition, the division bodies 611 which are positioned on both ends of the mandrel 610 are restricted by the pair of short-side walls 13 which restricts both ends of the intermediate press-formed product 251 in the longitudinal direction. If the upper press tool 220 further lowers and the bending portion 252*b* of the web portion 252 of the intermediate press-formed product 251 extends, the heights of the division bodies 611 are the same as each other. Simultaneously, compressive stress is applied to the mandrel 610, the elastic body 617 is compressed so as to be constricted, and the gap between the division bodies 611 decreases.

The reason why the compressive stress is applied to the mandrel 610 is as follows. That is, while the entire length of the intermediate press-formed product 251 is L1 in the state before the upper press tool 220 is lowered, in the state after the upper press tool 220 is lowered, the entire length of the intermediate press-formed product 251 is compressed so as to be L by the upper press tool 220 and the pair of short-side walls 13. As a result, since compressive stress is also applied to the mandrel 610 disposed along the web portion 252 of the intermediate press-formed product 251 by the upper press tool 220 and the pair of short-side walls 13, the compressive stress is applied to the mandrel 610.

FIG. 55 shows an example of the mandrel 610 in a state where the upper press tool 220 is lowered to the bottom dead center. In the mandrel 610 shown in FIG. 55, the gaps between the division bodies 611 are the same as each other. In this way, in order to allow the gaps between the division bodies 611 to be constant, a spring constant of the elastic body 617, the length of the connection body 520, the depth of the concave portion 613, or the like may be adjusted.

In addition, FIG. 56 shows another example of the mandrel 610 in a state where the upper press tool 220 is lowered to the bottom dead center. In the mandrel 610 shown in FIG. 56, the gaps between some division bodies 611 are narrower than the gaps between other division bodies 611. Specifically, the gaps between the central division body 611X and two division bodies 611 adjacent to the central division body 611X relatively decrease, and the gaps between other division bodies 611 relatively increase. The central division body 611X and two division bodies 611 adjacent to the central division body 611X are positioned in the vicinity of the bending portion 252*b* of the web portion 252 of the intermediate press-formed product 251. In this way, in the mandrel 610 shown in FIG. 56, the division bodies 611, which are positioned in the vicinity of the bending portion 252*b* in which buckle easily occurs, approach each other in the state where the upper press tool 220 is lowered to the bottom dead center.

In order to allow the gaps between the division bodies 611 to be different from each other, the spring constant of the elastic body 617, the length of the connection body 520, the depth of the concave portion 613, or the like may be adjusted. In the mandrel 610 shown in FIG. 56, for example, spring constants of the elastic bodies 617 of the central division bodies 611X and the two division bodies 611 adjacent to the central division bodies 611X may be smaller than the spring constants of other elastic bodies 617. In addition, the entire length of each of the connection bodies 520 which connects the central division body 611X and two division bodies 611 adjacent to the central division body 611X may be shorter than the entire length of each of other connection bodies 520. Moreover, the depth of each of the concave portions 613 of the central division body 611X and two division bodies 611 adjacent to the central division body 611X may be shallower than the depth of each of other concave portions 613.

According to the present embodiment, the mandrel 610 in which the entire length can increase and decrease is used, the mandrel 610 is inserted along the web portion 252 of the intermediate press-formed product 251, and the intermediate press-formed product 251 is press-formed while the entire length of the mandrel 610 decreases. Accordingly, it is possible to restrict the entire intermediate press-formed product 251 by the mandrel 610, and it is possible to reliably prevent the buckling distortion of the web portion 252 and the vertical wall portions 253.

[Modification Example of Mandrel 610]

Figure 57:
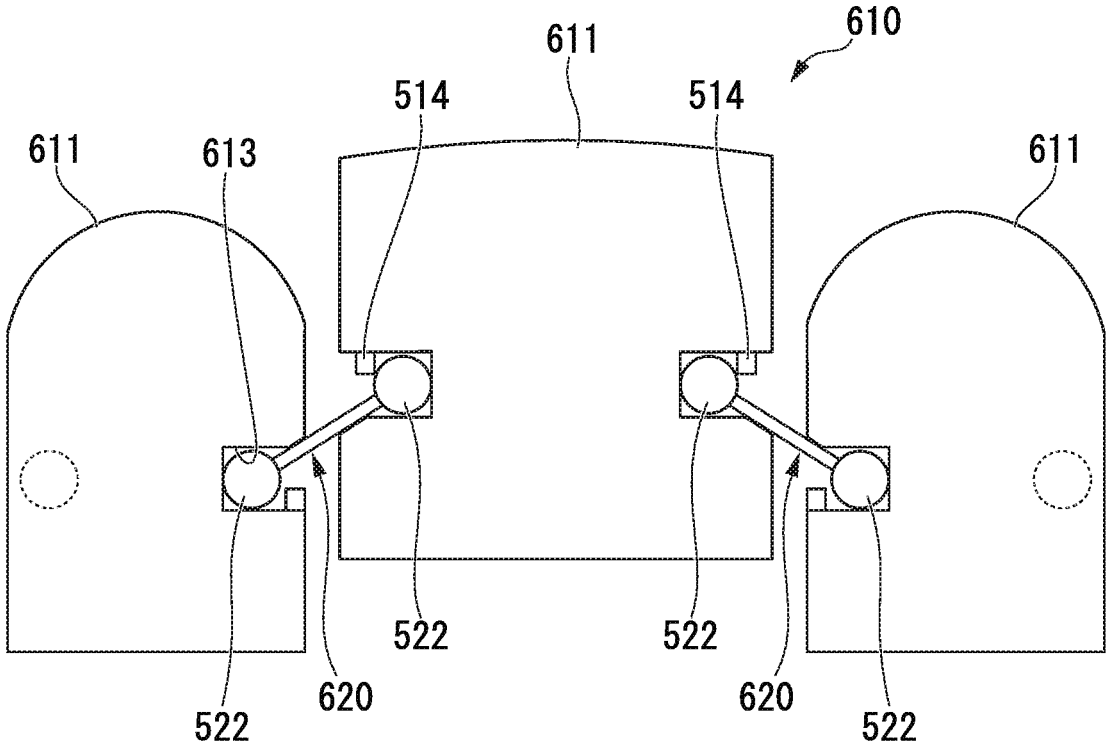
Figure 58:
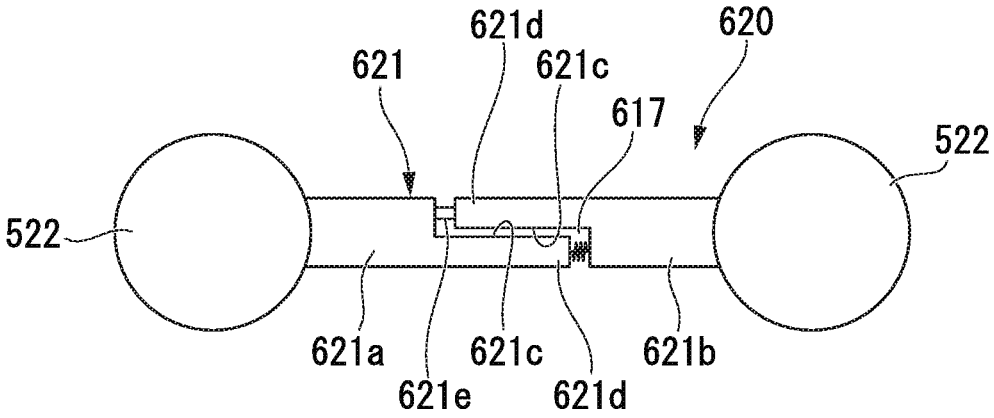

FIGS. 57 and 58 are views showing a modification example of the mandrel 610. As shown in FIGS. 57 and 58, instead of the slide body 616, the elastic body 617, and the connection body 520, a connection body 620 may be provided in the division body 611 of the mandrel 610.

A main body portion 621 of the connection body 620 shown in FIGS. 57 and 58 is configured of two division main body portions 621*a* and 621*b*. The division main body portions 621*a* and 621*b* are configured by dividing the main body portion 621 into two portions at the center in the longitudinal direction.

One end of each of the division main body portions 621*a* and 621*b* in the longitudinal direction is connected to the engagement portion 522, and each of the division main body portions 621*a* and 621*b* includes a notch portion 621*c* and a protrusion portion 621*d* which is provided on the other end. The notch portion 621*c* and the protrusion portion 621*d* are configured so as to be fitted to each other. In addition, the elastic body 617 is provided on the distal end of the protrusion portion 621*d* of the division main body portion 621*a*, and a slide pin 621*e* is provided on the distal end of the protrusion portion 621*d* of the division main body portion 621*b*. The elastic body 617 is connected to the notch portion 621*c* of the division main body portion 621*b*. Moreover, the slide pin 621*e* is inserted into an insertion hole (not shown) which is provided in the notch portion 621*c* of the division main body portion 621*a*. Since the elastic body 617 is disposed between the division main body portions 621*a* and 621*b*, the division main body portions 621*a* and 621*b* are separated from each other.

According to this configuration, in the mandrel 610 shown in FIGS. 57 and 58, when compressive stress is applied to the mandrel 610 along the longitudinal direction, the elastic body 617 is compressed, the gap between the division main body portions 621*a* and 621*b* decreases, and it is possible to decrease the entire length of the connection body 620. Accordingly, similarly the present embodiment, it is possible to increase and decrease the entire length of the mandrel 610.

Figure 59:
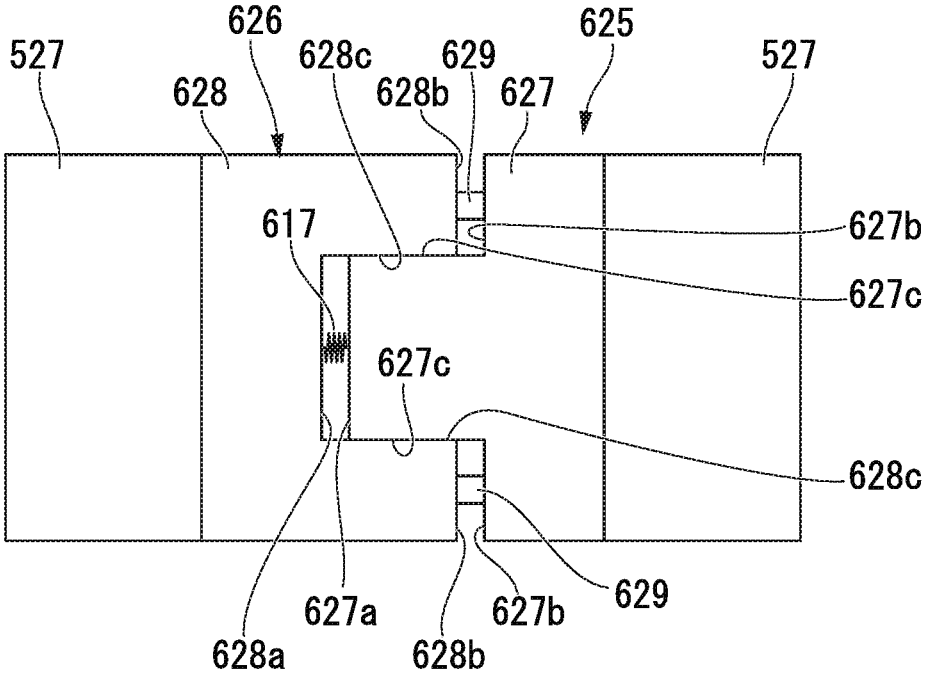

In addition, instead of the connection body 620, a connection body 625 shown in FIG. 59 may be used. FIG. 59 is a plan view showing the connection body 625. The connection body 625 is configured by dividing the connection body 525 shown in FIG. 48.

A plate-shaped main body portion 626 of the connection body 625 shown in FIG. 59 is configured of two division main body portions 627 and 628. The division main body portions 627 and 628 are configured by dividing the main body portion 626 into two at approximately the center in the longitudinal direction.

A protrusion portion 627*a* is provided at the center of one division main body portion 627 in the width direction. In addition, a notch portion 628*a* is provided at the center of the other division main body portion 628 in the width direction. Moreover, the elastic body 617 is provided on the distal end of the protrusion portion 627*a*. The elastic body 617 is connected to the notch portion 628*a* of the division main body portion 628. In addition, slide pins 629 are provided on the end surface 627*b* on both sides of the protrusion portion 627*a* of the division main body portion 627 in the width direction. Each of the slide pins 629 is inserted into an insertion hole (not shown) which is provided an end surface 628*b* of the division main body portion 628. Since the elastic body 617 is disposed between the division main body portions 627 and 628, the division main body portions 627 and 628 are separated from each other.

According to this configuration, similarly to the connection body 620, the entire length of the connection body 625 can increase and decrease.

Seventh Embodiment

Next, a seventh embodiment of the present invention will be described.

Figure 61:
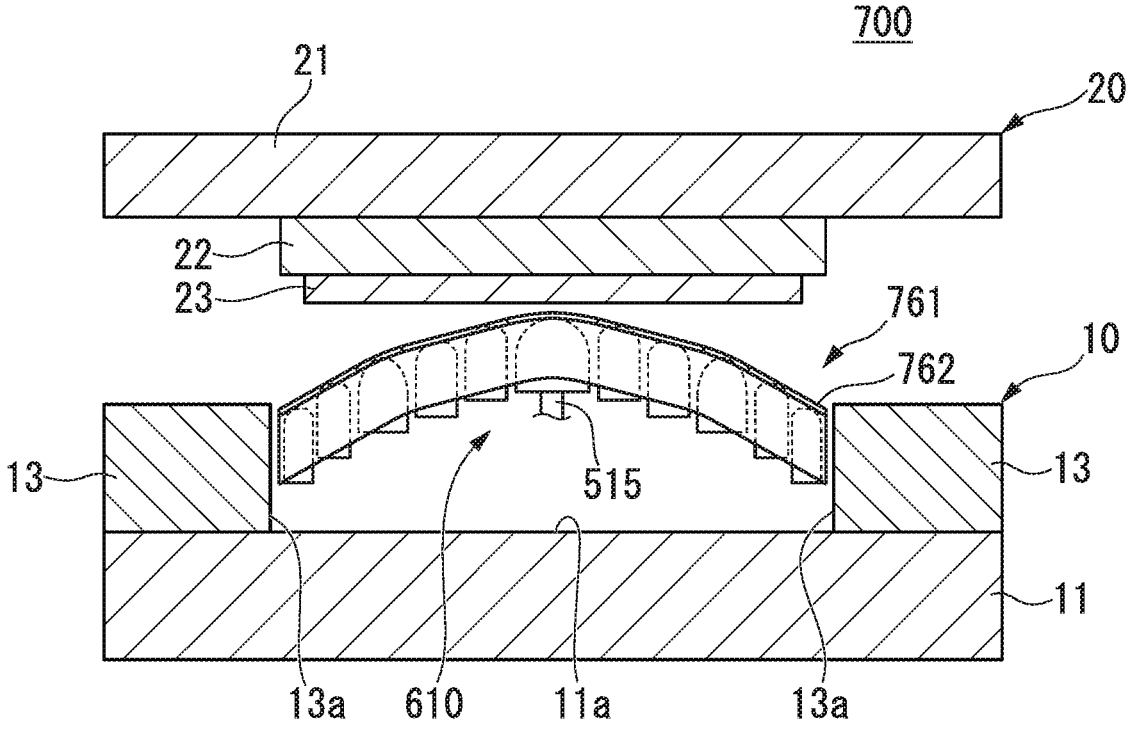
Figure 62:
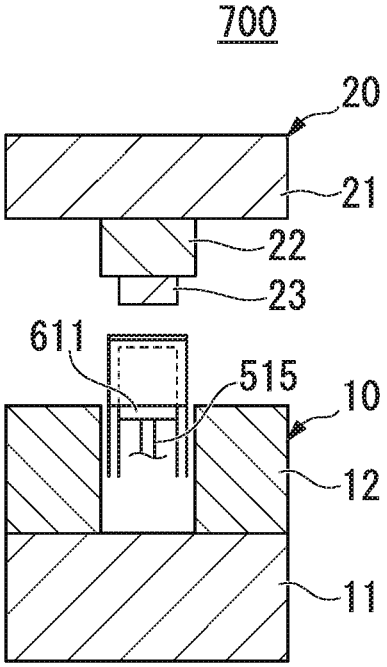

FIGS. 61 and 62 are front views showing a device 700 for manufacturing a press-formed product (hereinafter, simply referred to as a manufacturing device 700) according to the seventh embodiment. The manufacturing device 700 according to the present embodiment is configured of the manufacturing device 1 according to the first embodiment, and the mandrel 610 according to the sixth embodiment.

Figure 60A:
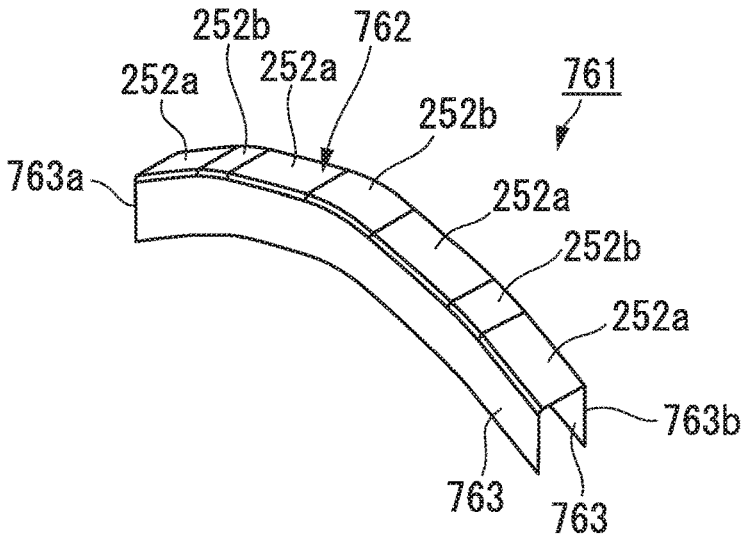
Figure 60B:
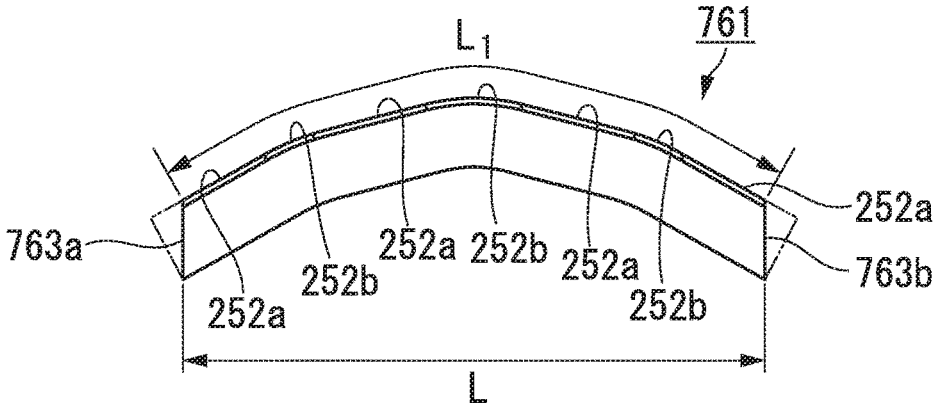
Figure 60C:
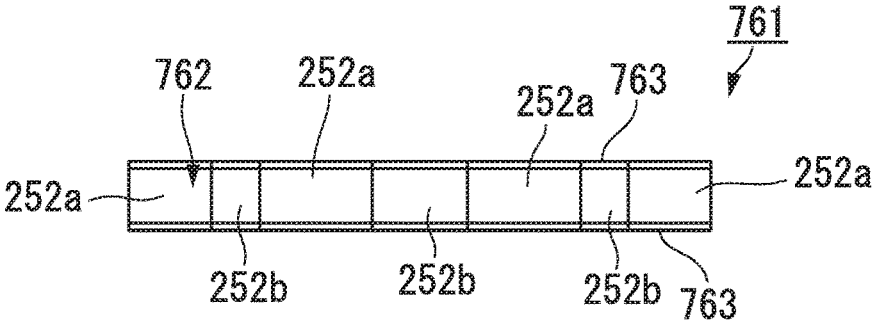

In the present embodiment, an intermediate press-formed product 761 shown in FIGS. 60A to 60C are press-formed using the manufacturing device 700. As shown in FIGS. 60A to 60C, the intermediate press-formed product 761 includes a web portion 762 and a pair of vertical wall portions 763. In addition, the intermediate press-formed product 761 is different from the intermediate press-formed product 251 (refer to FIGS. 24A and 24B) in that three bending portions 252*b* and four linear portions 252*a* are provided.

Figure 63:
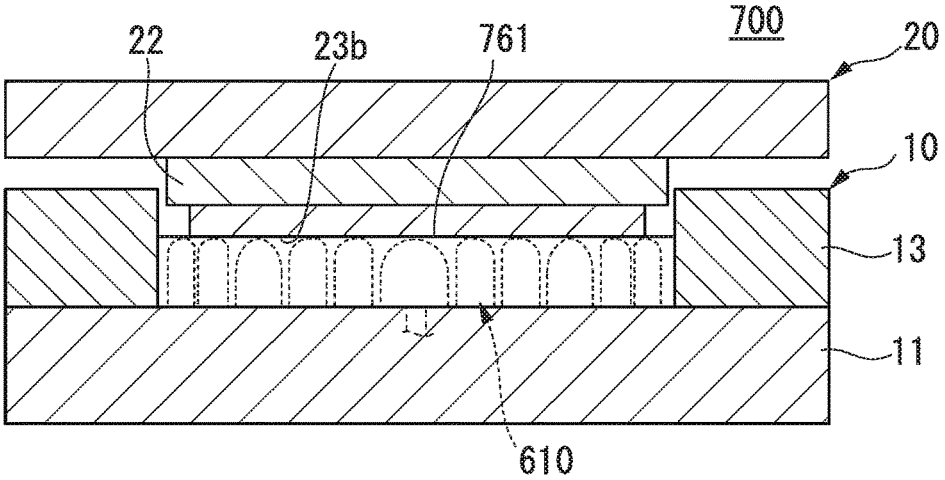

FIG. 63 is a view showing a state where the intermediate press-formed product 761 is press-formed using the manufacturing device 700. In the present embodiment, similarly to the sixth embodiment, since the mandrel 610 is changed in accordance with the shape of the intermediate press-formed product 761, it is possible to prevent buckling distortion of the intermediate press-formed product 761.

Figure 64A:
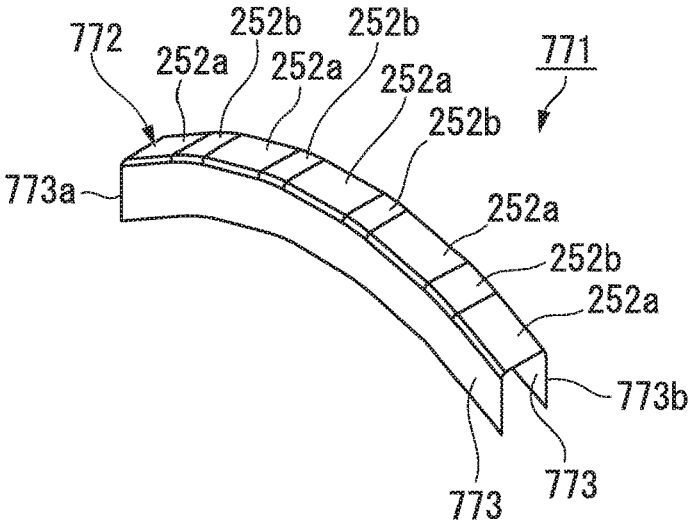
Figure 64B:
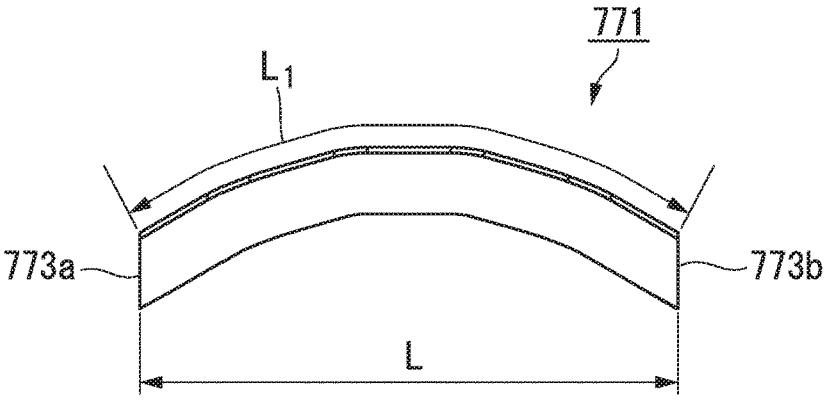
Figure 64C:
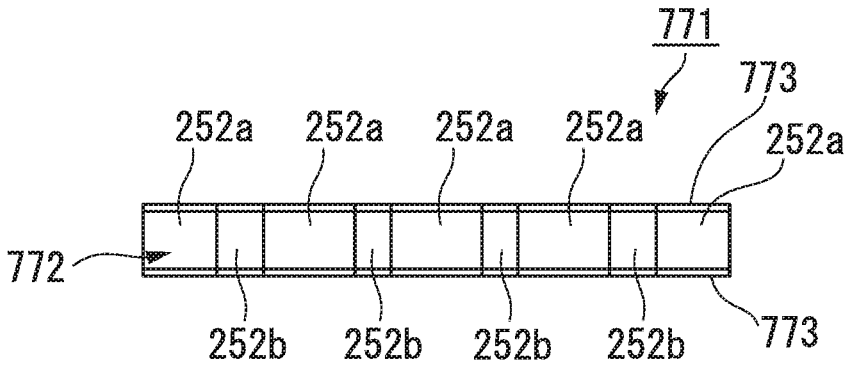

In addition, in the manufacturing device 700, an intermediate press-formed product 771 shown in FIGS. 64A to 64C may be used. As shown in FIGS. 64A to 64C, the intermediate press-formed product 771 includes a web portion 772 and a pair of vertical wall portions 773. In addition, the intermediate press-formed product 771 is different from the intermediate press-formed product 251 (refer to FIGS. 24A and 24B) in that four bending portions 252*b* and five linear portions 252*a* are provided. When the intermediate press-formed product 771 is press-formed by the manufacturing device 700, as shown in FIG. 65, the intermediate press-formed product 771 may be disposed in the manufacturing device 700.

In addition, in the manufacturing device 700, an intermediate press-formed product 781 shown in FIGS. 66A to 66C may be used. As shown in FIGS. 66A to 66C, the intermediate press-formed product 781 includes a web portion 782 and a pair of vertical wall portions 783. The intermediate press-formed product 781 is different from the intermediate press-formed product 351 (refer to FIGS. 33A to 33C) in that two bending portions 252*b*, six linear portions 252*a*, and three bending portions 352*c* are provided. When the intermediate press-formed product 781 is press-formed by the manufacturing device 700, as shown in FIG. 67, the intermediate press-formed product 781 may be disposed in the manufacturing device 700. In this case, preferably, the shaft portions 515 are provided on the division bodies 611 of the mandrel 610 which comes into contact with the bending portions 252*b* of the intermediate press-formed product 781.

In addition, in the manufacturing device 700, an intermediate press-formed product 791 shown in FIGS. 68A to 68C may be used. As shown in FIGS. 68A to 68C, the intermediate press-formed product 791 includes a web portion 792, a pair of vertical wall portions 793, and flanged portions 794. The intermediate press-formed product 791 is different from the intermediate press-formed product 761 (refer to FIGS. 60A to 60C) in that the flanged portions 794 are provided. When the intermediate press-formed product 791 is press-formed by the manufacturing device 700, as shown in FIG. 69, the intermediate press-formed product 791 may be disposed in the manufacturing device 700.

Eighth Embodiment

Next, an eighth embodiment of the present invention will be described.

FIG. 70 is a perspective view showing a device 800 for manufacturing a press-formed product (hereinafter, simply referred to as a manufacturing device 800) according to the eighth embodiment. In the first embodiment, the pair of short-side walls 13 of the manufacturing device 1 are fixed to the base portion 11 (refer to FIG. 2). Meanwhile, in the manufacturing device 800 according to the present embodiment, the intermediate press-formed product 51 is press-formed while a short-side wall 814 (pressurization restriction wall) which is provided on the base portion 11 approach a short-side wall 813 (pressurization restriction wall) according to lowering of an upper press tool 820.

FIG. 71A is a front view showing the manufacturing device 800, and is a view showing a state before the upper press tool 820 is lowered. As shown in FIG. 71A, a lower press tool 810 includes the base portion 11, the short-side wall 813 (fixing restriction wall) which is fixed to the upper surface 11*a* of the base portion 11, the short-side wall 814 (pressurization restriction wall) which is provided on the upper surface 11*a* of the base portion 11 and moves on the base portion 11, a cam slider 815 which is coupled to the short-side wall 814, a support portion 816 which is fixed to the base portion 11, a slide pin 817 which is connected to the cam slider 815 through the support portion 816, and a return spring 818 which connects the support portion 816 and the slide pin 817. An inclined slide surface 815*a* is provided on the cam slider 815. In addition, the slide pin 817 is biased toward a direction, which is separated from the short-side wall 814, by the return spring 818. The slide pin 817 can be inserted into and extracted from the support portion 816 along the longitudinal direction. In addition, the cam slider 815 which is fixed to the slide pin 817 slides along the longitudinal direction of the slide pin 817.

A concave portion 813*a*, a plate-shaped workpiece receiving portion 813*b*, a hinge 813*c*, and a spring member 813*d* (elastic body) are provided on the surface of the short-side wall 813 facing the short-side wall 814. The workpiece receiving portion 813*b* is connected to the short-side wall 813 via the hinge 813*c*. Accordingly, the workpiece receiving portion 813*b* is movable with respect to the short-side wall 813 with the hinge 813*c* as an axis.

The workpiece receiving portion 813*b* is accommodated in the concave portion 813*a* in a case where the workpiece receiving portion 813*b* is closest to the short-side wall 813. In addition, a spring member 813*d* is disposed between the workpiece receiving portion 813*b* and the short-side wall 813. The spring member 813*d* biases the workpiece receiving portion 813*b* toward the short-side wall 814.

Similarly, a concave portion 814*a*, a plate-shaped workpiece receiving portion 814*b*, a hinge 814*c*, and a spring member 814*d* (elastic body) are provided on the surface of the short-side wall 814 facing the short-side wall 813. The workpiece receiving portion 814*b* is connected to the short-side wall 814 via the hinge 814*c*. Accordingly, the workpiece receiving portion 814*b* is movable with respect to the short-side wall 814 with the hinge 814*c* as an axis.

The workpiece receiving portion 814*b* is accommodated in the concave portion 814*a* in a case where the workpiece receiving portion 814*b* is closest to the short-side wall 814. In addition, a spring member 814*d* is disposed between the workpiece receiving portion 814*b* and the short-side wall 814. The spring member 814*d* biases the workpiece receiving portion 814*b* toward the short-side wall 813.

The upper press tool 820 is configured of the main body portion 21, the punch portion 22, the convex portion 23, and a cam driver 825 which is attached to the punch portion 22. An inclined slide surface 825*a* is provided on the cam driver 825.

In addition, when the cam driver 825 of the upper press tool 820 is lowered toward the cam slider 815 of the lower press tool 810, the cam slider 815 and the cam driver 825 are positioned such that the inclined surface 815*a* of the cam slider 815 and the inclined surface 825*a* of the cam driver 825 come into contact with each other.

Hereinafter, a method for manufacturing a press-formed product of the present embodiment will be described. First, as shown in FIG. 71A, the intermediate press-formed product 51 is disposed between the upper press tool 820 and the lower press tool 810. At this time, the intermediate press-formed product 51 is disposed such that the convex side (extension surface) of the bending portion 52*b* of the intermediate press-formed product 51 faces the upper press tool 820. In addition, both ends of the intermediate press-formed product 51 in the longitudinal direction come into contact with the workpiece receiving portions 813*b* and 814*b*. The workpiece receiving portions 813*b* and 814*b* are pressed by both ends of the intermediate press-formed product 51 in the longitudinal direction by the spring members 813*d* and 814*d*. In this way, both ends of the intermediate press-formed product 51 in the longitudinal direction are restricted by the short-side walls 813 and 814.

FIG. 71B is a view showing a state where the upper press tool 820 is lowered. As shown in FIG. 71B, the cam driver 825 comes into contact with the cam slider 815 according to the lowering of the upper press tool 820. In addition, according to the lowering of the cam driver 825, the cam slider 815 slides toward the short-side wall 813 against a spring force of the return spring 818. According to the sliding of the cam slider 815, the short-side wall 814 slides toward the short-side wall 813.

If the upper press tool 820 is further lowered, the short-side wall 814 slides, the convex portion 23 of the upper press tool 820 comes into contact with the web portion 52 of the intermediate press-formed product 51, and the intermediate press-formed product 51 is compressed in the longitudinal direction. In the present embodiment, since the short-side wall 814 slides toward the short-side wall 813, the distance between the short-side walls 813 and 814 decreases according to the lowering of the upper press tool 820. Accordingly, it is possible to increase a compressive force in the longitudinal direction which is applied to the intermediate press-formed product 51.

In addition, as shown in FIG. 71C, the press forming ends when the upper press tool 820 reaches the bottom dead center.

Here, if attention is focused on both ends of the intermediate press-formed product 51 in the longitudinal direction, in a state before the press forming starts, as shown in FIGS. 71A and 71B, both ends of the intermediate press-formed product 51 in the longitudinal direction are inclined with respect to the upper surface 11*a* of the base portion 11. However, according to proceeding of the press forming, the inclination angles of both ends of the intermediate press-formed product 51 in the longitudinal direction becomes perpendicular with respect to the upper surface 11*a* of the base portion 11.

In this way, according to proceeding of the press forming, the inclination angles of both ends of the intermediate press-formed product 51 in the longitudinal direction are changed. With respect to both ends of the intermediate press-formed product 51 in the longitudinal direction, the plate-shaped workpiece receiving portions 813*b* and 814*b* always press both ends of the intermediate press-formed product 51 in the longitudinal direction by the spring members 813*d* and 814*d*. In this way, in the present embodiment, the state where both ends of the intermediate press-formed product 51 in the longitudinal direction are restricted by the workpiece receiving portions 813*b* and 814*b* is maintained.

According to the present embodiment, since the intermediate press-formed product 51 is press-formed such that the curvature of the bending portion 52*b* of the intermediate press-formed product 51 decreases while the distance between the short-side wall 813 and the short-side wall 814 decreases, it is possible to reliably apply the compressive stress to the intermediate press-formed product 51 along the longitudinal direction.

In addition, since the upper press tool 820 is lowered in the state where the workpiece receiving portions 813*b* and 814*b* come into contact with both ends of the intermediate press-formed product 51 in the longitudinal direction, it is possible to equally apply a load to both ends of the intermediate press-formed product 51 in the longitudinal direction, and it is possible to apply compressive stress to both ends of the intermediate press-formed product 51 without buckling both ends of the intermediate press-formed product 51.

In addition, since an axial compressive force is easily released to extract the press-formed product when the press tool is removed, it is possible to prevent the formed product from protruding due to elastic recovery of the press-formed product.

In addition, in the manufacturing device 800, an intermediate press-formed product 861 shown in FIGS. 72A to 72C may be used. The intermediate press-formed product 861 includes a web portion 862 and a pair of vertical wall portions 863. Moreover, the intermediate press-formed product 861 is different from the intermediate press-formed product 451 (refer to FIGS. 39A to 39C) in that short sides 863*a* and 863*b* of the vertical wall portions 863 are not parallel with each other. As shown in FIGS. 73A and 73B, by disposing the intermediate press-formed product 861 in the manufacturing device 800 and lowering the upper press tool 820, it is possible to compress the intermediate press-formed product 861 in the longitudinal direction.

Moreover, in the manufacturing device 800, an intermediate press-formed product 871 shown in FIGS. 74A to 74C may be used. The intermediate press-formed product 871 includes a web portion 872 and a pair of vertical wall portions 873. Moreover, the intermediate press-formed product 871 is different from the intermediate press-formed product 761 (refer to FIGS. 60A to 60C) in that short sides 873*a* and 873*b* of the vertical wall portions 873 are not parallel with each other. As shown in FIGS. 75A and 75B, by disposing the intermediate press-formed product 871 in the manufacturing device 800 and lowering the upper press tool 820, it is possible to compress the intermediate press-formed product 871 in the longitudinal direction. In addition, in this case, preferably, the blank holder pad 331 (refer to FIGS. 32A to 32C) is disposed between the pair of vertical wall portions 873 of the intermediate press-formed product 871.

Moreover, in the manufacturing device 800, an intermediate press-formed product 881 shown in FIG. 76 may be used. As shown in FIG. 76, the intermediate press-formed product 881 is different from the intermediate press-formed product 251 (refer to FIGS. 24A and 24B) in that semicircular flanged portions 884 are provided on both ends in the longitudinal direction. In addition, the pair of flanged portions 884 is not parallel with each other. As shown in FIG. 77, by disposing the intermediate press-formed product 881 in the manufacturing device 800 such that the flanged portions 884 of the intermediate press-formed product 881 come into contact with the workpiece receiving portions 813*a* and 814*b* and lowering the upper press tool 820, it is possible to compress the intermediate press-formed product 881 in the longitudinal direction.

Moreover, in the manufacturing device 800, an intermediate press-formed product 886 shown in FIG. 78 may be used. The intermediate press-formed product 886 is different from the intermediate press-formed product 881 (refer to FIG. 76) in that three quadrilateral flanged portions 887 are provided on each of both ends in the longitudinal direction.

In addition, in the manufacturing device 800, an intermediate press-formed product 888 shown in FIG. 79 may be used. The intermediate press-formed product 888 is different from the intermediate press-formed product 881 (refer to FIG. 76) in that flanged portions 889 are provided on ends of the vertical wall portions 253 in the width direction.

Moreover, as shown in FIGS. 80A and 80B, in the manufacturing device 800, the intermediate press-formed product 251 (refer to FIGS. 24A and 24B) can be used. In this case, since both ends of the intermediate press-formed product 251 in the longitudinal direction are parallel with each other, the workpiece receiving portions 813*b* and 814*b*, the concave portions 813*a* and 814*a*, and the spring members 813*d* and 814*d* may not be provided in the lower press tool 810.

Ninth Embodiment

Next, a ninth embodiment of the present invention will be described.

FIG. 81 is a schematic view showing a device 900 for manufacturing a press-formed product (hereinafter, referred to as a manufacturing device 900) according to the ninth embodiment. As shown in FIG. 81, the manufacturing device 900 is different from the manufacturing device 800 according to the eighth embodiment in that the punch portion 222 (refer to FIG. 25A) having the concave portion 223 and the mandrel 610 (refer to FIG. 50) are provided.

The manufacturing device 900 is used when an intermediate press-formed product 951 is press-formed. Here, the intermediate press-formed product 951 has the same configuration as that of the intermediate press-formed product 251 (refer to FIG. 24A) except that both ends in the longitudinal direction are not parallel with each other.

FIGS. 82A to 82C are longitudinal sectional views showing the manufacturing device 900. In addition, FIG. 82B is a view showing a middle state where an upper press tool 920 lowers, and FIG. 82C is a view showing a state where the upper press tool 920 is lowered to the bottom dead center. First, as shown in FIG. 82A, the intermediate press-formed product 951 is disposed in the manufacturing device 900 such that both ends of the intermediate press-formed product 951 in the longitudinal direction come into contact with the working receiving portions 813*b* and 814*b*. At this time, the mandrel 610 is inserted into a space which is surrounded by a web portion 952 and a pair of vertical wall portions 953 of the intermediate press-formed product 951.

Subsequently, as shown in FIGS. 82B and 82C, the upper press tool 920 is lowered, and the intermediate press-formed product 951 is press-formed. At this time, the web portion 952 and the pair of vertical wall portions 953 of the intermediate press-formed product 951 are held by the concave portion 223 of the upper press tool 920 and the mandrel 610. Accordingly, it is possible to prevent buckling distortion when the intermediate press-formed product 951 is compressed in the longitudinal direction.

As described above, in the present embodiment, the intermediate press-formed product 951 is held by the mandrel 610 and the concave portion 223 of the upper press tool 920, and the intermediate press-formed product 951 is compressed in the longitudinal direction. Accordingly, with respect to the manufacturing device 800 of the eighth embodiment, it is possible to reliably prevent buckling distortion of the intermediate press-formed product 951.

Hereinbefore, embodiments of the present invention are described. However, the embodiments are exemplified, and the scope of the present invention is not limited to the embodiments. The embodiments can be modified to various aspects, and various omissions, replacements, modifications can be applied within a scope which does not depart from the gist of the present invention. If the embodiments or the modifications are included in the scope or gist of the present invention, the embodiments or the modifications are included in a range equivalent to the invention disclosed in the claims.

For example, in the embodiments the cases where the intermediate press-formed product is formed by one-time stroke (the number of times of the lowering of the upper press tool is one) are shown. However, the intermediate press-formed product may be formed by a plurality of strokes (the number of times of the lowering of the upper press tool is multiple). That is, as shown in FIGS. 83A to 83C, a curvature $m_o$ of the intermediate press-formed product 51 may be brought into $m_k$ by a first stroke, and the curvature $m_k$ of the intermediate press-formed product 51 may be brought into $m_n$ by a second stroke.

In addition, for example, in the embodiments, the cases where the intermediate press-formed product includes the bending portion formed by plastic deformation are shown. However, instead of the intermediate press-formed product, a steel having a bending portion (that is, a bending portion which is formed by elastic deformation) which is formed by the own weight of the intermediate press-formed product may be used.

Moreover, for example, in the eighth embodiment, the case is shown, in which the cam driver 825 of the upper press tool 820 comes into contact with the cam slider 815 of the lower press tool 810, and thus, the short-side wall 814 approaches the short-side wall 13. However, a separate slide mechanism may be provided on the lower press tool 810 so as to independently control the upper press tool 820 and the lower press tool 810.

In addition, for example, the direction of the bending or a bending amount of the bending in the intermediate press-formed product may be appropriately adjusted as long as the intermediate press-formed product is bent toward the thickness direction of the web portion. In addition, the intermediate press-formed product may be bent in an arc shape, or may be bent in an elliptical arc shape.

INDUSTRIAL APPLICABILITY

According to the present invention, it is possible to provide a method for manufacturing the press-formed product, the device for manufacturing the press-formed product, the mandrel, and the press-formed product capable of simultaneously achieving a decrease in weight and high rigidity without the need of welding.

BRIEF DESCRIPTION OF THE REFERENCE SYMBOLS

1: DEVICE FOR MANUFACTURING PRESS-FORMED PRODUCT (FIRST EMBODIMENT)
10: LOWER PRESS TOOL (FIRST PRESS TOOL)
11: BASE PORTION
12: LONG-SIDE WALL
13: SHORT-SIDE WALL (RESTRICTION WALL)
14: GROOVE PORTION
20: UPPER PRESS TOOL (SECOND PRESS TOOL)
21: MAIN BODY PORTION

22: PUNCH PORTION
23: CONVEX PORTION
51: INTERMEDIATE PRESS-FORMED PRODUCT
52: WEB PORTION
52A: LINEAR PORTION OF WEB PORTION
52B: BENDING PORTION OF WEB PORTION
53: VERTICAL WALL PORTION
53*a*, 53*b*: SHORT SIDE OF VERTICAL WALL PORTION
200: DEVICE FOR MANUFACTURING PRESS-FORMED PRODUCT (SECOND EMBODIMENT)
210: LOWER PRESS TOOL
214: CONVEX PORTION OF BASE PORTION
220: UPPER PRESS TOOL
222: PUNCH PORTION
223: CONCAVE PORTION
251: INTERMEDIATE PRESS-FORMED PRODUCT
252: WEB PORTION
252*a*: LINEAR PORTION OF WEB PORTION
252*b*: BENDING PORTION OF WEB PORTION
253: VERTICAL WALL PORTION
253*a*, 253*b*: SHORT SIDE OF VERTICAL WALL PORTION
300: DEVICE FOR MANUFACTURING PRESS-FORMED PRODUCT (THIRD EMBODIMENT)
331: BLANK HOLDER PAD (BLANK HOLDER TOOL)
400: DEVICE FOR MANUFACTURING PRESS-FORMED PRODUCT (FOURTH EMBODIMENT)
500: DEVICE FOR MANUFACTURING PRESS-FORMED PRODUCT (FIFTH EMBODIMENT)
510: MANDREL
511: DIVISION BODY
520: CONNECTION BODY
600: DEVICE FOR MANUFACTURING PRESS-FORMED PRODUCT (SIXTH EMBODIMENT)
610: MANDREL
611: DIVISION BODY
613: CONCAVE PORTION
616: SLIDE BODY
617: ELASTIC BODY
700: DEVICE FOR MANUFACTURING PRESS-FORMED PRODUCT (SEVENTH EMBODIMENT)
800: DEVICE FOR MANUFACTURING PRESS-FORMED PRODUCT (EIGHTH EMBODIMENT)
810: LOWER PRESS TOOL
813: SHORT-SIDE WALL (FIXING RESTRICTION WALL)
814: SHORT-SIDE WALL (PRESSURIZATION RESTRICTION WALL)
815: CAM SLIDER
816: SUPPORT PORTION
817: SLIDE PIN
818: RETURN SPRING
820: UPPER PRESS TOOL
825: CAM DRIVER
900: DEVICE FOR MANUFACTURING PRESS-FORMED PRODUCT (NINTH EMBODIMENT)
920: UPPER PRESS TOOL

The invention claimed is:

1. A method for manufacturing a press-formed product, comprising:

a first step of preparing a long material having an elongated web portion and a vertical wall portion, the elongated web portion having a bending portion, the long material being the press-formed product, the long material having distal end surfaces; and a second step of compressing the bending portion in a longitudinal direction by decreasing curvature of a concave side of the bending portion while restricting both ends of the long material in the longitudinal direction at the distal end surfaces of the vertical wall portion and by increasing a cross-sectional area of the long material.

2. The method for manufacturing a press-formed product according to claim 1, wherein in the second step, the curvature decreases while the shortest distance between both ends of the long material is constantly maintained.

3. The method for manufacturing a press-formed product according to claim 1, wherein in the second step, the curvature decreases while a shortest distance between both ends of the long material decreases.

4. The method for manufacturing a press-formed product according to claim 1, wherein in the second step, the curvature decreases while at least a concave side of the bending portion of the long material is supported.

5. The method for manufacturing a press-formed product according to claim 1, wherein in the second step, the curvature decreases in stages.

6. The method for manufacturing a press-formed product according to claim 1, wherein planes including edges of both ends of the long material are parallel with each other.

7. The method for manufacturing a press-formed product according to claim 2, wherein in the second step, the curvature decreases while at least a concave side of the bending portion of the long material is supported.

8. The method for manufacturing a press-formed product according to claim 3, wherein in the second step, the curvature decreases while at least a concave side of the bending portion of the long material is supported.

9. The method for manufacturing a press-formed product according to claim 1, wherein the bending portion has a vertex portion at a convex side thereof, and in the second step, decreasing the curvature of the bending portion by pressing only the vertex portion of the bending portion while restricting the both ends of the long material in the longitudinal direction at the distal end surfaces.

* * * * *